US008348755B2

(12) United States Patent
Kelly et al.

(10) Patent No.: US 8,348,755 B2
(45) **Date of Patent: *Jan. 8, 2013**

(54) POWER WINNERS PROCESSING SYSTEM

(75) Inventors: Bryan M. Kelly, Alamo, CA (US); Patricia A. McMahan, Vineland, NJ (US); Frank J. Silvestro, Tuckerton, NJ (US); Wayne W. Walkwitz, Waterford Works, NJ (US); Paul C. McLaughlin, Brigatine, NJ (US); Ryan Randazzo, Glendora, NJ (US)

(73) Assignee: Bally Gaming, Inc., Las Vegas, NV (US)

( * ) Notice: Subject to any disclaimer, the term of this patent is extended or adjusted under 35 U.S.C. 154(b) by 765 days.

This patent is subject to a terminal disclaimer.

(21) Appl. No.: 12/113,026

(22) Filed: Apr. 30, 2008

(65) Prior Publication Data

US 2008/0305864 A1 Dec. 11, 2008

Related U.S. Application Data

(63) Continuation-in-part of application No. 11/208,198, filed on Aug. 19, 2005.

(51) Int. Cl.
*A63F 9/00* (2006.01)

(52) U.S. Cl. ..... 463/27

(58) Field of Classification Search ..... 463/25, 463/27, 43

See application file for complete search history.

(56) References Cited

U.S. PATENT DOCUMENTS

| | | | | |
|---|---|---|---|---|
| 5,280,909 | A * | 1/1994 | Tracy | 463/27 |
| 6,266,103 | B1 * | 7/2001 | Barton et al. | 348/675 |
| 6,604,997 | B2 * | 8/2003 | Saidakovsky et al. | 463/9 |
| 2002/0004424 | A1 * | 1/2002 | Nelson et al. | 463/42 |
| 2002/0042299 | A1 * | 4/2002 | Soltys et al. | 463/29 |
| 2002/0160825 | A1 * | 10/2002 | Nicastro et al. | 463/16 |
| 2003/0027625 | A1 * | 2/2003 | Rowe | 463/20 |
| 2003/0119586 | A1 * | 6/2003 | Crumby | 463/26 |
| 2004/0043810 | A1 * | 3/2004 | Perlin et al. | 463/16 |
| 2005/0037837 | A1 * | 2/2005 | Rowe | 463/25 |
| 2005/0215314 | A1 * | 9/2005 | Schneider et al. | 463/26 |
| 2005/0288081 | A1 * | 12/2005 | Amaitis et al. | 463/6 |
| 2006/0030399 | A1 * | 2/2006 | Baerlocher | 463/20 |
| 2006/0183538 | A1 * | 8/2006 | Michaelson et al. | 463/27 |
| 2007/0060320 | A1 * | 3/2007 | Kelly et al. | 463/27 |
| 2007/0167210 | A1 * | 7/2007 | Kelly et al. | 463/16 |
| 2007/0167226 | A1 * | 7/2007 | Kelly et al. | 463/29 |
| 2007/0259709 | A1 * | 11/2007 | Kelly et al. | 463/20 |
| 2008/0254893 | A1 * | 10/2008 | Patel et al. | 463/42 |
| 2008/0305865 | A1 * | 12/2008 | Kelly et al. | 463/27 |
| 2008/0305866 | A1 * | 12/2008 | Kelly et al. | 463/27 |
| 2009/0088244 | A1 * | 4/2009 | Nicely et al. | 463/27 |

* cited by examiner

*Primary Examiner* — Melba Bumgarner
*Assistant Examiner* — Seng H Lim
(74) *Attorney, Agent, or Firm* — Steptoe & Johnson LLP

(57) ABSTRACT

A system and method is disclosed for a multi-site casino or resort wide promotional winners selection. The system selects a winner based on playing with a card at a table game or slot machine, or just being at an active slot machine, opened table game, or other activity within a resort.

9 Claims, 27 Drawing Sheets

Master Table Current Value-12:14 AM

| Row | Time | Active Carded Players |
|---|---|---|
| 1 | 12:00 AM | 25 |
| 2 | 12:15 AM | 22 |
| 3 | 12:30 AM | 18 |
| 4 | 12:45 AM | 15 |
| 5 | 1:00 AM | 12 |
| ... | ... | ... |
| 94 | 11:15 PM | 43 |
| 95 | 11:30 PM | 38 |
| 96 | 11:45 PM | 28 |

Master Table New Value-12:15 AM

| Row | Time | Active Carded Players |
|---|---|---|
| 1 | 12:00 AM | 25 |
| 2 | **12:15 AM** | **26** |
| 3 | 12:30 AM | 18 |
| 4 | 12:45 AM | 15 |
| 5 | 1:00 AM | 12 |
| ... | ... | ... |
| 94 | 11:15 PM | 43 |
| 95 | 11:30 PM | 38 |
| 96 | 11:45 PM | 28 |

Sorted Table (after 12:15 AM Interval updated)

| Row | Time | Active Carded Players |
|---|---|---|
| 1 | 1:00 AM | 12 |
| 2 | 12:45 AM | 15 |
| 3 | 12:30 AM | 18 |
| 4 | 12:00 AM | 25 |
| ... | ... | ... |
| **87** | **12:15 AM** | **26** |
| ... | ... | ... |
| 95 | 11:30 PM | 38 |
| 96 | 11:15 PM | 43 |

FIG. 6

186 eGameCash Purchase

Your eGameCash=$0.00 Your Bonus Points(17898) Your eCash ($5.00) Your Base Game Cash ($25.25)

Please choose
1) Transfer Base game credits to your eGameCash account ($1.00=$1.00eGameCash)
2) Purchase eGameCash with Bonus Points ($1.00 eGameCash=100 Bonus Points)
3) Transfer from eCash account ($1.00 eGameCash=$1.00 eCash
4) Convert Prize Points to eGameCash ($1.00 eGameCash=850 Prize Points)
5) Banking Transfer
6) 3rd party transfer Select Back

188

John Doe's Account Activity Detail Page Trans ID 16981

Description: You advance to level 2 player & win 50 raffle tickets to yearly raffle.
Tourn ID=8836892. Tourn Start Time: 6/8/05 6:15am Tourn Close Time: 6/9/04 6:15am
Type: Daily Tournment

| Date | # | Player Name | Score | Prize |
|---|---|---|---|---|
| 6/8/05 6:15am | #1 | Bob L | 187,984 | $5.00 eGameCash |
| 6/9/05 6:00am | #2 | You | 182,111 | Advance to level 2 + 50 raffle tickets to raffle ID 187. |
| 6/9/05 6:01am | #3 | Wait | 177,838 | - |
| 6/9/05 6:04am | #4 | Warren | 172,111 | - |

...
...

More Prev

Back

188

John Doe's Account Activity

| Trans ID | Date | TYPE | Description |
|---|---|---|---|
| 11363 | 6/7/04 3:30pm | Raffle Win | $25 raffle won |
| 11981 | 6/7/04 3:31pm | Game Win | $1.25 eGame Cash won on Blazing 7's |
| 16981 | 6/9/04 6:15am | Tourn Win | You advance to level 2 |
| 16997 | 6/9/04 6:16am | Transfer | $50.00 eGameCash to base game Credits |
| 17981 | 6/9/04 6:20pm | Sweepstacks | 50 tickets purchased for Sweep ID 587 |
| 18941 | 6/9/04 6:40pm | 3rd Party Game | $5 transfer to Keno-online.com |

More Previous Search/Sort Show Detail

Back

FIG. 7

190

Game Selection

| | | |
|---|---|---|
| Poker 50¢ | Black Jack 50¢ | Bingo |
| Keno | Poker $1 | Black Jack $1 |
| Cancel/Back | | More... |

192

Game Setup -Bingo Mania (min cost $.25) (1 cent per ball)

| | Current Value | |
|---|---|---|
| Change Denomination ($.01,.05,.10,.25,.50,$1.00) | .25 | modify |
| AutoPlay/Normal Mode | Auto | modify |
| Play for Points | No | modify |
| Play for eGameCash | Yes | modify |
| # of Credits | 3 | modify |
| View Bingo Mania Rules | | |
| Fast Play/Slow Play | Fast | modify |

Cancel Play Game

194

John Doe Account

DONE

| | |
|---|---|
| eGameCash(cashable) | $2.50 |
| eGameCash(un-cashable) | $5.00 |
| Bonus Points(cashable) | 23,768 |
| PrizePoints | 102,304pp |
| eCash | $5.00 |
| Base Game Cash | $20.25 |

| | | |
|---|---|---|
| Get eGameCash | Cashout eGameCash | Convert Points to Base game credits |
| View Account history | Set up preferences | |

Messaging-Prompt area

FIG. 8

196

Mounds of Money

Just by playing this Slot machine you can also win large cash progressives in addition to your other Bonus System Games winnings

| | |
|---|---|
| Super Progressive: | $123,052.11 |
| Weekly Progressive: | $ 7,988.23 |
| Daily Progressive: | $ 1,134.98 |

Winners will be chosen at surprise time, and you can be one of them. So hurry up and get playing.

198

Mounds of Money Winner!

YOU JUST WON a surprise progressive Bonus Jackpot

Amount: $1,155.91

Touch here to collect your winnings.

FIG. 9

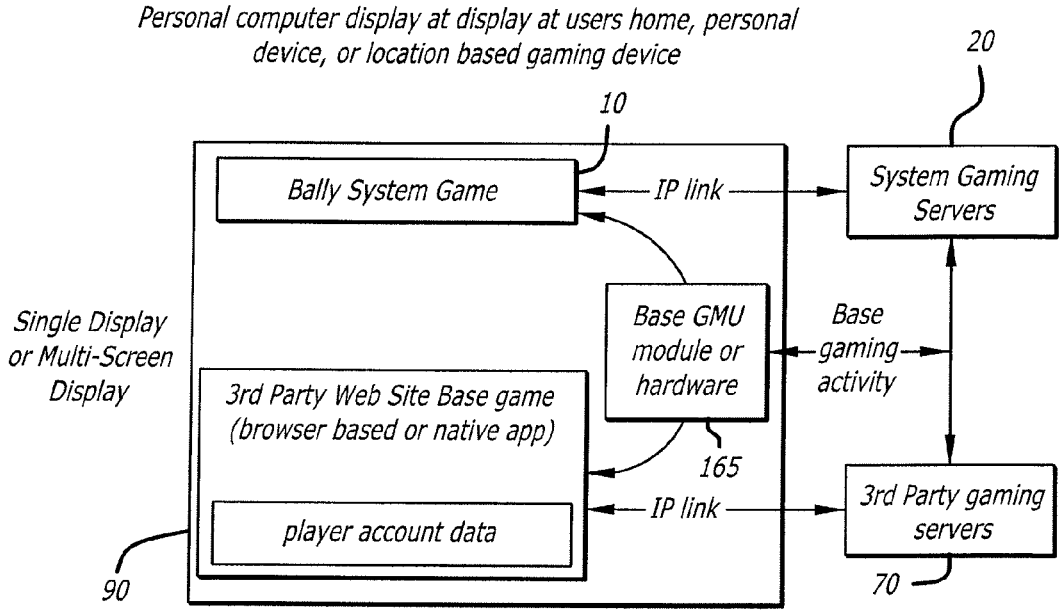

| Card# | eGameCash (uncashable) | eGameCash (cashable) | eGameCash (player funded) | eGameCash (cashable) |
|---|---|---|---|---|
| 132 | $01.1200 | $00.0000 | $00.0000 | 150,000 |
| 384 | $23.2300 | $10.1000 | $00.0000 | 123,013 |
| 892 | $15.0000 | $01.5000 | $00.0000 | 15,001 |
| 126 | $00.0000 | $00.0000 | $00.0000 | 0 |
| .. | .. | .. | .. | .. |
| .. | .. | .. | .. | .. |
| . | . | . | . | . |

POWER WINNERS PROCESSING SYSTEM

CROSS-REFERENCE TO RELATED APPLICATIONS

This application is a continuation-in-part of U.S. patent application Ser. No. 11/208,198, filed on Aug. 19, 2005, entitled PROGRESSIVE GAME AND PROCESSING SYSTEM THEREOF, which is hereby incorporated by reference. This application is also related to co-pending U.S. patent application Ser. No. 12/113,057 concurrently filed on Apr. 30, 2008, entitled POWER WINNERS PROCESSING METHOD and U.S. patent application Ser. No. 12/113,039 concurrently filed on Apr. 30, 2008, entitled POWER WINNERS PROCESSING ENGINE.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD

These embodiments relate generally to a gaming system that incorporates a progressive game and, more particularly, to a gaming system that incorporates a multi-site, customizable, time-based, promotional progressive game that selects one or more winners from among eligible players at slot machines, table games, or both.

BACKGROUND

Casinos have long sought new ways to induce play on the gaming devices. They try to increase player time on gaming devices, average wager amount, and speed of play. Various techniques have been used in attempts to gain higher casino profits. One such technique in the casino gaming industry is the use of secondary bonus rounds or bonus games. This usually takes the form of a second level inside a base game of a gaming device embodied in software or an add-on top box bonus game. Newer game titles can be created with these secondary levels of play providing a player additional chances of winning even larger prize rewards. Older game titles do not have these newer secondary games or bonus rounds due to game software and hardware upgrade costs, and/or lack of interest of game manufacturers to re-code or configure legacy software, which is often a very difficult task. Also, game resubmission to regulatory agencies is prohibitive in relation to cost, time, and resources. The game manufacturer would rather focus on creating these new features on new software titles under development using a more modern hardware/software platform. As such, it is difficult to provide players of these older gaming devices a secondary "win" opportunity.

In the last decade, player tracking systems have emerged, wherein a player registers for a player-tracking card at a registration desk. The player is typically given a plastic magnetic strip player card for use while playing gaming devices on the casino floor or at the card tables. Each player card has a number on it that associates it with a player record in a casino marketing promotion server.

More recent additions to the casino player tracking systems provide bonus prizes or prize pools that are periodically given to carded players on a random basis to give the player the more instantaneous and larger rewards verses the slow accrual of Bonus Points. This is done for several reasons: to help induce play on the gaming device; to encourage players to become carded players; to create player loyalty for the casino; and to provide bonus prizes without modifying the base gaming device software.

SUMMARY

Briefly and in general terms, a multi-site progressive processing method for providing an opportunity to win a progressive prize, wherein the progressive gaming method has a progressive prize value that increases according to a progressive prize growth rate. The progressive processing method includes: funding a progressive prize using non-gaming funds; selecting how many properties are incorporated into the multi-site progressive prize opportunity; determining when the progressive prize is triggered at a random time during a progressive processing bonus period; halting the growing progressive prize value when the trigger time has been reached; notifying a winners application that it is time to select one or more random winners from among eligible players; identifying the progressive prize value; notifying signage display controllers of the current progressive values and that a winner is to be drawn; randomly selecting one or more winners based upon criteria in the winners application; sending winners data to the signage display controllers for display on signage; sending the progressive prize to one or more winners' player account or to an awarding marketing location; and sending notification of the prize to one or more gaming machines at which the one or more winning players are located.

Additionally, in some embodiments, the multi-site progressive processing method further includes: designating eligible players from players at slot machines, players at table games, or players at slot machines and table games. In still other embodiments, the multi-site progressive processing method further includes: designating eligible players from active players with cards, active players without cards, or all active players.

Other features and advantages of the claimed invention will become apparent from the following detailed description when taken in conjunction with the accompanying drawings, which illustrate by way of example, the features of the claimed invention.

BRIEF DESCRIPTION OF THE DRAWING

FIG. 6 illustrates an eCash purchase screen where a player may transfer credits from one form to another, as well as additional personal account activity screens;

FIG. 7 illustrates a game setup screen for modifying a bingo game, a game selection screen, and a personal account display screen that shows both cashable and uncashable funds for a system game in the same display screen;

FIG. 8 illustrates a user interface for a progressive game in attract mode, as well as a user interface for a progressive game showing an "award display screen" after a progressive prize has been won;

FIG. 9 illustrates a progressive processing system incorporating web services that enable viewing of the progressive games from a home web browser or other personal client computing device;

DETAILED DESCRIPTION

One embodiment of the time-based progressive game and method is implemented over a gaming system on a system game user interface of a gaming machine. In this manner, the time based progressive game increases user excitement and competition, thereby increasing a user's average playing time on gaming machines in the gaming system. In one embodiment (described in detail below in the multi-site power winners section), a multi-site power winners system is configured for both slot machines and table games with a parent property and one or more additional local properties. In such an embodiment, the multi-site power winners system provides a method of selecting a winner for a prize in a multi-site casino or resort environment. Additionally, the system provides the properties with the ability to configure a combined jackpot amount across one or more properties. In a more basic embodiment, the gaming system includes one or more gaming machines that are connected to a system server, preferably over a network. The system game user interface utilized by the time-based progressive game and method provides enhanced player satisfaction and excitement through player competition (or perceived competition) and additional opportunities to "win," which results in increased user playing time on games in the system.

Figure 1:
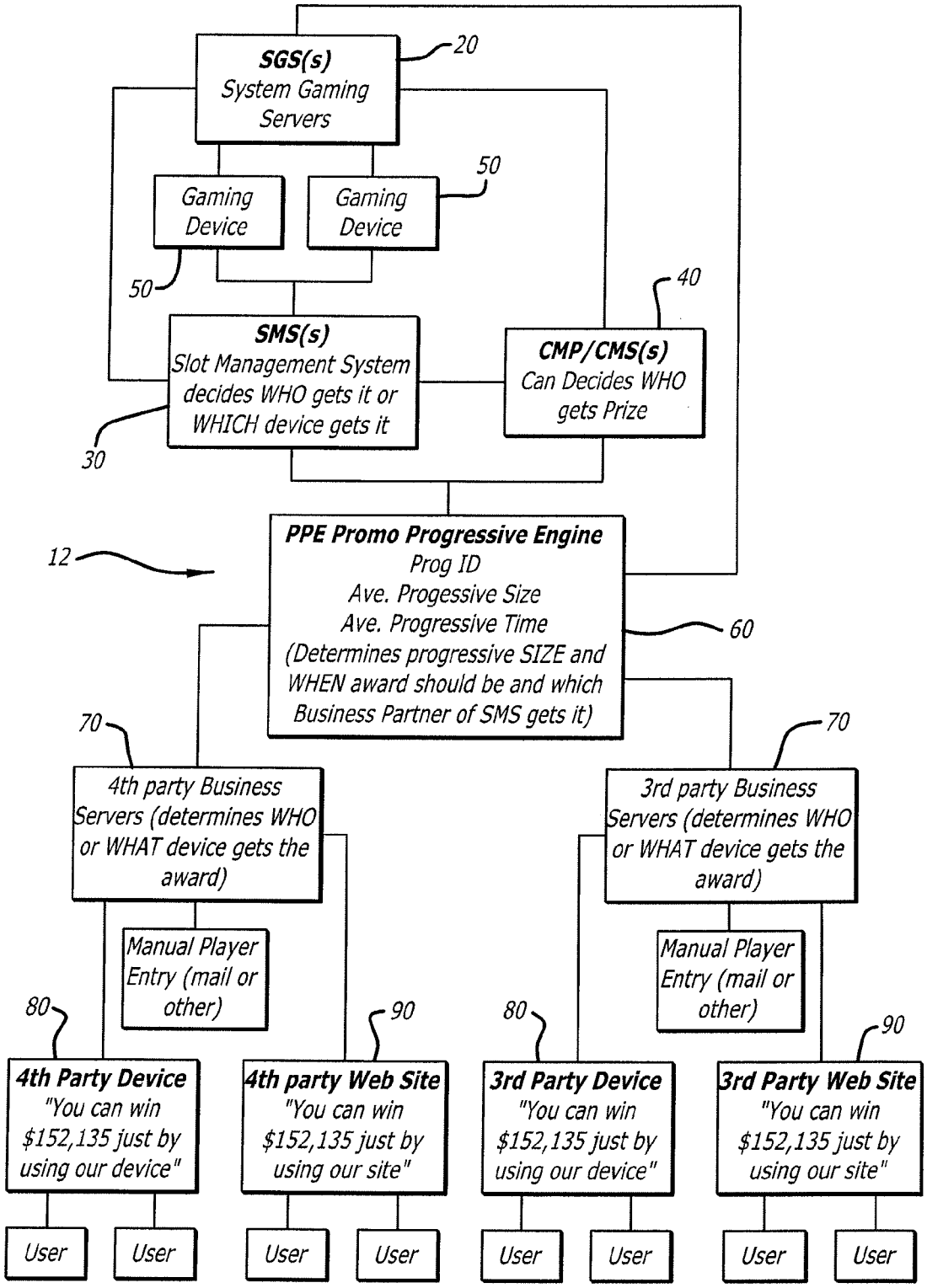
FIG. 1 illustrates a relational diagram of a progressive processing system, configured in accordance with the claimed invention, interconnected with associated servers and devices.
Figures 1, 2A:
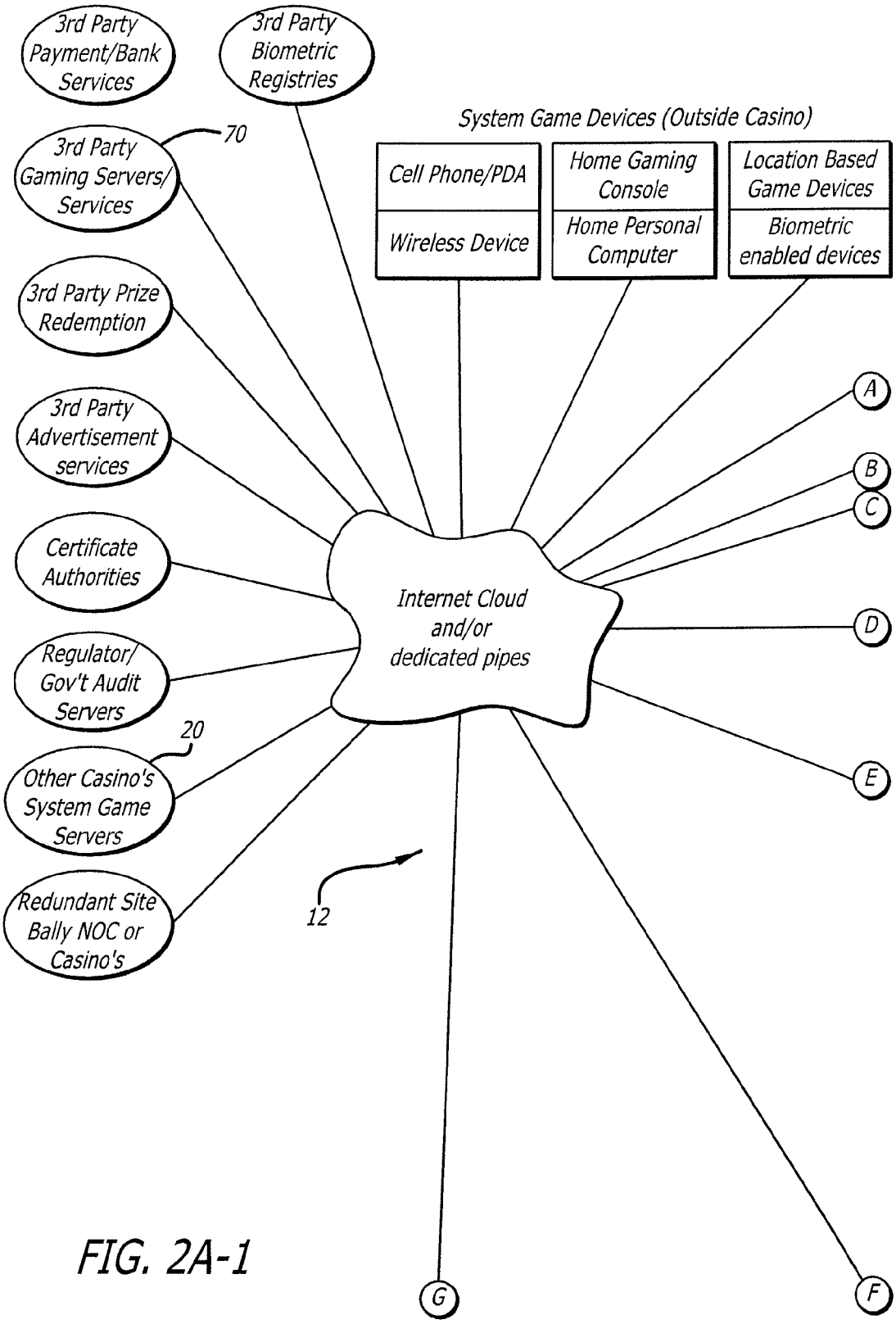
FIG. 2A illustrates a relational diagram of a progressive processing system, interconnected with associated servers, devices, components, services, and the Internet.
Figures 2, 2A:
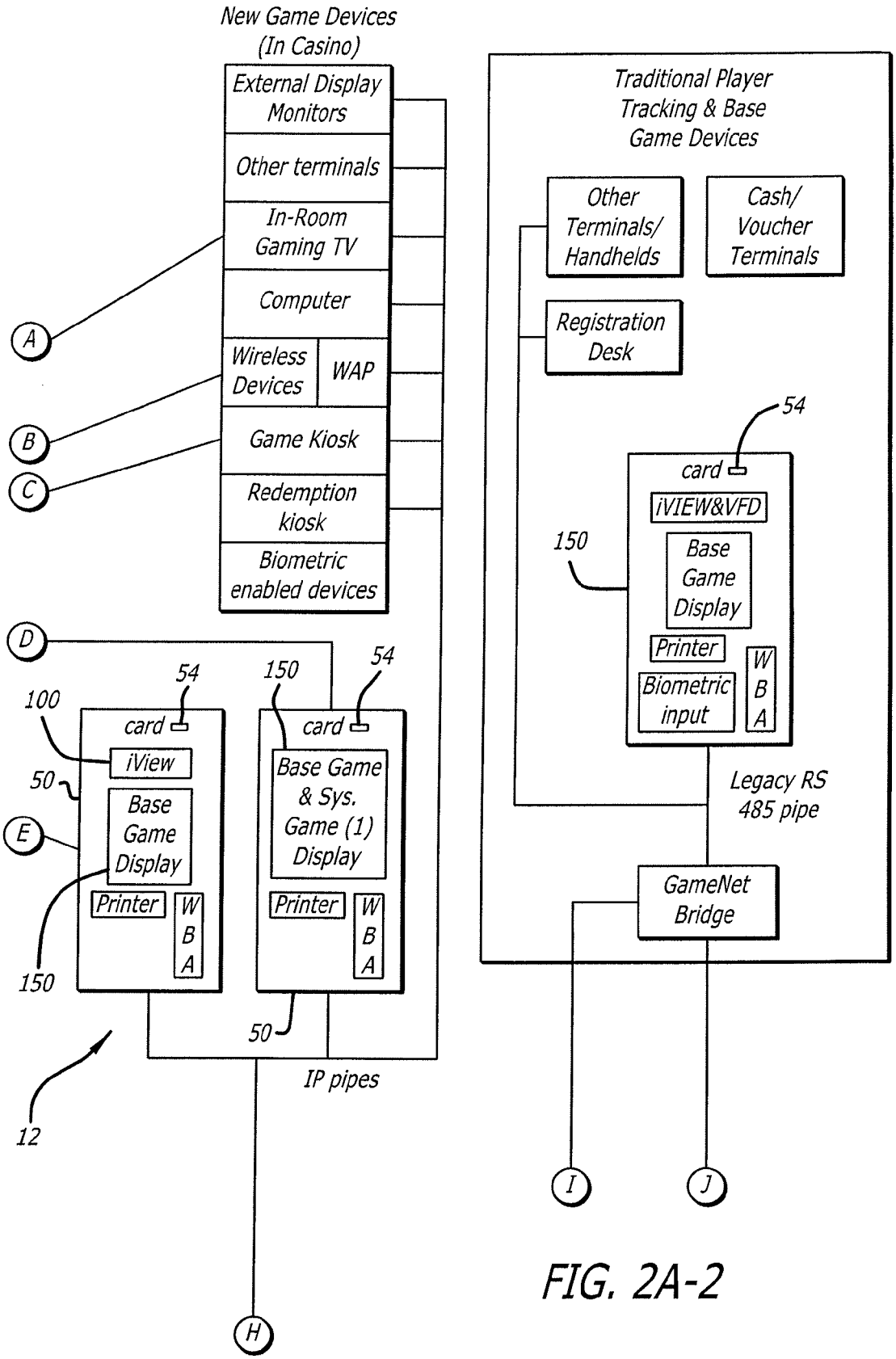
Figures 2, 2A, 3:
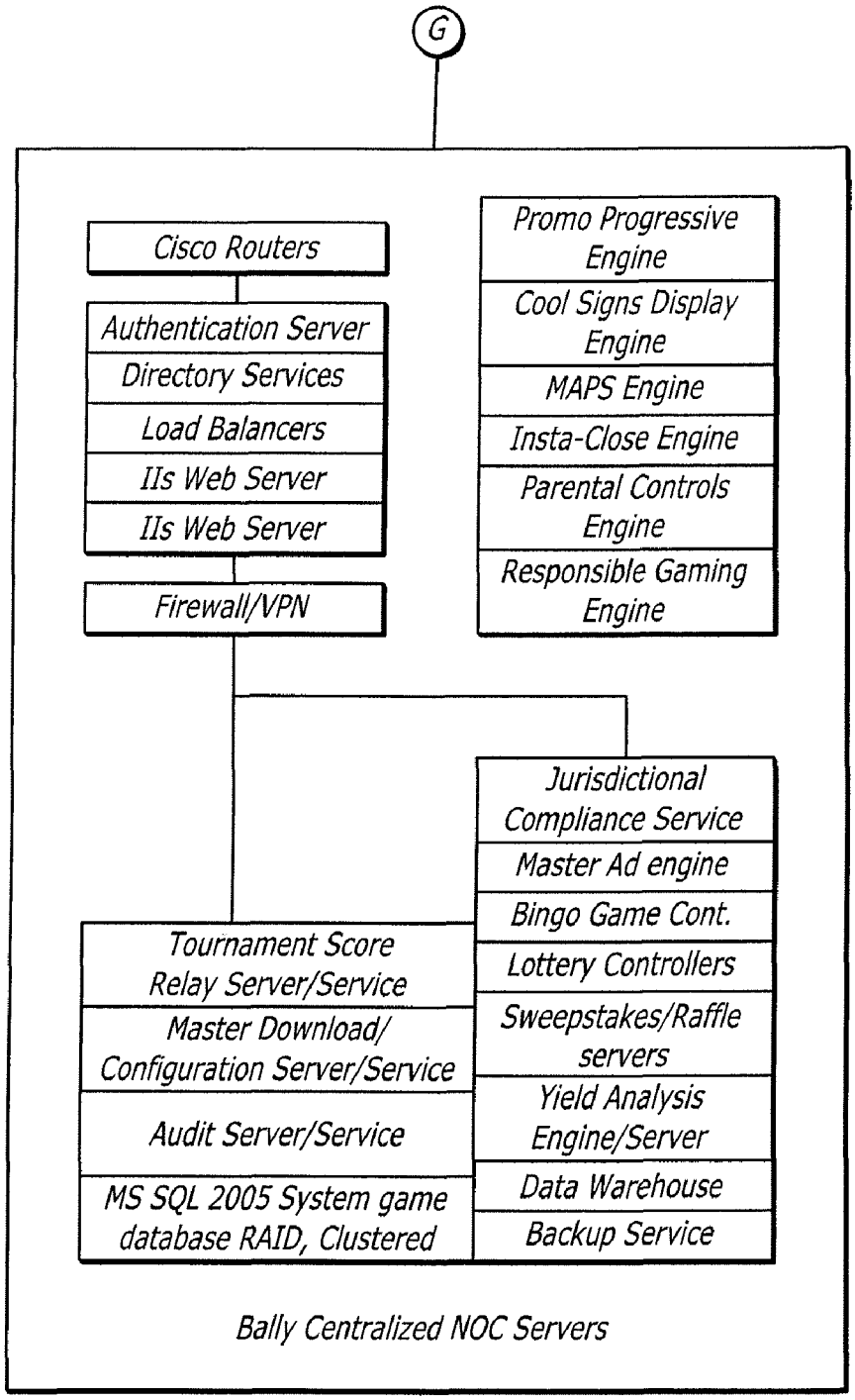
Figures 2, 2A, 3, 4:
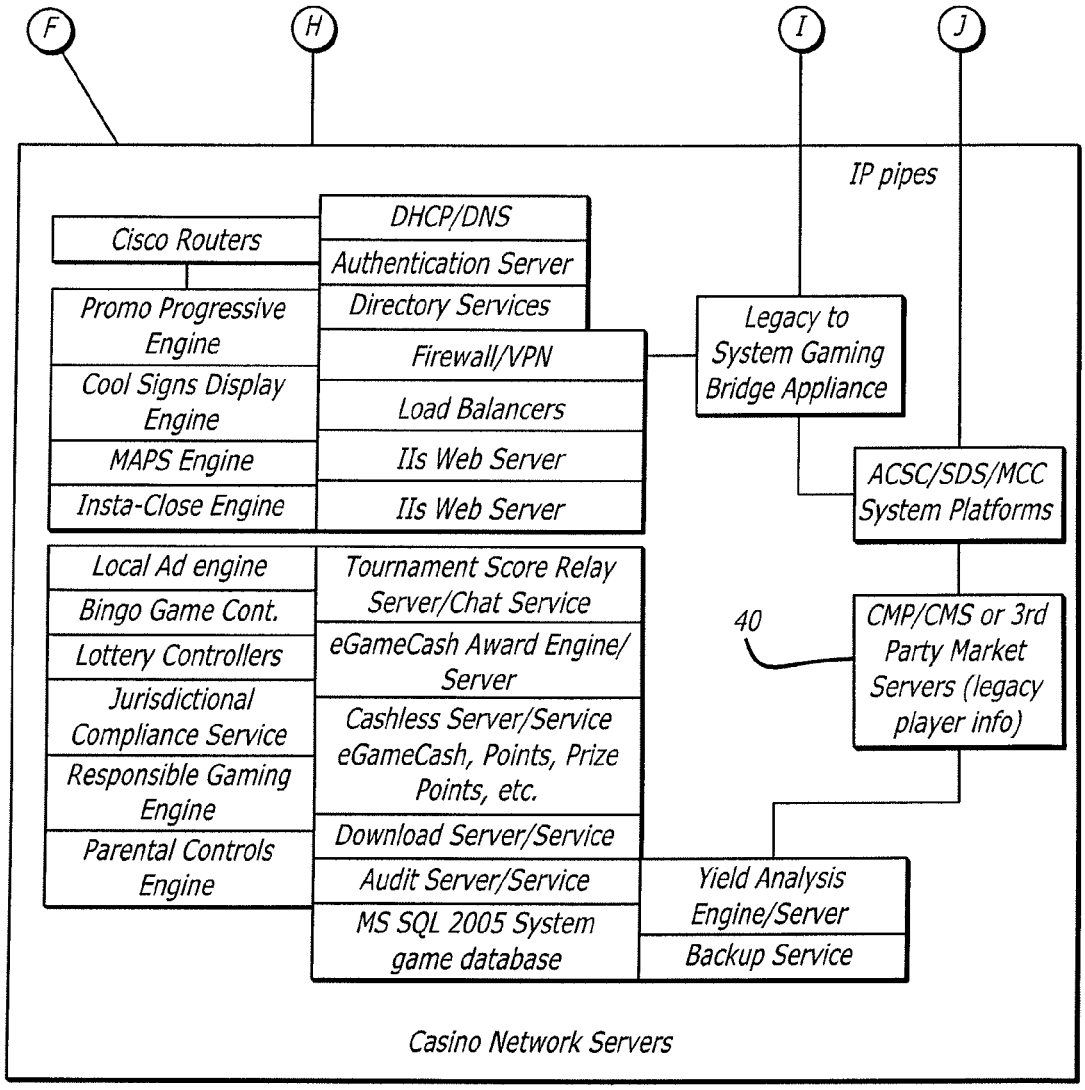
Figure 2B:
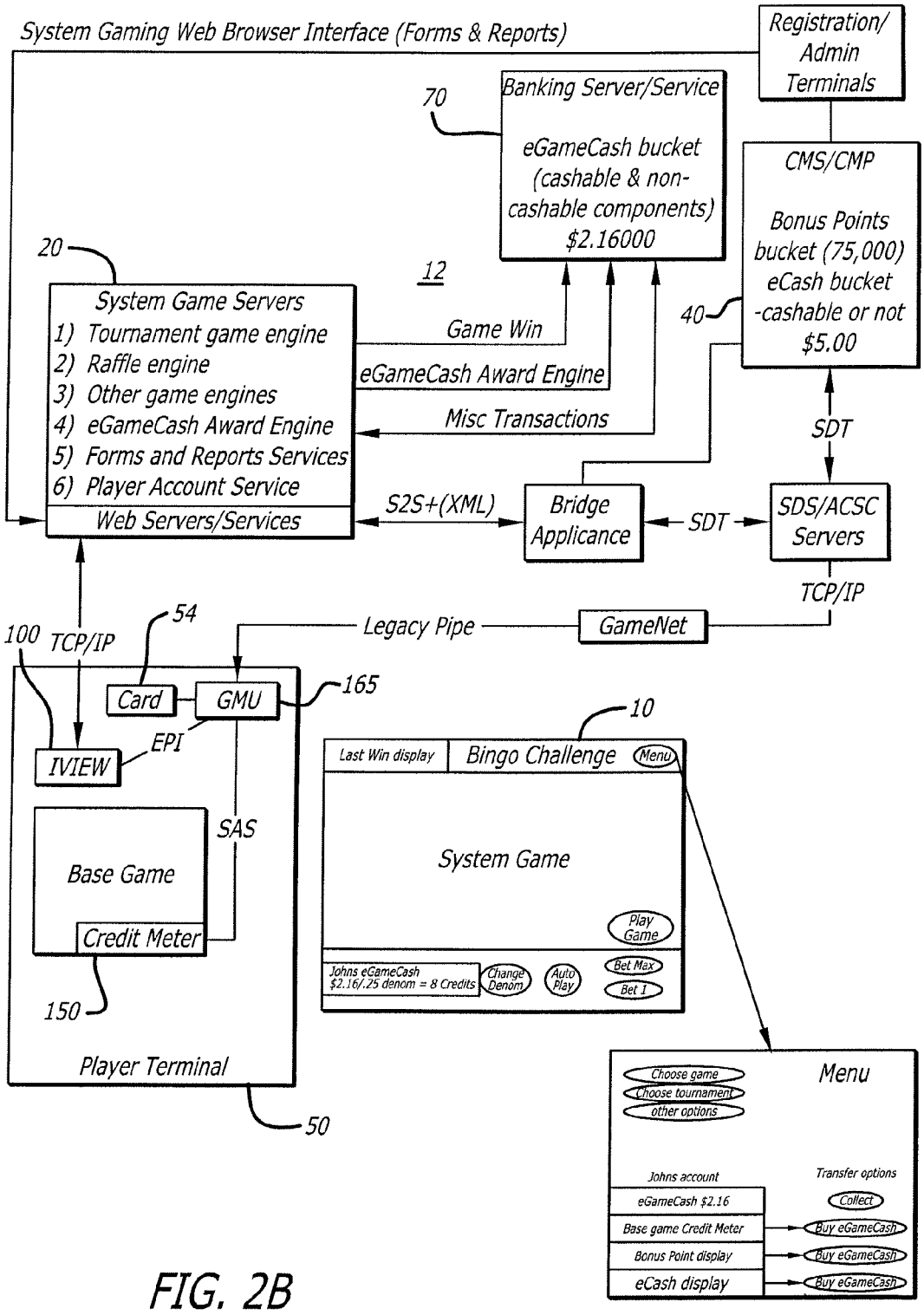
FIG. 2B illustrates a relational diagram of a progressive processing system, interconnected with associated servers, devices, components, services, display screens, and menus.
Figure 3A:
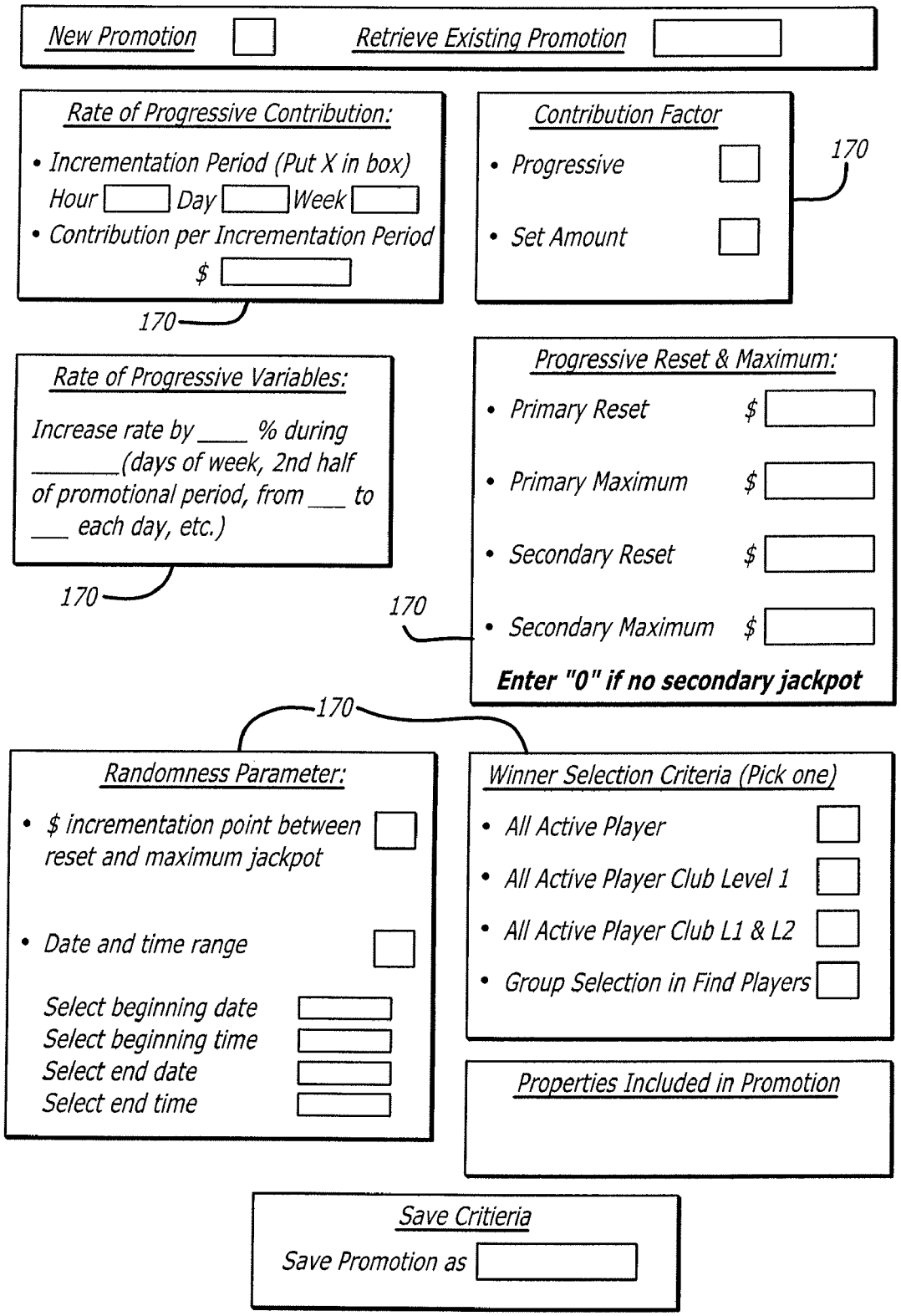
FIGS. 3A-3E illustrate various examples of progressive parameter set-up screens.
Figure 3B:
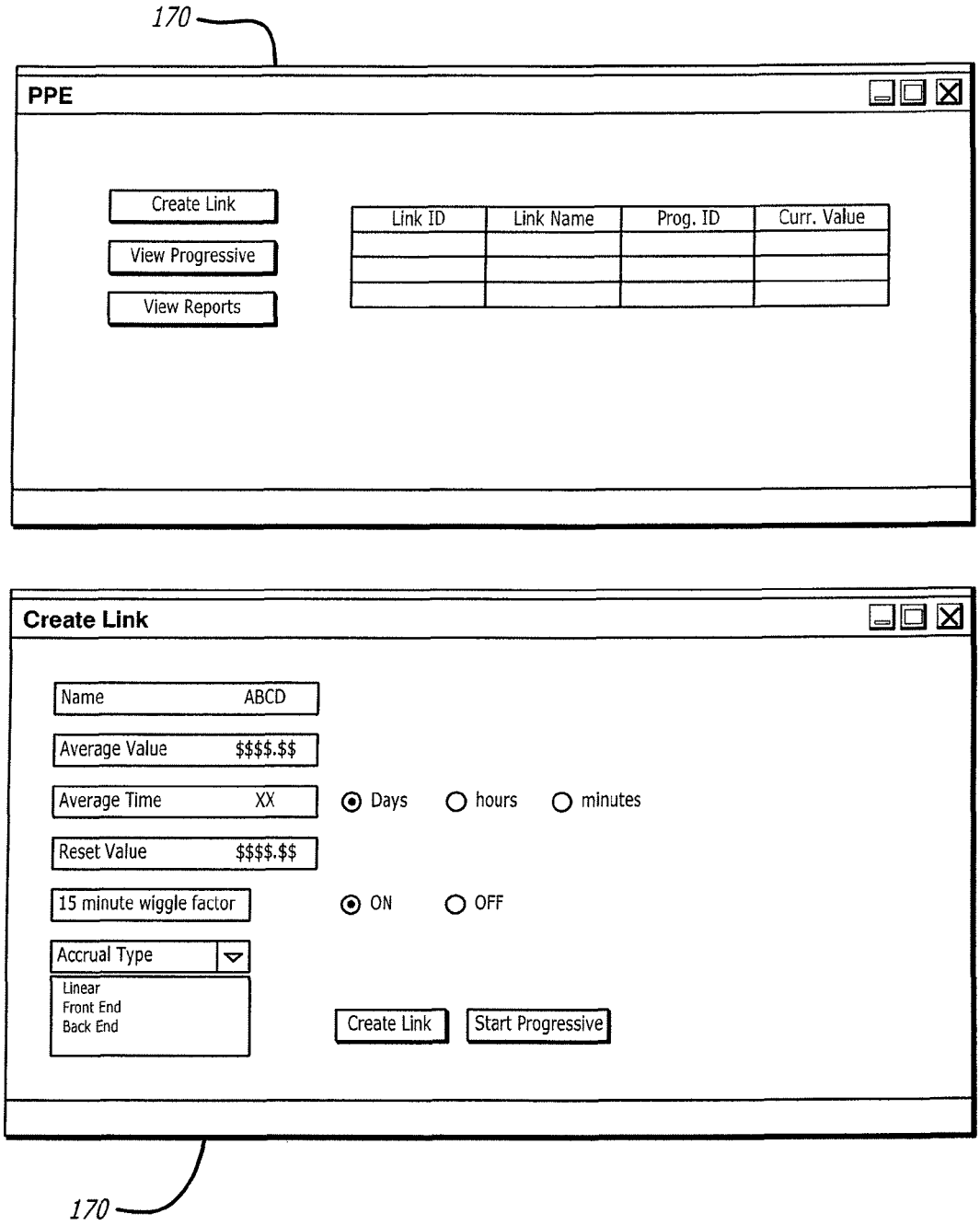
Figure 3C:
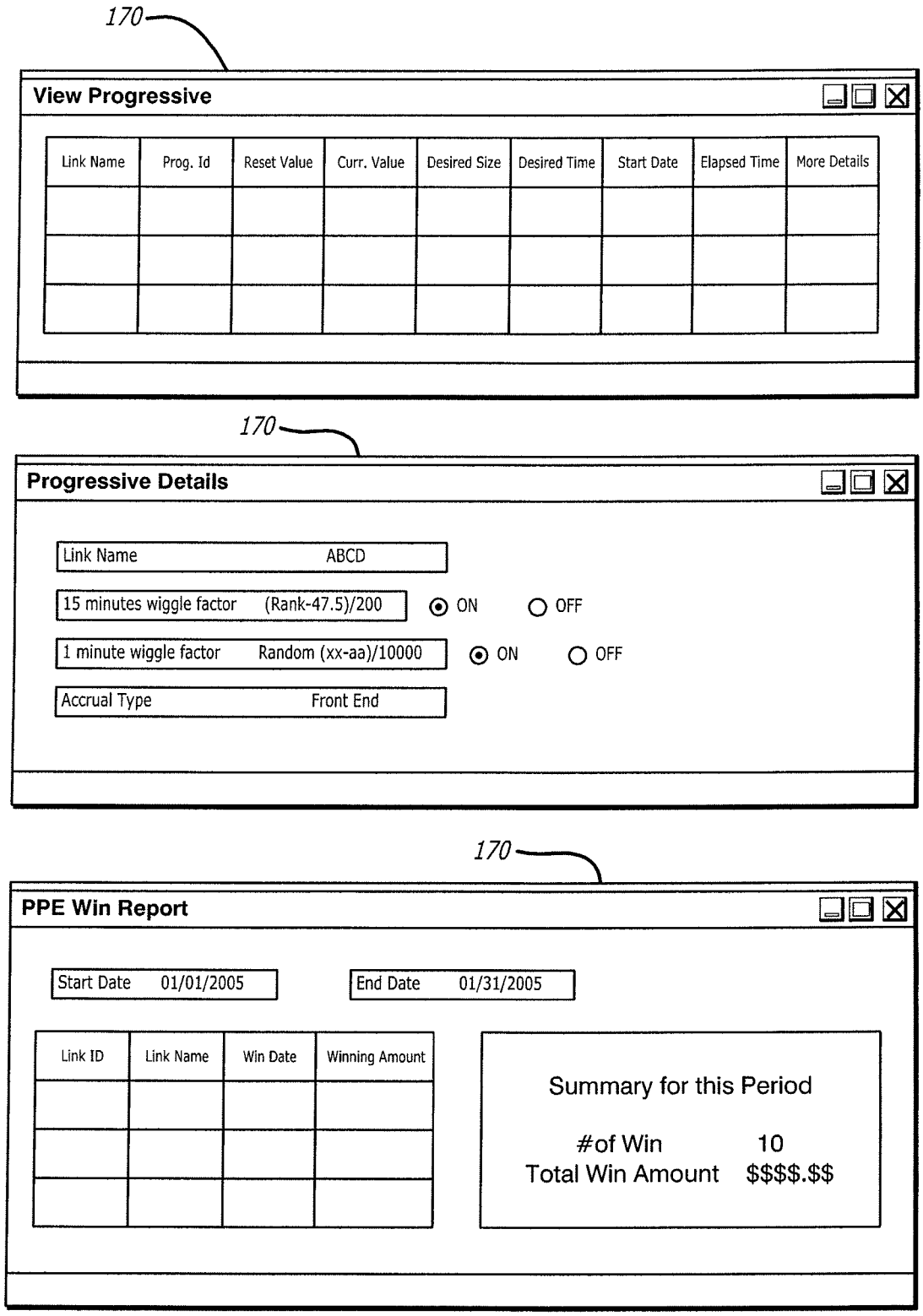
Figure 3D:
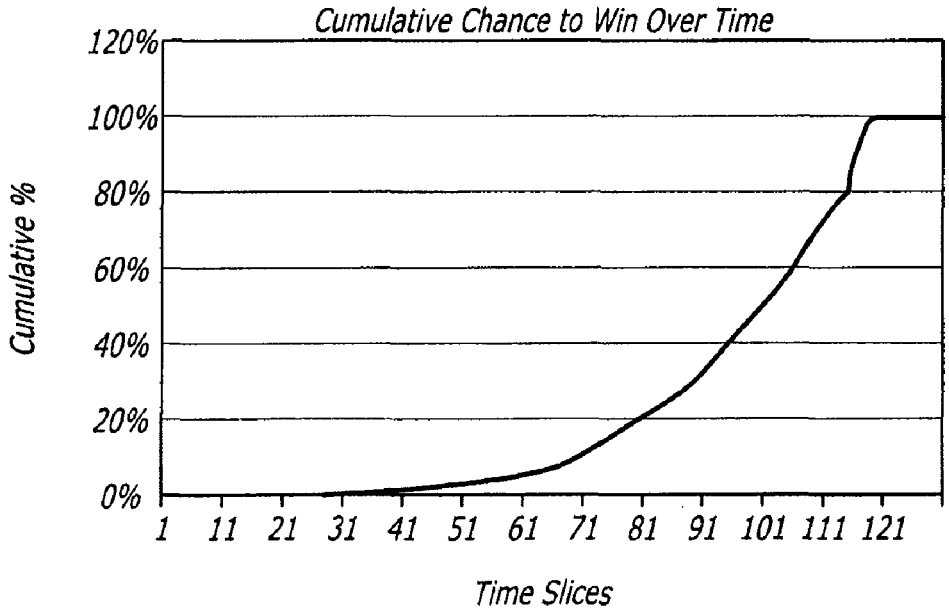
Figure 3E:
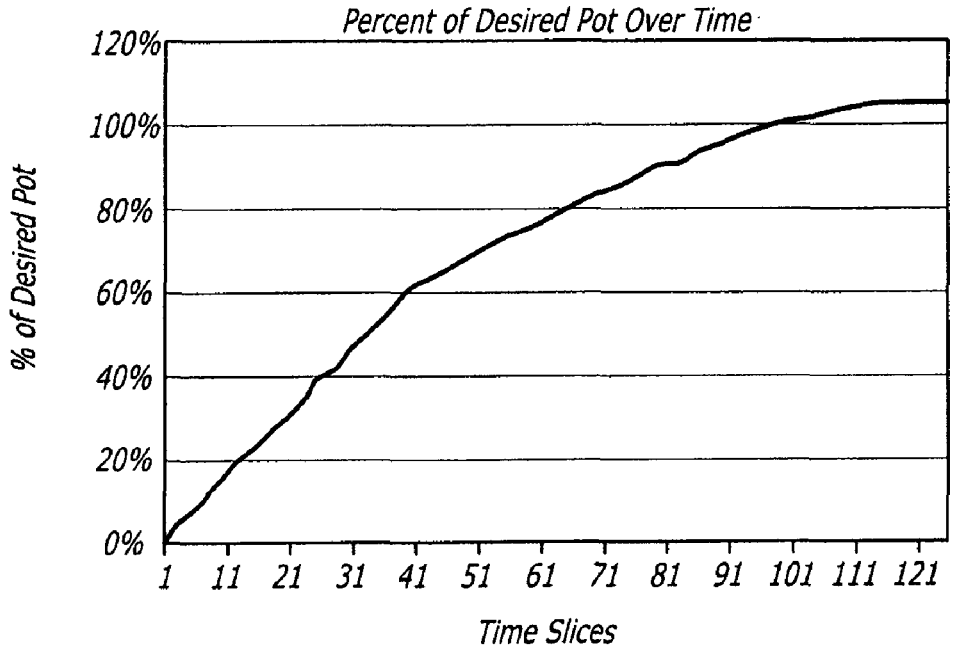

Referring now to the drawings, wherein like reference numerals denote like or corresponding components throughout the drawings and, more particularly to FIGS. 1, 2A, and 2B, there is shown an embodiment of a progressive game 10 implemented on a progressive processing system 12. Specifically, FIG. 1 shows a time-based progressive game 10 implemented on a progressive processing system 12 that includes system gaming servers 20, a slot management system 30, a casino management system 40, gaming machines 50, a progressive engine 60, 3rd and 4th party business servers 70, and 3rd and 4th party devices 80 and web sites 90. In one preferred embodiment, the time-based progressive game 10 is a promotional game, in that it is funded using non-wagered dollars. The time-based progressive game 10 is preferably customizable, enabling gaming parameters of the time-based progressive game to be controlled by casino administrators that implement and manage the game.

Specifically, a casino that employs a preferred embodiment of the progressive game 10 is able to select the targeted progressive prize size and targeted progressive prize length of time until the award is given. This affords casino administrators a much greater (and desirable) amount of control, in contrast to typical progressive games that are usually driven by components such as "coin in" to the gaming machines in the system, which are not controlled by the casino. Furthermore, in a preferred embodiment of a progressive game 10, casino administrators are also able to customize the shape of the "payout curve" (i.e., the curve of progressive prize size versus time at which the progressive prize is paid out). This as well is a highly desirable degree of control that is achievable in a preferred embodiment of a progressive game 10. This payout curve increases the desired excitement and anticipation of the players for the specific progressive.

In a preferred embodiment of the progressive game 10, the casino administrators typically control (1) the targeted length of time at which each progressive prize is to be won, (2) the targeted progressive prize value in dollars, (3) the "enticement factors," if any, that are used to help increase player excitement and/or control of the "payout curve," and (4) the progressive prize reset value. Correspondingly, in a preferred embodiment of the progressive game 10, the progressive processing system 12 typically controls the remaining factors of the progressive game, including by way of example only, and not by way of limitation: (1) the targeted increment rate of the progressive prize, which is calculated using the targeted progressive prize value, the targeted progressive prize time, and any added "enticement" factors; (2) the random number generation algorithm used to determine if there will be a progressive prize winner; and (3) if a progressive prize is to be awarded, the random number generation algorithm used to determine who the award winner will be.

In another preferred embodiment of the progressive game 10, the player selection may not use a random number generator at all. For instance, by way of example only, and not be way of limitation, the slot management system (SMS) may pick the person with the longest current play session, the person with the most money played, the person who lost or won the most money in the last fifteen minutes, the first person to insert a player card into a gaming device at the start of the last fifteen minute period, or any other identifiable selection criteria.

The progressive game 10 includes several desirable characteristics. For example, in a preferred embodiment of the progressive game 10, the player has the opportunity to win a progressive prize from the very beginning of the promotional progressive game cycle. Additionally, in a preferred embodiment of the progressive game 10, the progressive prize growth rate is not directly linked to the wagered "coin in" of floor play (i.e., "coin in" from participating gaming machines does not directly contribute to the progressive prize growth). However, the progressive prize can be indirectly (or partially) linked, if desired, with activity on the gaming floor using an "enticement factor," as described in further detail below. Such an enticement factor can create a casino-moderated "ebb and flow" in response to gaming activity, if the casino so desires.

In some preferred embodiments, the progressive game 10 uses one or more various "enticement" factors that speed up and/or slow down the incremental growth rate of the targeted progressive prize. In one preferred embodiment, one such "enticement" factor (referred to herein as a "floor activity enticement factor") is based on gaming activity on the floor. In an additional preferred embodiment, another such "enticement" factor (referred to herein as an "erratic movement enticement factor") provides the addition of randomized movement to the incremental growth rate, which gives the progressive increment rate a desirable "look and feel" (i.e., makes the players feel like "sometime is happening" or that "sometime is about to happen").

In yet an additional preferred embodiment, another such "enticement" factor is based on the number of eligible players in the progressive gaming system (e.g., the number of player cards inserted in gaming machine) and not the "coin in" amount. Various other types of "enticement" factors are customizable as desired to influence player behavior. For example, in one preferred embodiment, the displays digits of the time-based progressive game 10 count faster from 1 to 3, then slower from 4 to 6, and finally at a medium count rate from 7 to 9.

With respect to another aspect of a preferred embodiment of the progressive game 10, the winning player is selected randomly from among all active players at the time the progressive is awarded. In this regard, an "active player" is defined as a player who has a player tracking card 54 inserted into a gaming machine in the gaming system. In another preferred embodiment, more than one player is randomly selected from among all active players at the time the progressive is awarded. In one such preferred embodiment, the primary winning player receives X % of the progressive prize and the rest of the winning players receive the remainder (100%-X %) of the progressive prize.

In a preferred embodiment, as shown in FIGS. 2A and 2B, the progressive game 10 is a system game that is displayed on a system game user interface 100, such as an iVIEW-type device (described in further detail below). However, in another preferred embodiment, the progressive game 10 may be implemented over another gaming platform. Preferably, one embodiment of the progressive game 10 is a time-based and value-based progressive game, having a progressive prize that is funded from marketing dollars, which is paid to one or more players who have a player-tracking card inserted into the game when the award is activated. However, in another preferred embodiment, the time-based progressive game 10 may utilize other funding methods, as indicated in FIGS. 1, 2A, and 2B (e.g., wagered dollars, 3rd party incentives, 3rd party services, and the like).

In another aspect of a preferred embodiment, the progressive game 10 is self-tunable to a desired casino profitability level by adjusting the targeted progressive prize amount to be awarded and the targeted time in which the progressive prize is to be awarded, during the processing of the progressive prize information, which takes into account the total money in and out of the entire business per unit time. In one preferred embodiment, no player interaction is required with the progressive game in order to enhance the player's ability to win or enhance the amount of the player's win. However, in another preferred embodiment, the progressive game 10 may utilize (or allow) at least some limited type of player interaction like a simulated game bingo. Moreover, an alternative to dispensing cash to players at the gaming terminal is to dispense the prizes to player account buckets, including bonus points, eCash, eGameCash, and the like. In this regard, progressive prizes may be in a form that includes, by way of example only, and not by way of limitation, prize points, bonus points, cash, eCash, eGameCash, or any other point or credit system used by a casino or by a third party (e.g., points.com, airline points, and the like).

As stated above, preferably all players that have their player cards inserted into an eligible gaming machine in the gaming system are eligible to win the progressive prize. Additionally, the progressive prize that is available may be grouped in many different ways, including by way of example only, and not by way of limitation: by game denomination, by group of game machines on the floor (i.e., grouped according to a distinguishable game machine characteristic), or by random grouping of game machines on the floor. Alternatively, the progressive prize available may be inclusive of all game machines on the floor. Otherwise stated, in a preferred embodiment of the time-based progressive game 10, gaming machines on the floor are dynamically groupable by virtually any desired criteria. Moreover, the progressive prize is preferably awarded to a randomly chosen player once the progressive prize requirement has been satisfied, typically using a random number generator algorithm. Alternatively, in another preferred embodiment, the winner of the progressive prize is selected by type of players (e.g., club level=silver, gold, platinum, and the like). Typically, historical play data is typically used to calculate the players club level. In another preferred embodiment, a progressive game 10 spans multiple property locations and the associated progressive prize is awarded to any player or machine at any of the property locations linked to the progressive ID of that progressive prize.

In a preferred embodiment of the progressive game 10, a player inserts its player tracking card 54 in an associated game machine 50. The player is then able to view specific progressive games/prizes on the system game user interface 100 that are eligible to the player. In one preferred embodiment, the progressive values, the progressive rules, and any help information are all displayed to the player over the system game user interface 100 from a gaming system server. Preferably, the player is automatically eligible for a specific set of progressive games and does not need to interact with the system game user interface 100 to enhance the player's opportunity to win one of the progressive games. Additionally, in one preferred embodiment, the player is able to select to play a specific progressive game from amongst a plurality of eligible progressive games. For example, the number of choices may be limited to just one or two of a multitude. In another preferred embodiment, the player may select to play a plurality of eligible progressive games simultaneously. Typically, when a player removes its player tracking card 54 from the progressive game 10, the player becomes ineligible to win a progressive prize.

In another aspect of a preferred embodiment, the progressive processing system 12 includes a player tracking system that comprises a graphic display, a keypad, and one or more player input means. The player input means include, by way of example only, and not by way of limitation, a touch bezel associated with the graphic display, soft keys, touchpad, trackball, joystick, micro-joystick, annular touch surface (e.g., iPod® click wheel), sub-located buttons, voice command, or a remote devices (e.g., mobile phones, PDAs, and the like).

As stated above, in a preferred embodiment of the progressive game 10, to be eligible to win a specific progressive prize, the player must have its player-tracking card 40 inserted in a game machine 50 that is associated with the specific progressive prize at the time of progressive prize is given. For example, in one specific non-limiting example, the casino may run three gaming promotions simultaneously: one for nickel ($0.05) denomination machines; one for quarter ($0.25) denomination machines; and one for all machines on the floor. In such an embodiment, a player that has its player-tracking card 40 inserted into a nickel machine is eligible to win both the nickel promotion and the floor wide promotion (i.e., the player is able to select to play a plurality of eligible progressive games simultaneously). The progressive game 10 need only know which player-tracking cards 40 are inserted at which game machines 50, as well as details of the base game (e.g., game denomination), in order to be able to award progressive game winnings to the player.

In a preferred embodiment of the progressive game 10, when determining what progressive prizes to make available, casino personnel have to ability to control (1) the types of progressives games/awards to make available, (2) the progressive details (e.g., progressive prize value and time to progressive prize payout) of progressive games/awards made available, and (3) how the progressive funds are distributed to a player that wins a progressive prize.

With respect to the types of progressives, the progressive game 10 enables casino personnel with the ability to provide different progressives for different players by utilizing grouping criteria that includes, by way of example only, and not by way of limitation, game denomination, grouping of gaining machines 50 by physical location on the gaming floor, grouping of all gaming machines 50 on the gaming floor, player tracking card 54 player level (e.g., silver, gold, platinum), and combinations thereof. Additionally, rated theoretical wins or losses for a player or group of players could also be used in the player selection criteria.

As discussed above, in one preferred embodiment, the targeted progressive value is modified by a yield analysis to correlate with the desired casino profitability. For example, if a casino had low earnings last week, and the casino ran a $10,000 progressive game, then the casino may only want to give a $5,000 progressive game this week. In another preferred embodiment, the progressive processing system 12 is modified dynamically prior to the next weekly recurring progressive game. This automatic tuning of the desired casino profitability may involve altering the progressive prize size and/or progressive prize time, thereby tuning to the current business needs. In some preferred embodiments, this tuning takes place while the progressive game is "live" (i.e., in progress).

With respect to the progressive details of progressives games/awards made available, the progressive game 10 enables casino personnel to determine the targeted time at which a progressive prize is given and the targeted dollars amount that will be distributed at that time. As previously stated, in one preferred embodiment, these targeted values are theoretical average values. The actual progressive prize time and progressive prize dollar amount will vary. As such, players (and potential players) will not be able to guess the exact time or amount of the progressive prize and use this information to "camp out" when the progressive prize is eminent.

The following is a non-limiting example of a progressive promotional award customized by a casino using the time-based progressive game 10. A casino desires a daily progressive that pays an average of $300 with a start/reset value of $85. All machines on the floor are eligible to participate in the progressive. Using a "Promotion Administration Tool," the casino would enter the following information: Targeted progressive value: $300; Progressive reset value: $85; Machines included in progressive: All; Targeted progressive prize time: 24 hours, 0 minutes (daily); Number of Winners: 1; Percentage of pot for each winner: 100%; and optionally, the +/− tolerance range for the desired numbers (e.g., progressive value=$300 +/−25%). This criteria is typically categorized in table format for a casino administrator to complete, including the percentage for each winner in the event of multiple winners in a single progressive game. Various examples of progressive parameter set-up screens 170 are shown in FIGS. 3A-3E.

Referring again to FIGS. 1, 2A, and 2B, in one preferred embodiment, the group of gaming devices in the specific promotion is set up in the SMS (slot management system) and/or the CMP/CMS (casino market place/casino management system) system to create a promotion ID. This promotion ID is then assigned to a Progressive ID in the progressive processing system 12. In this manner, the eligible players that are available to win the specific progressive ID, are controlled outside of the server of the progressive processing system 12. In this preferred embodiment, the progressive processing system 12 decides "when" a progressive prize will be awarded and the "value" of the progressive prize to be given. In such a preferred embodiment, the previously existing servers in the casino select "who" will win the progressive prize. In this manner, a preferred embodiment of the progressive processing system 12 is easily incorporated with slot floor systems in the field that have promotional capability.

Additionally, the progressive processing system 12 can be utilized by any business that seeks to offer promotional give-backs to their customers. In such an embodiment, these businesses merely have to select winners from their customers when the progressive processing system 12 notifies them to do so. Preferably, the business' other systems would manage player accounts and the computing devices as currently preformed. Typically, these systems would not require the support of progressive processing system 12. In another preferred embodiment, the software of the progressive processing system 12 is tightly embedded into existing operating business servers.

A preferred embodiment of the progressive processing system 12 includes a progressive engine 60. In a preferred embodiment, the progressive engine 60 performs several calculations utilized in the progressive game 10. These calculations are performed at predetermined "time slices" and "time sub-slices" (in accordance with the targeted progressive prize time). In one preferred embodiment, a "time slice" is equal to 1/100th of the total targeted length of time for the progressive to be awarded, as set by casino personnel. In one such embodiment, the progressive will be won 50% of the time on or by the targeted set time and will always be won by 125% of this desired time. In another preferred embodiment, there is no absolute payout time prompt. A sub-slice is yet a smaller slice of time within a time slice. Preferably, a "time sub-slice" is close to a minute in size, but obviously will vary in length depending on the desired targeted length of time selected for awarding the progressive prize. At each sub-slice of time, the progressive engine 60 tests for a winner. In a preferred embodiment, the progressive engine 60 uses time slices and sub-slices to accommodate progressive games 10 of any length of time, ranging from five minutes to over five years. Otherwise stated, virtually any length of progressive game 10 can be accommodated.

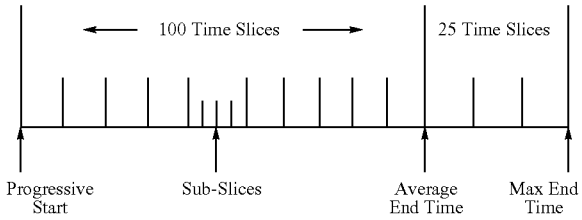

In a preferred embodiment of the progressive game 10, a setup procedure is performed for each progressive game. Preferably, this process includes: resetting the progressive prize to the progressive reset value; setting a progressive timer to the progressive start time; setting a sub-slice timer (this should be the same as the progressive timer to begin); setting the time slice counter to zero; setting the time slice increment rate; setting the number of time sub-slices per time slice; setting the time sub-slice increment rate; and starting the progressive game 10.

In one preferred embodiment of the progressive game 10, the following formulas and calculations are employed. In a preferred embodiment, the proper time slice increment rate is calculated by dividing the desired length of time for the progressive game by 100, which is the number of time slices in this embodiment. The result is the targeted length of each time slice in minutes. Thus, in an example 24-hour progressive game period, the time slice increment rate would be 14.4 minutes/slice. During a progressive game 10, the time-based progressive game 10 preferably uses values from a table, based on the number of the current time slice.

Another preferred aspect of a progressive engine 60 is the ability to emulate a traditional progressive game (e.g., a bonus progressive game), if desired, that is tied to wagering activity on the gaming floor. In one preferred embodiment, the progressive engine 60 emulates the "heart beat" of the floor (e.g., the number of players connected to the progressive gaming system), but is not tied in anyway to the wagering activity.

Additionally, in a preferred embodiment of the time-based progressive game 10, the number of time sub-slices per time slice is calculated by first truncating the time slice increment rate. If the resulting value is less than one, then the number of time sub-slices per time slice is set to one. This ensures that there is always at least one time sub-slice per time-slice. Preferably, there is always at least one time sub-slice per time-slice because the time-based progressive engine 60 tests for a progressive winner and increments the progressive prize based on the time sub-slices. Therefore, there must be at least one time sub-slice per time-slice in order to insure the math for the progressive game will work correctly. Accordingly, in the 24-hour progressive game period example discussed above, there are 14 time sub-slices.

Continuing, in a preferred embodiment of the progressive game 10, the time sub-slice increment rate is calculated by dividing the time slice increment rate by the number of time sub-slices per time slice. In this manner, the length of each sub-slice is determined. Typically, this value is close to one minute. Thus, in an example 24-hour progressive game period, the time sub-slice increment rate is 14.4 minutes (time slice incremental rate) divided by 14 minutes (number of time sub-slices per time slice)=61.7143 seconds.

In a preferred embodiment of the progressive game 10, progressive gaming calculations are performed during every time sub-slice interval of the progressive game by the progressive engine 60. Preferably, at the start of a new sub-slice, the by the progressive engine 60 runs a test to determine if a progressive prize is to be awarded at that time. Additionally, the growth rate of the progressive prize for each sub-slice is also determined at the start of a new sub-slice. In a preferred embodiment, these functions are repeated at the start of every time sub-slice until the progressive prize is awarded. Moreover, in a preferred embodiment of the progressive game 10, it is possible for the progressive prize to be won instantly (i.e., in the first time sub-slice of the first time slice), or for the progressive game to run until the game has passed the 100th time slice. In one preferred embodiment, the progressive game 10 is able to continue for many time slices past the 100th time slice, instead of having the progressive game incorporate a forced payout when the 100th time slice is reached. In such an embodiment, each of these time slices is the same length as the slices before the 100th time slice. In one preferred embodiment, the progressive game 10 also incorporates one or more enticement factor calculations that run in the background on the system server (independent of which particular progressive games are active). These calculations are backed up data every 15 minutes, as well as returning data to the progressive engine 60 on request.

In a preferred embodiment of the progressive processing system 12, the progressive game 10 allows players to have the opportunity to win the progressive prize as soon as the progressive game begins. In one preferred embodiment, there is not any progressive prize value trigger that must be reached in order to allow the progressive prize to be eligible to be won, other than the initiating of the progressive game itself. In a preferred embodiment of the progressive game 10, a calculation is made for each time sub-slice to determine if there is a win of the progressive prize. For each time sub-slice there is a different number of remaining possible winning time sub-slices. Therefore, a calculation is performed at the beginning of every time sub-slice for the length of the progressive game in order to determine whether the progressive prize is given. For each calculation, the progressive game 10 accesses an associated table (see example "Winning Time Slice Table" below) for the win value (i.e., number of "winning time slices") of the current time slice.

For example, at time-slice number four, the following calculation is performed:

```
IF      Random(1)* (1,000,000 * # of Sub-Slices per Time Slice
(14 in our 24 hour progressive))
            <= Winning Time Slice Table [Time Slice] THEN
            winner right now = TRUE
OR (in this example);
IF Random(1)* (14,000,000) <= Winning Time Slice Table[4] THEN
winner right now = TRUE
OR;
If Random(1)* (14,000,000) <= 8 THEN win = TRUE
        (Random(1) returns a 32 bit random number between 0-1)
```

Continuing, in a preferred embodiment of the time-based progressive game 10, if the random number picked is less than or equal to the win value in the Winning Time Slice table for the current time slice, then the progressive prize value (the progressive "pot") is awarded. In a preferred embodiment, the number of time sub-slices is multiplied by 1,000,000 so that the win value from the table is comparable to the random number based on the entire time-slice. For example, if there is one time sub-slice per time-slice in a progressive game, then there is a one in 1,000,000 chance of selecting a "winning" time slice. In this same manner (referring to the table below), if there are 14 time sub-slices, then there is an eight in 14,000,000 chance of selecting a "winning" time slice. This mathematical profile is selected in order to create to casino administrator's desired payout curve. Moreover, this mathematical profile is applicable to any length of progressive game 10. In one preferred embodiment, if the 125th time slice is reached, the progressive prize is automatically won on the first sub-slice test. However, in other preferred embodiments, the progressive prize is automatically won at a different time slice, or is never automatically won at any time slice.

Example Winning Time Slice Table

| Time Slice | # of Winning Tickets |
|---|---|
| 1 | 1 |
| 2 | 2 |
| 3 | 3 |
| 4 | 8 |
| . . . | . . . |
| 122 | 463, 702 |
| 123 | 560, 125 |
| 124 | 785, 129 |
| 125 | ALWAYS WIN |

In one preferred embodiment, above table is loaded into the progressive processing system 12 by selecting and dragging points on the payout curve, after which the number of time slices of winning tickets is reverse calculated, as well as the associated probability of winning. In one preferred embodiment, the payout curve can be manually modified, or alternatively, the payout curve drawn for the user.

In a preferred embodiment of the progressive game 10, if a win value is not selected for a time sub-slice that produces a progressive prize, then the progressive prize value is incremented. This is sometimes referred to as the pot growth rate. In one preferred embodiment, the pot growth rate formula has a non-linear growth rate. Additionally, in one preferred embodiment the pot growth rate loosely associates the movement of the progressive "pot" value to the number of active players. However, in another preferred embodiment, the pot growth rate is not associated with the number of active players. In one specific embodiment, the pot growth at any given minute is described by the following formula:

(Base growth rate for current time slice)+
(15 minute enticement factor)+
(sub-slice enticement factor)

The formula in the above non-limiting example calculates a dollar value to be added to the progressive "pot" value that is visible to the players, and which can be won over the next time sub-slice. In one specific embodiment, components of the formula include: (1) the desired overall pot growth for the entire length of the progressive game; (2) base growth rate for sub-slices in this time slice; (3) a 15-minute floor activity enticement factor; (4) a time sub-slice random enticement factor. However, other preferred embodiments of the progressive game 10 include fewer components (e.g., fewer enticement factors), additional components (e.g., more enticement factors), or modified components (e.g., different enticement factors), without departing from the scope of the claimed invention.

In one specific non-limiting example, $300 is the desired (or theoretical average) value for the progressive game to distribute on a daily basis. In this non-limiting example, the reset value of the progressive pot is $85. Therefore, the progressive pot grows during a targeted progressive game by $215 (i.e., $300 minus $85). Once again, this desired progressive prize value of $300 is an average. If the progressive prize actually paid out every time that the progressive pot hit exactly $300, players would only play the progressive game just as the pot approached the $300 value.

As described above, in a preferred embodiment of the progressive game 10, the base growth rate formula for the progressive "pot" value is customizable. However, a preferred embodiment of the progressive game 10 further includes several pre-designed growth rate formulas that can be utilized by a casino or other hosting establishment. One such pre-designed growth rate formula component of the progressive game 10 is a "front-loading" curve for the progressive prize incrementing rate that increases quickly in the beginning and then later tapers off.

Examinations of casino information have shown that this type of front-loading of a progressive prize value may increase progressive game play. In preferred embodiments of the progressive game 10, this front-loading curve is similar for all progressive games, regardless of: (1) the actual dollar amount being played on the progressive games, and (2) the actual dollar amount being awarded for the progressive games. Preferably, the base growth rate for time sub-slices is the component of the formula that keeps the progressive pot tracking correctly. This base growth rate value is determined by locating a value in a Pot Growth table and multiplying that value by the remaining factors of the progressive incremental growth rate formula. Preferably, the base growth rate remains the same for each time sub-slice in a given time-slice. In a preferred embodiment, the current time slice is utilized to locate a Pot Growth rate value on a Pot Growth table. In one specific non-limiting example, at time slice 4, the following formula is used to calculate the base growth rate for this time slice:

(overall desired pot growth(average $−reset $)*
pot growth value table[time slice])/10,000

OR (($300−$85)*pot growth value table[4])/10,000

OR ($215*300)/10,000=$6.45 (Total amount to add during this time-slice)

In the above non-limiting example, the number 10,000 was incorporated into the formula to generate the Progressive Pot Growth table shown below. Dividing by 10,000 produces the correct amount of total dollars to increment the pot growth for the time-slice. Continuing, in this non-limiting example, the value $6.45 is the total amount to be added to the progressive prize value for this time-slice. In a preferred embodiment, this value is divided by the number of time sub-slices per time slice. In the above non-limiting example, which is based off of a one-day progressive game, the progressive pot growth rate value is 14. However, this value will vary depending on the length of the progressive game. In this regard, a six-month progressive would have approximately 1296 time sub-slices per time-slice.

$6.45/14 Sub-Slices=$0.46 (Base Growth rate for this time sub-slice)

Example Pot Growth Table

| Time Slice | Pot Growth Value |
|---|---|
| 1 | 500 |
| 2 | 500 |
| 3 | 400 |
| 4 | 300 |
| . . . | . . . |
| 122 | 10 |
| 123 | 5 |
| 124 | 2 |
| 125 | 1 |

In one preferred embodiment, the data in the above table is entered manually by a casino administrator, while in another preferred embodiment, points on the payout curve are selected and dragged by a casino administrator in order to create the table.

A preferred embodiment of the progressive game 10 includes what is referred to herein as an "enticement factor." One specific, non-limiting example of an enticement factor is a 15-minute floor enticement factor. In a preferred embodiment, the 15-minute enticement factor is configured to give players the impression that the progressive growth rate is linked to actual floor activity on the gaming floor. In one preferred embodiment, the 15-minute enticement factor produces up to +/−23.75% of the base growth rate of the progressive pot for a given time sub-slice. Alternatively, this information may be manually entered by a casino administrator.

In a preferred embodiment of the progressive game 10, this component of the front-loading curve utilizes a separate calculation that is performed on a server that tracks player activity during a rolling 24 hour period and return values to any progressive game upon request. For example, in one preferred embodiment, the progressive engine 60 requests a rank value from this enticement factor calculation. This enticement factor calculation uses in the following formula:

(Rank−47.5)/200

The result of this formula is a value between −0.2375 and +0.2375. Notably, this equates to the +/−23.75% desired range of change. In the above example, this value is then multiplied by the base growth rate for this sub-slice in order to determine the final value.

In the following non-limiting example, an example rank of 87 is selected for illustrative purposes:

Base Growth Rate of Time Sub-slice*((Rank−47.5)/200)

OR (in this example);

$0.46*((87−47.5)/200)

OR $0.46*(0.1950)=$0.09 (for the 15 minute floor enticement factor)

Figure 4A:
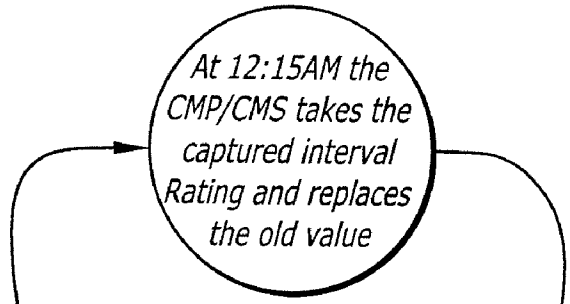
FIG. 4A illustrates multiple "floor activity" tables that keep multiple floor activity rolling and sorted tables.

As described above, a preferred embodiment of the progressive game 10 utilizes another calculation to produce for a 15-minute floor enticement factor (or other enticement factor in another preferred embodiment). A 15-minute interval is a preferred time interval because this time interval correlates with the current network capacity (or interval rating) for many casino systems. In one embodiment, the progressive game 10 performs this additional calculation every 15 minutes, preferably on the quarter hour. In order to perform this calculation, the progressive game 10 tracks the floor activity for the last 15 minutes. This "floor activity" value is typically captured by an Interval Rating Engine (or other appropriate engine in the progressive processing system 12). Referring now to FIG. 4A, in a preferred embodiment, the "floor activity" value is logged to a rolling table that keeps this value for each 15-minute period over the last 24 hours. Preferably, this rolling table includes 96 rows (i.e., four 15-minute periods per hour multiplied by 24 hours). As shown in FIG. 4A, each time a new value is calculated, this new value replaces the oldest value on the rolling table from 24 hours ago. In a preferred embodiment, this enticement factor calculation is constantly performed, regardless of whether there is any active progressive game play. This ensures that there are always "floor activity" values for the last 24-hours if a progressive game is to start at any time.

Additionally, a preferred embodiment of the progressive game 10 requires that the enticement factor background process also sort the floor activity values into a second table, as shown in FIG. 4A. This enables the time order to be preserved in the first table, i.e., the rolling table. The enticement factor background process sorts these floor activity values by the number of players, from the least number of players to the greatest number of players. In this manner, the time period with the biggest value would be in row 96. After the time periods have been sorted by activity level, the enticement factor background process returns the rank of the current time slice (i.e., a number between 1 and 96) to the progressive game upon request.

Another preferred embodiment of the progressive game 10 includes a different enticement factor. A non-limiting example of another enticement factor is a sub-slice floor enticement factor. In a preferred embodiment, the sub-slice enticement factor is configured to give players the impression that the progressive growth rate has more "life" (e.g., a more erratic, less predictable growth rate). Preferably, the sub-slice enticement causes the progressive growth rate to erratically move in a +/−10% range. In other preferred embodiments, the sub-slice enticement causes the progressive growth rate to erratically move in a +/−5% or +/−15% range. In one specific, non-limiting example, the following formula defines the sub-slice floor enticement factor:

(Random(2000)−1000)/10,000

This formula returns a value between −0.1 and +0.1, with four decimal point accuracy. This equates to a +/−10% range. In a preferred embodiment, this sub-slice floor enticement factor is multiplied by the base growth rate for this sub-slice to determine the final progressive value. In one specific, non-limiting example, the random number equating to the sub-slice floor enticement factor is 0.0473.

Base Growth rate for this sub-slice*((Random(2000)−1000)/10,000)

Or (in this example);

$0.46*(−0.0473)=−$0.02

Therefore, in a preferred embodiment, the final calculation for the determining the progressive pot growth rate of the front-loading curve utilizes the above described components of the formula curve. In one specific embodiment, the pot growth at any given minute is described by the following formula:

(Base growth rate for sub-slice)+(15 minute enticement factor)+(sub-slice enticement factor)

Or (incorporating the above-selected sample values)

$0.46+(−$0.02)+$0.09=$0.53 (total to be added to the progressive pot during this sub-slice).

Figure 4B:
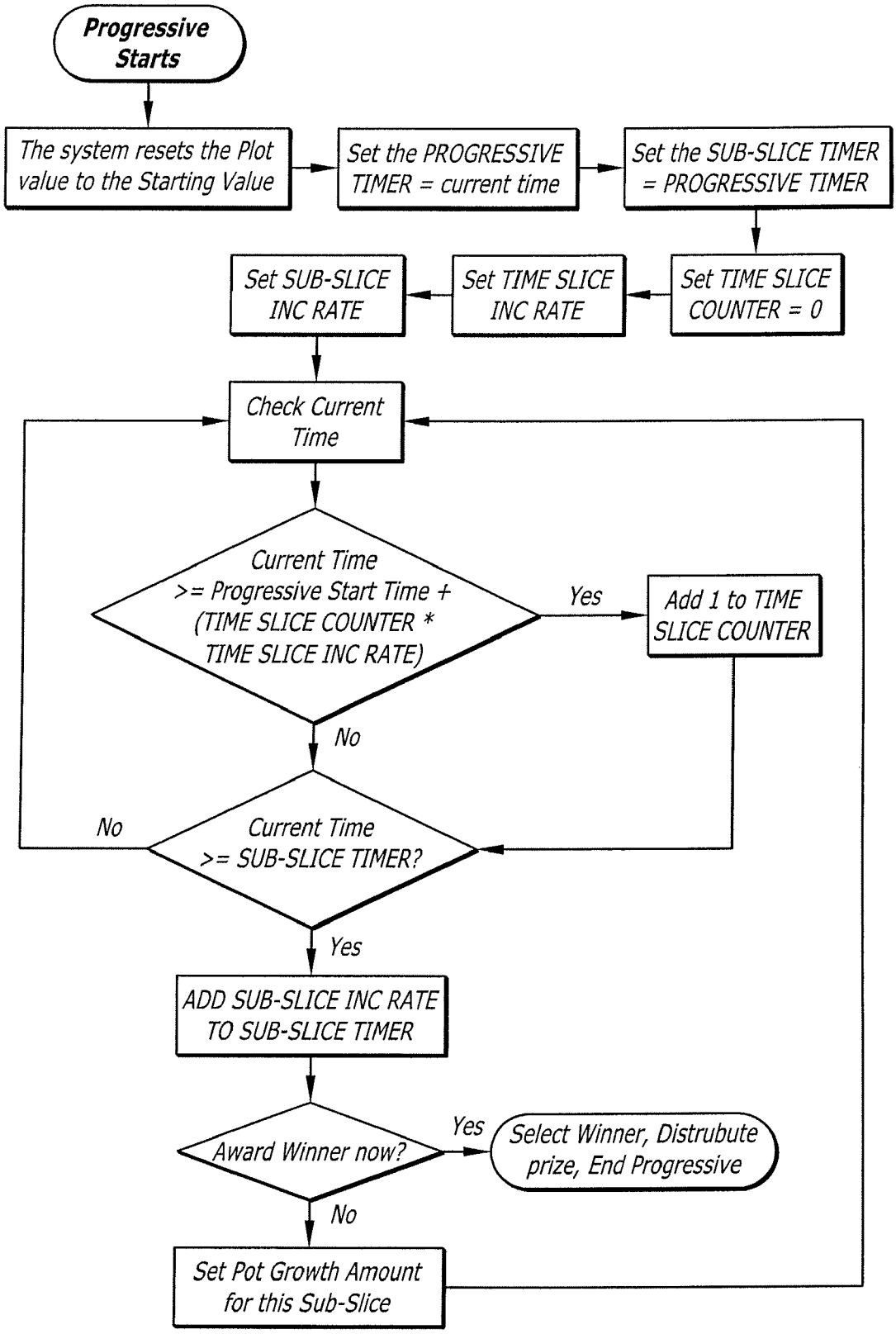
FIG. 4B illustrates a logic flow diagram of a preferred embodiment of the progressive game.

Referring now to FIG. 4B, a logic flow diagram of a preferred embodiment of the time-based progressive game 10 is shown. FIG. 4B details the process that is undergone during the execution of the time-based progressive game 10.

Figure 4C:
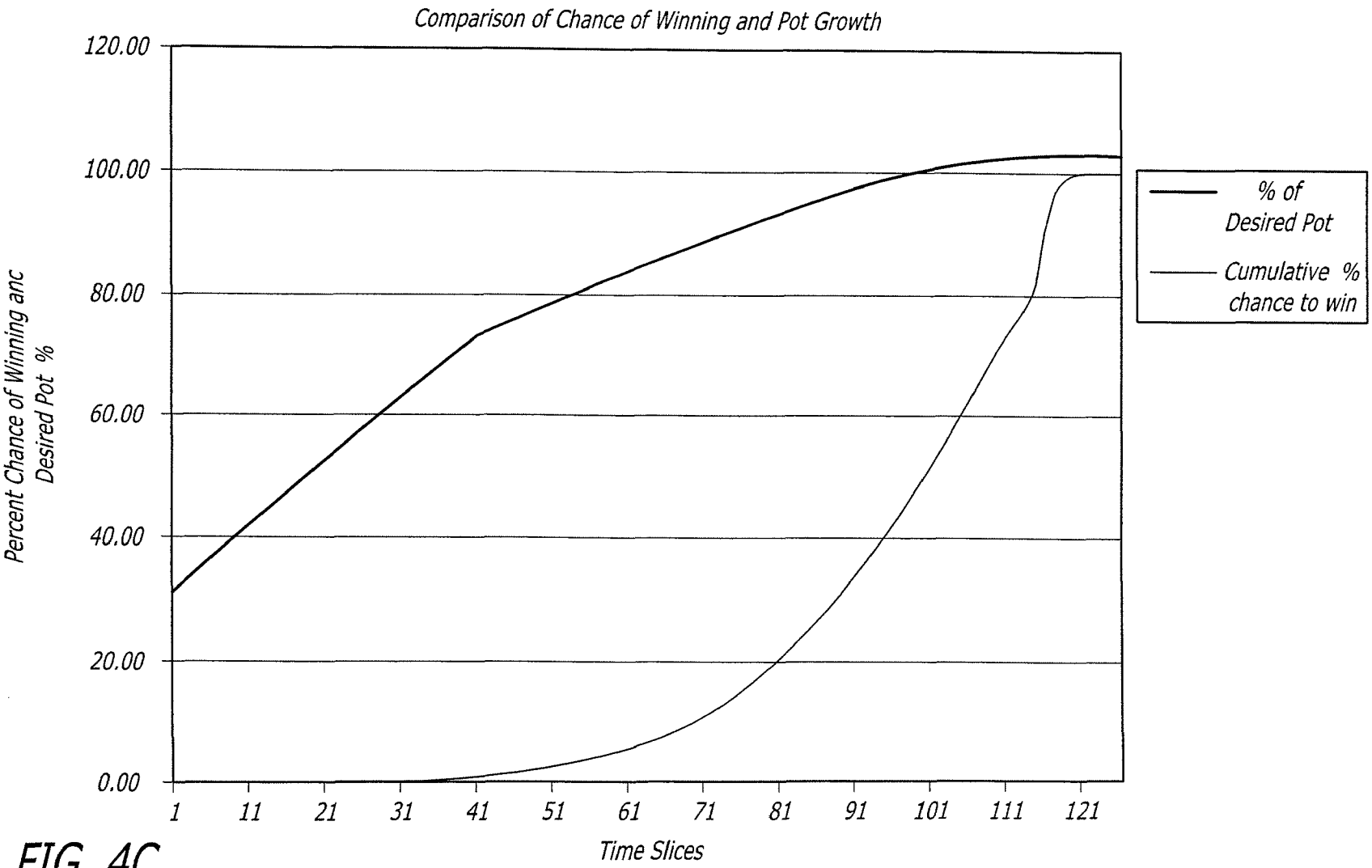
FIG. 4C illustrates a comparison chart of the percentage of the targeted (theoretical) progressive pot value (i.e., percentage of the targeted progressive prize value) versus the cumulative chance to win over time.

Furthermore, with respect to the distribution of progressive funds, FIG. 4C illustrates a comparison of the percentage of the theoretical average of the progressive pot value (i.e., percentage of the targeted progressive prize value) versus the cumulative chance to win. This comparison chart elucidates the "front loading" concept that is employed by a preferred embodiment of the progressive game 10. In one preferred embodiment, the progressive prize has a lower cumulative probability of being awarded early in the time period and increases to a higher cumulative probability of being awarded later in the time period.

In a preferred embodiment of the progressive processing system 12, the cumulative percent chance to win is a statistical technique used to create a winning time slice table, as shown above. The winning time slice table is referenced at each time sub-slice to determine the chance for a progressive prize to be won at that time sub-slice. In a preferred embodiment, the winning time slice table has 125 values that represent the number of winning time sub-slices out of 1,000,000 in any given time slice. The winning time slice table contains cumulative percent chance values. In this regard, the cumulative percent chance of selecting a progressive prize at any given time slice increases the closer that time slice is to the targeted progressive prize time. In a preferred embodiment, the cumulative percent chance is within a range of time that is acceptable to allow the progressive game 10 to have a broad enough range of lengths that players are unable to determine the ending time of the progressive game with any degree of accuracy.

In a preferred embodiment of the progressive processing system 12, the winning time slice table is generated using a spreadsheet that includes automated formulas. This enables a user to fill in some data in the table and then have the remainder of the data automatically generated. In a preferred embodiment, the spreadsheet shows the cumulative payback percent chance at each time slice. One example of the formula for finding how many time-slices exist at each time slice is:

Time Slice Number (1.5+a value added to the exponent), where the "value added to the exponent" is equal to the "Time Slice Number" divided by "a value based upon the slice number" and key time slice settings. In a preferred embodiment, the "divide value based on slice number" is determined after the user decides what time slices they want to effect and the cumulative percent chance to win at each time slice.

In one specific example, shown below, the value for time slices 1-80 is 168.59 (Original div value). This divide value is used in the "Additive to factorial" column. Any change to this value then filters through the spreadsheet, thereby producing a new "percent chance to win value" for all time slices. Preferably, setting a goal seek value in the "Used for Goal Seek" column changes the value in the "Original Div Value" column. In one specific example, this is a built-in function of the spreadsheet.

| | Div Values | Used for Goal Seek | Key Slice | Desired % |
|---|---|---|---|---|
| Original div vale | 168.59 | 0% | 0 | 0.00% |
| After 1st key | 118.1886 | 10.0000% | 80 | 10.00% |
| After 2nd key | 105.492 | 50.0000% | 100 | 50.00% |
| All remaining | 93.5 | 95.0000% | 115 | 95.00% |
| slices | | 100.0000% | 125 | 100.00% |

| Additive to factorial | Slice number | Winning Tickets | Fail chance this slice | Cumulative fail chance | Cumulative Win % |
|---|---|---|---|---|---|
| 0.00593155 | 1 | 1 | 99.9999% | 99.9999% | 0.0001% |
| 0.0118631 | 2 | 2 | 99.9998% | 99.9997% | 0.0003% |
| 0.01779465 | 3 | 5 | 99.9995% | 99.9992% | 0.0008% |
| 0.0237262 | 4 | 8 | 99.9992% | 99.9984% | 0.0016% |
| 0.02965775 | 5 | 11 | 99.9989% | 99.9973% | 0.0027% |

In a preferred embodiment of the progressive processing system 12, a casino operator or bonus game manufacturer creates an original table of probabilities. In one such embodiment, an operator creates a probability curve by choosing one or more key time slices. The operator then decides what percent of the winners should occur by the chosen key slices. For example, in one embodiment, the 80th time slice is selected as the time slice by which to have 10% of all progressive prizes are to be awarded. Preferably, at the 100th time slice, 50% of the progressive prizes have been won, so as to make the overall average length of the progressive games be approximately equal to the targeted award time. Continuing, at the 115th slice, 95% of the progressive prizes have been won. Finally, in one preferred embodiment, at the 125th time slice 100% of the progressive prizes have been won, thereby restricting the top end length of the progressive to be 25% over the targeted progressive time. In this one preferred embodiment, the 25% value was chosen arbitrarily and can be modified (or removed altogether) to suit customer preference.

Preferably, adding to this 25% in value entails adding corresponding additional time slices after the 125th time slice. In other preferred embodiments, there are multiple key time slices both before and after the 100th time slice. However, even in such preferred embodiments, the target for the cumulative percent chance to win at each key slice becomes larger as the slice number increases.

In another step involved with creating an original table, the user would then goal seek for the desired percent for the first key slice by changing the original div value (divisional value). Continuing, the user repeats this process for each remaining key, and finally for the 125th time slice. The winning tickets column is then filled with the correct number of time sub-slices to ensure the progressive plays as intended.

In another aspect of a preferred embodiment, the spreadsheet is used to calculate for each time slice, the cumulative chance for the progressive prize to be won. This is determined by: (1) finding the percent chance to fail for a given time slice, (2) multiplying the percent chance to fail for all time slices up to a given point (i.e., this is the cumulative percent chance to fail at this point), and (3) subtracting the cumulative chance to fail from 100 percent to find the percent chance to win.

The following table provides an illustrative example:

| Additive to factorial | Slice number | Winning Tickets | Fail chance this slice | Cumulative fail chance | Cumulative Win % |
|---|---|---|---|---|---|
| 0.00593155 | 1 | 1 | 99.9999% | 99.9999% | 0.0001% |
| 0.0118631 | 2 | 2 | 99.9998% | 99.9997% | 0.0003% |
| 0.01779465 | 3 | 5 | 99.9995% | 99.9992% | 0.0008% |
| 0.0237262 | 4 | 8 | 99.9992% | 99.9984% | 0.0016% |
| 0.02965775 | 5 | 11 | 99.9989% | 99.9973% | 0.0027% |

In the table above, at Time Slice 1 there is 1 winning time ticket. So there are 999,999 chances in 1,000,000 to lose (i.e., 99.9999% chance to lose). As this is the first time slice, 99.999% is also the cumulative percent chance to fail. The chance to win at this point is then 100%-99.9999 or 0.0001%.

Referring now to the table and time slice 2, there are 2 winning tickets, and a 99.9998% chance to lose on this time slice. By multiplying 99.9999% (i.e., the cumulative chance to fail at time slice 1) times 99.9998% (i.e., the cumulative chance to fail at time slice 2), it is determined that there is a 99.997% cumulative percent chance to lose at time slice 2. Correspondingly, this translates into a 0.0003% chance to award the progressive prize at time slice 2.

Referring now to the table and time slice 3, there are 5 winning tickets, and a 99.9995% chance to lose on this time slice. By multiplying 99.9997% (i.e., the cumulative chance to fail at time slice 2) times 99.9995% (i.e., the cumulative chance to fail at time slice 3), it is determined that there is a 99.992% cumulative chance to lose at time slice 3. This correlates with a 0.0008% chance to win at time slice 3.

In a preferred embodiment of the progressive game 10, after the progressive engine 60 has determined that there is a winner for the current time sub-slice, the system then randomly selects a winner of the progressive game using a random number generating algorithm. In one preferred embodiment, a player is eligible to win the progressive prize if they have a player-tracking card inserted in a game machine 50 that is eligible to win that specific progressive prize at the time the progressive prize is selected. For example, if the progressive prize was awarded for all nickel machines on the floor, the progressive game 10 would select a winner randomly from one of the player-tracking cards inserted into any nickel machine on the casino floor. In the case of a progressive game that awards to multiple winners, multiple cards are chosen as winners in accordance with the set-up of the progressive game. In these types of multi-winner progressive games, each player may win an equal share or there may be a range of payouts.

If there are no players playing on eligible gaming machines 50 for a specific progressive game at the time that the progressive game 10 determines there is a win for that progressive game, the progressive prize will be awarded to the next player(s) to insert a player tracking card 54 into an eligible game machine 50. In another preferred embodiment, the progressive prize is deposited into a winning player's account without even requiring the player to be present. In one such embodiment, the winning player is then notified of the deposit by e-mail, regular mail, given on the next visit or over multiple visits, or other known means.

In another preferred embodiment of the progressive game 10, all active players on the floor are eligible to win the progressive prize, not only the player with inserted player tracking cards. In one embodiment, the winning "non-player tracking card" player must use the progressive prize at that winning machine, since the player does not have a player tracking card 54 to associate the winning with that player.

Figure 5:
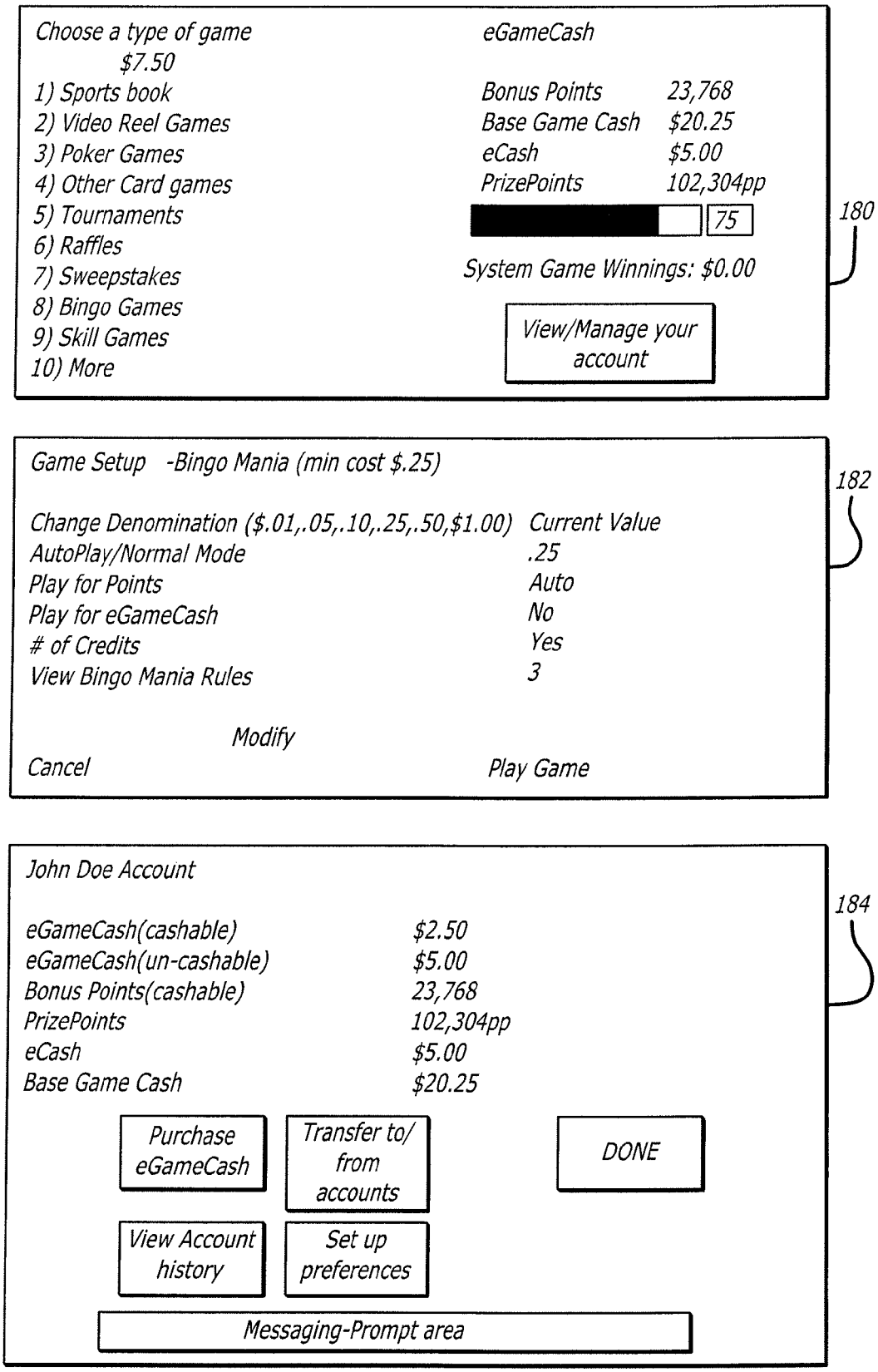
FIG. 5 illustrates player's eCash bucket screen, game setup screen, and personal account screen, as viewed over a system gaming user interface.

In a preferred embodiment of the progressive game 10, progressive prize is then dispensed to the winning player by crediting the player's eGameCash bucket. As shown in FIG. 5, a player is able to view his or her eGameCash bucket screen 180, as well as other game setup screens 182 and personal account screens 184, typically via the user interface 100 in the progressive processing system 12. In one embodiment, as shown in FIG. 6, these credits in the player's eGameCash bucket can be transferred (as shown on the eGameCash purchase screen 186) to the base game upon request from the player (following PIN entry or some other suitable means of player identification). Additionally, personal account activity screens 188 are also displayed in FIG. 6. Referring now to FIG. 7, a preferred embodiment of the progressive processing system 12 also includes a game selection screen 190, game setup screen 192 for modifying a bingo game, and a personal account display screen 194 that shows both cashable and uncashable funds for a system game in the same display screen. FIG. 8 shows a progressive game 10 displaying the "attract mode" screen 196 on the user interface 100, as well as an "award display" screen 198 that is shown to a player after winning a progressive prize.

In a preferred embodiment of the progressive game 10, the application design of the progressive game includes many various programs. Preferably, such programs include by way of example only and not by way of limitation: a master maintenance program including a graphic user interface, a link maintenance program, a promotion detail maintenance program, a progressive update program, a progressive winner program, a progressive increment override program, a "Pick the Winner" program, and a "create promotion" program (machines and/or player).

The master maintenance program enables data entry for the promotion master file. This program calls the link maintenance program and enables the user to set-up the progressive link. Optionally, the promotion may be started by the promotion detail maintenance program to create the promotion detail file and perform the necessary system calculations. Referring now to the link maintenance program, this program enables users to select a subset of gaming machines 50 for entry into the progressive link file for a particular promotion game. Additionally, the promotion detail maintenance program performs calculations based on information in the promotion master file to determine the trigger amount and trigger date/time, as well as to write this information to the promotion detail file.

Referring now to FIG. 9, in one preferred embodiment, web services are connected to the progressive processing system 12 that enable viewing of the progressive games 10 from any casino, home web browser, cell phone, PDA, and the like. In another preferred embodiment of the time-based progressive game 10, the progressive update program continually updates the current progressive pot value and sends updates to the slot system, and optionally, to a plasma display system. This data can also be fetched from the progressive processing system 12 upon request from any authorized device or server. Further, the progressive update program determines when a trigger time/date has occurred and invokes the progressive winner program. Preferably, the progressive winner program randomly selects a winner from the accounts with an inserted player tracking card 54 at the time the trigger was activated. This program will update the progressive winner file and send notification to the slot system. Finally, the progressive increment override program enables users to override the increment amounts for a promotion. The override is a dollar amount for a user defined date and hour.

In another aspect of a preferred embodiment, the progressive processing system 12 includes a "weighting" option to the random selection of progressive prize winner. Preferably, this weighting option enables the casino to "weight" the odds of a player being selected as the "random winner" of the progressive prize, based on casino defined criteria. In one specific, non-limiting example, this weighting technique initially involves setting every qualified player with a "Base Value" of 100 points. Further, the weighting option incorporates a table in which "casino established rules" are used to add or subtract from the 100 points before the random selection of the winner, thereby changing the odds of a selecting the winner of the progressive prize.

Typical weighting calculation might include, by way of example only, and not by way of limitation: (1) silver carded players receives +50 points, gold carded players receives +100 points, and platinum carded players receives +150 points; (2) extra points are received based on "time played" multiplied by "average bet" for the day (e.g., compensating for a player participating higher denomination games by increasing the weighted winning odds, and compensating for a player that is playing at a slow rate waiting for the progressive to hit by decreasing the weighted winning odds, and the like); and (3) extra points are received based on total bet for the day or average over a number of days.

In one preferred embodiment, the weighting option logic is used to handle a "free chance" that may be required in some locations (to meet some states lottery requirements). In one embodiment, such a weighting option gives players a "free chance" to be awarded a prize when using a kiosk or simply by inserting a patron card into a machine. In another preferred embodiment, a casino may elect to have such a free chance be good for a selected number of minutes, and have a weighting factor that is equal to 1, 10, or the selected number of minutes.

In one specific, non-limiting embodiment, the weighted "points" discussed above appear as drawing tickets in a promotion barrel from which a winner drawn. In such an embodiment, the base players have 100 chances out of X total chances, and gold members have 200 chances out of X total chances, and platinum members have 300 chances out of X total chances. Preferably, the winner selection calculation then use the same logic used for Electronic Quick Draw. These calculations include, by way of example only, and not by way of limitation: (1) place chances in a virtual barrel; (2) total number of chances in the virtual barrel=Y; (3) randomly select number from 1 to Y; (4) if multiple winners being picked, (5) confirm that random number has not been used; (6) check which account/gaming machine is the winner; (7) check casino rules on multiple winners for same account and re-draw if needed; and (8) record winner and process award.

In a preferred embodiment of the time-based progressive game 10, the system database design of the progressive gaming system includes many various data files. In one preferred embodiment, the promotion master file includes the following data: promotion code (primary key), promotion description, start date, start time, targeted progressive trigger value, minimum progressive trigger value, progressive reset value, targeted progressive prize time, minimum progressive prize time, key for progressive link file, stop date, stop time, iVIEW winner broadcast show number, and iVIEW winner asset show number.

In one preferred embodiment, the Slot Management servers and the Casino Marketplace servers maintain promotions (Promotion ID) for groups of players and groups of machines. Each Progressive ID is associated with a specific Promotion ID, typically outside of the server/service of the progressive processing system 12. However, in another preferred embodiment, these systems are all merged.

In one preferred embodiment, the detail promotion file includes the following data: the promotion code, the players, and/or groups of machines included in the promotion. In another preferred embodiment, the progressive increment override file includes the following data: promotion code, hour, day, and override amount. In a preferred embodiment, the progressive winner file includes the following data: promotion code, account number, winner notified (y/n), amount, date, and time. In a preferred embodiment, the progressive link file includes the following data: promotion code and asset number.

Figure 10A:
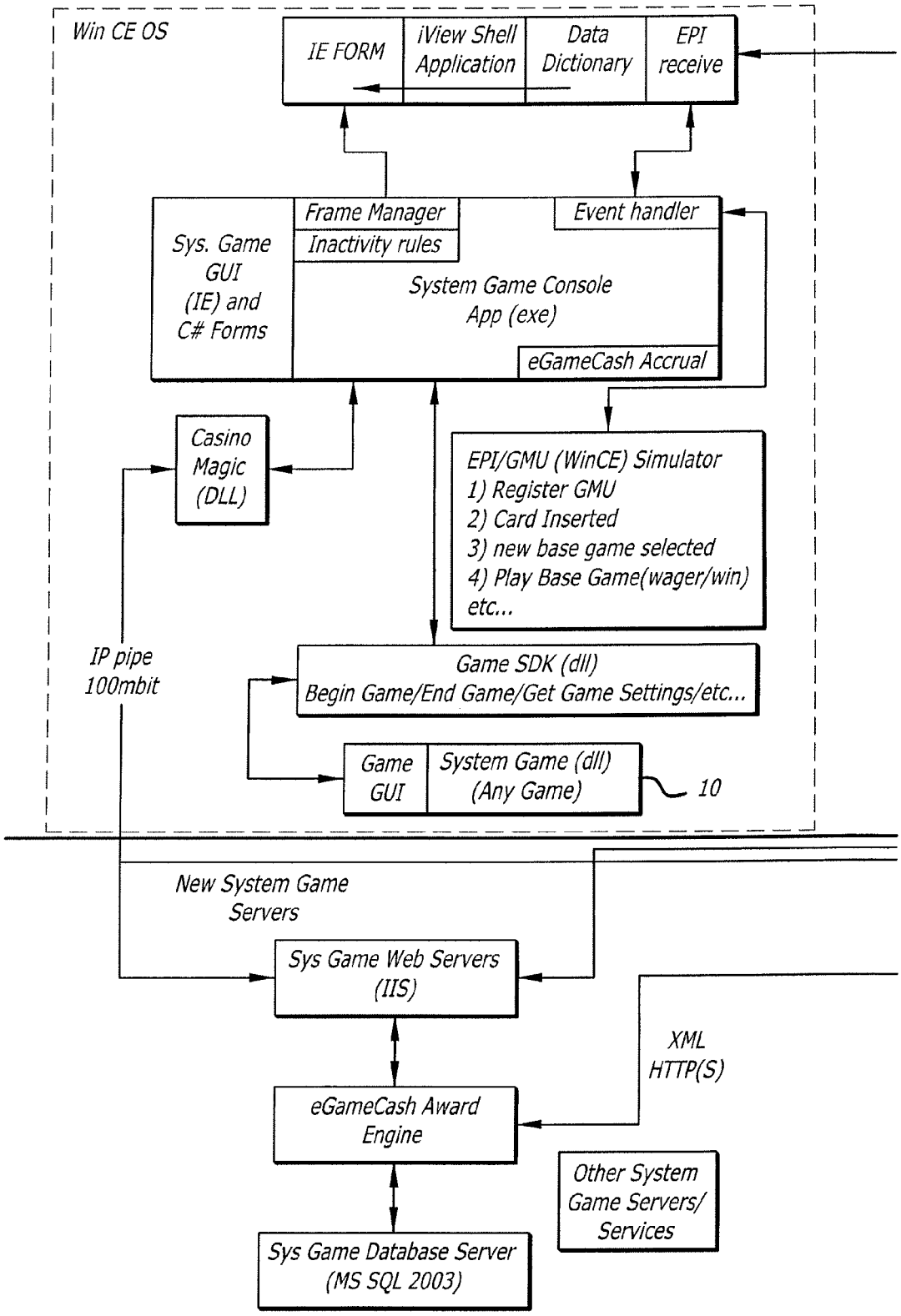
FIG. 10 illustrates client side applications/services/hardware, as well as system gaming servers.
Figure 10B:
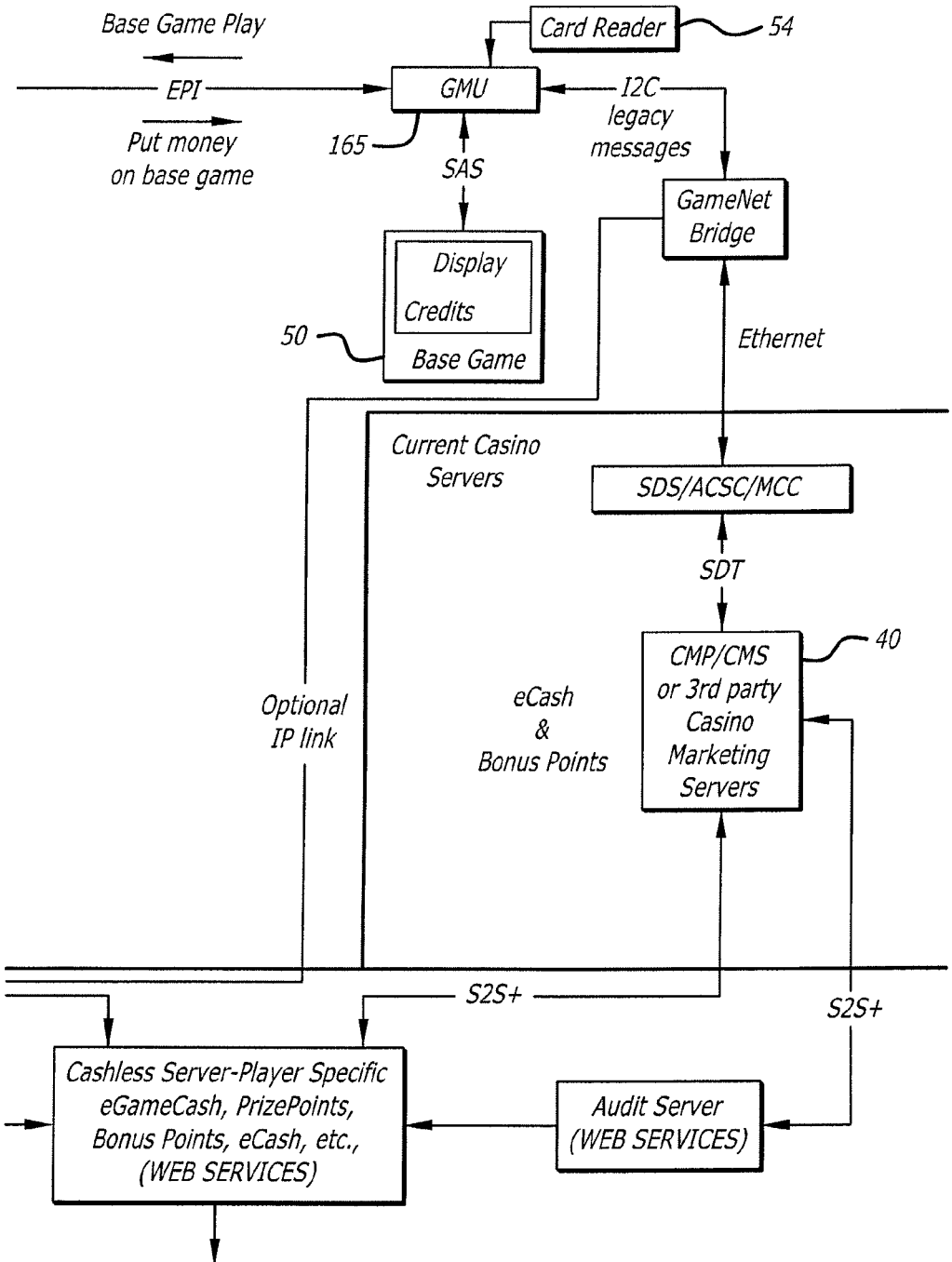

In one preferred embodiment of the progressive processing system 12, an optional way of awarding a progressive prize utilizes reverse mapping. In one such embodiment, the progressive processing system 12 tells a System Gaming Server and Client Side Game Device (e.g., an iVIEW, as shown in FIG. 10) that a specific player has won a progressive prize. In response, the progressive game 10 running on a gaming device forcefully triggers a specific winning combination in a game (e.g., 777 in a reel spinner, Royal Flush in poker, and the like). The game then starts its win sequence and informs the player that the progressive prize has been won. In other preferred embodiments, other winning combinations are generated from either a central random number generator, a finite pool of prizes, or from a client side random number generator.

In another aspect of a preferred embodiment, the progressive processing system 12 incorporates further promotions in addition to the system game promotions discussed above in which players receive promotional eGameCash with which to play. For example, one promotional progressive may simply be randomly given to a player whenever the progressive processing system 12 determines that it is time for a progressive prize. In this regard, the player may even be in the middle of a normal system game at the time of the award.

In another aspect of a preferred embodiment, the progressive processing system 12 is utilized in conjunction with non-gaming third party promotions. In one example embodiment, a gas station chain has a $1,000,000.00 progressive game 10. In another embodiment, the prize is a non-cash prize (e.g., a new car). When the progressive processing system 12 of the gas station determines that it is time for a progressive prize to be given away, the system may (1) give the award to a person standing in front of a gas pump at that time with a card in the progressive device (e.g., the gas pump), or (2) assign the progressive prize to a player's account number. In another example embodiment, web businesses that incorporate a progressive processing system 12 may use this type of non-gaming third party promotions as a means to draw customers to their site. If a progressive prize occurs while a person is browsing the site of the web business, then the browsing person will win.

In this manner, the progressive processing system 12 of the claimed invention is a universal, promotional, progressive engine 60 that can be integrated with almost any business that desires to give something back to patrons. In one embodiment, spending money at the business is required, but in other embodiments, no purchase is required at the business, thereby bypassing sweepstakes issues. In one preferred embodiment, patrons are able to mail in entry forms, and software in the progressive processing system 12 selects a winner from either the mailed in entries or the patrons at the business at the progressive award time.

In another aspect of a preferred embodiment, the progressive processing system 12 incorporates overhead video displays that show data including, by way of example only, and not by way of limitation, current progressive values, targeted progressive size, targeted win time, start time, actual winners, information revealing that a progressive prize is about to be given, player qualification rules, or combinations thereof. These overhead video displays include, by way of example only, and not by way of limitation, plasma displays, liquid crystal displays, cathode ray tube displays, digital light processing displays, video projectors, or other similar technology. Further, in one preferred embodiment, overhead video displays that present data from multiple progressive games 10, and from multiple facilities, thereby facilitating player interaction with other property locations as well.

In yet another aspect of a preferred embodiment, the progressive processing system 12 can be configured to prevent a progressive prize win during certain time periods (e.g., preventing a progressive prize from being awarded at a certain time period during the day). Additionally, the progressive processing system 12 enables the opportunity to win a progressive prize to be turned off by an administrator at any time. In some preferred embodiments, the awarding of the progressive prize is automatically reoccurring after each progressive prize is awarded. Further, in some embodiments, a delay is inserted after the awarding of a progressive prize and before the beginning of the next automatically reoccurring progressive prize.

In still another aspect of a preferred embodiment, the award process includes payment techniques that include, by way of example only, and not by way of limitation, hand-paying a winner; using EFT (electronic funds transfer) to transfer the award to a base game upon a player selecting to redeem the award at the base game; using AFT (advanced funds transfer) to transfer the award to a base game upon a player selecting to redeem the award at the base game; using other approved funds transfer protocols to the gaming devices; sending the award to a player account bucket; enabling the award to be collected at a cashier cage; mailing the award to the winner; placing the award in the player's private banking account; and placing the award as a credit on the player's credit card, debit card, player club account, or other financial account.

In another preferred embodiment, the progressive processing system 12 utilizes progressive identifiers that enable the opportunity to win a progressive prize to be activated from a remote server. Preferably, the progressive identifier is created using required data that is supplied through XML messaging or by using a management screen. The data required to generate a progressive identifier includes, by way of example only, and not by way of limitation: desired progressive value data, desire progressive win time data, progressive reset value data, maximum progressive value data, desired start time of the progressive data, whether the progressive auto-restarts after a win, how many times the progressive repeats, whether any enticement factors are utilized, progressive payout curve data, maximum progressive prize value data, desired start time of the progressive data, selectable progressive auto-restarts after a win, selectable number of progressive repeats, enticement factors data, and progressive payout curve data.

In one preferred embodiment of a progressive game 10 the administrator sets (1) the "actual" progressive prize value that will be awarded and (2) the targeted progressive prize time at which the progressive prize is to be awarded. In this embodiment, the progressive game 10 will be awarded at a random time that is calculated around the targeted progressive prize time entered by the administrator.

Alternately, in another preferred embodiment of a progressive game 10 the administrator sets (1) the targeted progressive prize value to be awarded and (2) the "actual" progressive prize time at which the progressive prize will be awarded. In such an embodiment, the progressive prize value grows to a random number calculated using the targeted progressive prize value. The awarding of the progressive prize is then compelled at the "actual" progressive prize time entered by the administrator. Clearly, in such an embodiment, the "actual" progressive prize time must be kept highly confidential.

Moreover, in a preferred embodiment, a progressive prize from the progressive processing system 12 is able to trigger additional events or promotions in the casino (e.g., consolation prizes, a $10 prize to each carded player now playing, and the like). Therefore, the progressive processing system 12 can be utilized as a promotions prize control engine that controls frequency at which promotional prizes (but progressive and non-progressive) are awarded based upon time.

In one preferred embodiment, the promotional progressive system 12 (PPS) is a service that runs on a server and performs backend processing for progressive game 10, provides various devices on a casino floor with information to display, and notifies other servers when a progressive prize event occurs and needs to be awarded to a winner. In some preferred embodiments, other servers are utilized to select one or more winners of the progressive prize to be awarded. In other preferred embodiments, the winner selection functionalities are integrated with the rest of the progressive game 10 functionalities in the promotional progressive system 12.

Preferably, the progressive processing system 12 (i.e., where the progressive processing service is performed) also incorporates devices such as signage that display the current progressive prize value on a casino floor (e.g., modern COOL SIGNS type devices, legacy Player Tracking Displays, iVIEWs, and the like). Additionally, a preferred embodiment of the promotional progressive system 12 also incorporates a Slot Management System (or other type of casino floor management system) that provides floor statistics that enable a progressive game 10 to run, as well as perform a redemption function (i.e., select a progressive winner and award the progressive prize to the winner). Further, a preferred embodiment of the progressive processing system 12 also incorporates a Web interface, as shown in FIG. 9. Preferably, the Web interface resides on a separate server and provides administration of the progressive processing system 12, as well as reporting through the World Wide Web.

In a preferred embodiment, a Web Interface is utilized to create and manage a progressive game 10 from a remote location. Additionally, in a preferred embodiment, the Web Interface enables enhanced reporting capabilities including, by way of example only, and not by way of limitation: the ability to lookup specific Program Identifier status and details, the ability to generate a report on a specific progressive over a time period, the ability to generate a report on multiple progressive games 10 for the same casino over a selected time period, the ability to generate ad-hoc queries to provide support for business decisions (e.g., targeted progressive prize value, targeted progressive prize time, effective grouping of slot machines and/or carded players, and the like).

The following table shows the messages that are communicated between the progressive processing system 12 and other devices. As referenced below, a Program Identifier (ProgID) is a unique identifier for progressive game 10 on the promotional progressive system 12. As such, other servers and processes are able to reference a specific progressive game 10 using the associated ProgID.

TABLE 1

| | SMS | Signage | Web Interface |
|---|---|---|---|
| To PPS | Create ProgID<br>Get ProgID meter<br>Check ProgID win<br>Post Floor Statistic<br>Notify ProgID win redemption | | Create ProgID<br>Admin ProgID<br>Check ProgID status<br>Reports |
| From PPS | Get Floor Statistic<br>Notify ProgID win | Add/Remove ProgID<br>Update ProgID meter<br>Notify ProgID win | |

TABLE 2

| Message Name | From | To | Description | Request Data | Reply Data |
|---|---|---|---|---|---|
| Create ProgID | SMS | PPS | SMS creates progressive game on PPS (total the average progressive $ win value, progressive reset value in $, average length of time for a progressive to run, scheduling data for a progressive). Normally, setup happens through the web interface. | All game data | ProgID<br>Error Codes |
| Get ProgID meter | SMS | PPS | SMS requests current meter value for ProgID | ProgID | ProgID<br>Meter Value<br>Error Codes |
| Check ProgID win | SMS | PPS | SMS checks if ProgID is won. If yes, it had been stopped by PPS. | ProgID | Won(yes/no)<br>Meter Value<br>Error Codes |
| Post Floor Statistic | SMS | PPS | For game to function correctly, it needs some timely floor statistic for a certain period of time (15 min) like<br>Number of carded players active<br>or<br>Number of un-carded players active or<br>Total $ spent for each group (ProgID) and the like. | ProgID<br>StatName<br>StatValue | Error Codes |
| Notify ProgID win redemption | SMS | PPS | When ProgID is won, SMS/CMP has to perform some processing to determine the winner and after that is done, it will notify PPS, so the ProgID is closed and that PPS can notify Signage to display a winning sequence: create excitement, do winner's recognition, display amount won, and the like. | ProgID<br>Winner's data<br>(if any) | Error Codes |
| Get Floor Statistic | PPS | SMS | This is a request for "Post Floor Statistic" message. Depending on implementation, we can have PPS send this request to SMS or have SMS do "Post Floor Statistic" on agreed periods of time | ProgID | ProgID<br>StatName<br>StatValue<br>Error Codes |
| Notify ProgID win | PPS | SMS | This is an unsolicited "Check ProgID win" reply. It tells SMS/CMP that a ProgID win happened. Depending on implementation, we can have PPS notify SMS when ProgID is won | ProgID<br>Meter Value | Error Codes |

In a preferred embodiment, these messages originate from the progressive processing system 12.

TABLE 3

| Message Name | Description | Request Data | Reply Data |
|---|---|---|---|
| Add/Remove ProgID | PPS will register or un-register a ProgID with Signage. A proper assignment of displays on a casino floor to a ProgID and to specific video content will be done at the Signage Network Controller. | ProgID<br>ProgName<br>Action(add/remove) | Error Codes |
| Update ProgID meter | PPS will notify Signage in a timely manner about current meter value of ProgID. | ProgID<br>Meter value | Error Codes |
| Notify ProgID win | PPS will notify Signage when ProgID is won. This will happen after PPS gets a notification from SMS that ProgID redemption is completed. Signage will then perform winner's recognition, create excitement around the win, and the like. | ProgID<br>Meter Value<br>Winner's data<br>(if any) | Error Codes |

A preferred embodiment of the progressive processing system 12 generates a progressive game 10 that is managed by the casino and can be offered to multiple customers. Preferably, a progressive game 10 uses a variety of criteria to determine player eligibility and winner selection on multiple slot machines. These features include, by way of example only, and not by way of limitation: (1) promotional progressive games focused on carded play only (i.e., game play by players that are using player tracking cards 54); (2) progressive games in which progressive contributions offer reset amounts, minimum/maximum levels, and a variety of methods for progression; (3) progressive games in which progressive prize growth rate is not generated based on direct or indirect gaming activity (e.g., the progressive prize increases based on a pre-determined rate that varies by day, dates, or time according to casino's decision on progression rates); (4) progressive games in which multiple progressives are overlapping; (5) progressive games that include a secondary reset amount; (6) progressive games in which the awarding of a progressive prize is based on a randomly selected point in the progressive prize value growth, or a randomly selected progressive prize time within a range; (7) progressive games in which a progressive prize winner is be selected from a specific group of players, all carded players, or other criteria (e.g., players with a minimum of 50 points in last 24 hours and still actively playing or customers playing more that $20 in "coin in" for the last hour); (8) progressive games in which the winner selection is performed using either selected player/account or slot machine location (also multiple card accounts, such as spouses sharing accounts); (9) progressive games in which signage and graphics are utilized for a promotion); (10) progressive games that are either isolated to a specific casino or operate over multiple properties; and (11) progressive games in which lotteries are incorporated (e.g., one swipe or entry a day translates into one minute of qualified play and a chance to win if a winner is selected during that time period).

In one preferred embodiment, the progressive game 10 is a floor-wide progressive game that is player-centric rather than game-centric. Preferably, there are no protocol or other requirements for slot machines to be eligible to participate in the progressive game 10. In a preferred embodiment, participation is based on casino-selected criteria that designates what types of eligible carded player activity contribute to increasing of the progressive prize. Preferably, the progressive prize values and other promotion status messages are displayed on video display signage throughout the casino, as well as being sent to the gaming machines as directed messages.

In one preferred embodiment, the progressive processing system 12 enables multiple progressive promotions or flat payout promotions that could run simultaneously. For example, the progressive processing system 12 enables a casino to have a four level progressive game with smaller progressive prizes hitting more frequently, thereby enabling each of the four to be configured separately using separate criteria. Preferably, in this type of tiered progressive game, these qualifiers are consistent to make it easier for players to understand the multi-tiered game.

In still another preferred embodiment of the progressive processing system 12, the progressive prize value is hidden from the players. In such an embodiment, a surprise award amount is given to the players when the progressive processing system 12 determines that the award has occurred.

In yet another preferred embodiment of a progressive processing system 10, the progressive prize is awarded directly out of the gaming device by printing a cash or prizepoint voucher. In such a preferred embodiment, the game monitoring unit enables dire One preferred embodiment of a progressive game 10 is the chain reaction progressive game. In the chain reaction progressive game, an incrementing rate is created for multiple progressives or flat amounts. In a preferred embodiment, a casino administrator selects a progressive prize growth rate, which can vary based on numerous criteria. Preferably, the chain reaction progressive game enables multiple promotional progressive games to be played while overlapping each other. In a preferred embodiment, game information is sent to displays throughout the casino to further encourage player excitement. Preferably, a casino administrator selects the game parameters, and the progressive prizes are awarded at random progressive prize values and/or random progressive prize times within a "time for a winner" parameter set by the casino. Finally, when a progressive prize is to be awarded, the winner is selected from active players on the casino floor that match "select a winner" parameters, as set by the casino. Referring now to one specific, non-limiting, embodiment of a user interface 100 shown in FIG. 11, an iView-type device is described herein in greater detail. The user interface 100 is sometimes referred to herein as "additional" in that the user interface is preferably separate from the gaming screen (or other gaming presentation). Further, the user interface is sometimes referred to herein as "embedded" in that the user interface preferably includes its own processor in some preferred embodiments of the invention. The functionality of the user interface includes, by way of example only, and not by way of limitation, the ability to display animation, multimedia, and other web-type content. The embedded additional user interface 100 enables presentation of additional information (e.g., enhanced player information) to a player (or potential player) through the web page display screen 120 in an exciting, eye-catching format, while not interfering with the normal gaming processes being displayed on the gaming screen 150. Further, the embedded additional user interface 100 does not interfere with the normal gaming hardware in the gaming machine 50, but rather is easily integrated into a gaming machine 50.

In situations involving multiple gaming machine (or gaming component) manufactures, an embedded additional user interface 100 can be incorporated into a game machine 50 (either originally or by retrofitting) without requiring access to the game logic or other gaming systems that might be proprietary and inaccessible with a game machine 50 from another gaming manufacturer. Thus, in a preferred embodiment of the invention, the embedded additional user interface 100, which includes a web page display screen 120 for presenting supplementary information to a player, is incorporated into a gaming machine 50 in addition to the standard gaming screen 150 typically found in a gaming machine. The embedded additional user interface 100 may also be incorporated into a gaming machine 50 that utilizes a gaming region (e.g., a reel-spinner) instead of a standard game machine 50. This supplemental information may include general gaming information, player specific information, player excitement and interest captivation content, advertising content (targeted or otherwise), and the like. Further, in other preferred embodiments, the embedded additional user interface 100 may have the ability to interact with the game logic of the gaming processor 160, and thus, provide further functionality, such as bonus games and/or the ability to incorporate awards, promotional offers, or gifts from the web page display screen 120 to the game machine 50. Moreover, the web page display screen 120 may display supplemental information in an "attract mode" when there is no game play occurring.

In a preferred embodiment of the invention, the embedded additional user interface 100 is used to make casino services more accessible and friendly to casino patrons. In one preferred embodiment, the embedded additional user interface 100 is designed to interface with the hardware configuration of game platforms currently employed in an existing gaming communication systems network, thus decreasing implementation costs for the casino. A standard gaming network interface to the systems network, such as a Mastercom system, includes a multi-drop bus method of communicating to a keypad and display. The Mastercom system is available from Bally Manufacturing, and is described in U.S. Pat. No. 5,429,361 to Raven et al. incorporated herein by reference. One such currently utilized bus is an EPI bus (Enhanced Player Interface bus), which uses industry standard I2C hardware and signaling.

In one preferred embodiment, the embedded additional user interface 100 is used to replace/upgrade an EPI device. Preferably, the embedded additional user interface 100 replaces the EPI device in the game machine 50 in a "plug and play" manner. In other words, the old EPI device can be unplugged from the bus and the new embedded additional user interface 100 can simply be plugged into the I2C bus of the gaming machine 50, where the user interface 100 utilizes the currently employed industry standard I2C hardware and signaling without requiring any further modification. The embedded processor 130 of the embedded additional user interface 100 reads incoming I2C data (content), translates the data into a web authoring language (e.g., HTML, DHTML, XML, MACROMEDIA FLASH, animated Gifs, and JAVA Applets), and maps the data to the web page display screen 120. In this manner, the previous I2C data messages, which were typically presented on a two-line, twenty character VF display, are automatically transformed by the embedded additional user interface 100 into an attention grabbing, animated (multimedia) web page style format. This results in enhanced player satisfaction and excitement with extremely minimal retrofitting requirements.

Since, in one preferred embodiment, the embedded additional user interface 100 utilizes I2C hardware and signaling, this enables the user interface 100 to speak and understand the I2C protocol message set, and thus, communicate directly with the gaming processor 160 of the gaming machine 50 (or other networked devices) in the same fashion in which the gaming processor previously communicated with the EPI device. Accordingly, in a preferred embodiment of the invention, the functionality of the previously utilized hardware (e.g., the EPI device) is replaced and substantially upgraded with the integration of the embedded additional user interface 100 into the gaming machine 50. As such, the external hardware of any such system components (e.g., a keypad and a two-line, twenty character VF display) is eliminated.

As stated above, in one preferred embodiment, the incoming data received by the embedded additional user interface 100 is I2C signaling protocol; however, in other preferred embodiments other serial communication protocols (or electronic communication format) are utilized. Preferably, the embedded processor 130 communicates with the gaming processor 160, and/or other connected devices, over an I2C bus (or over another serial communications bus in embodiments that utilize another protocol). The web page display screen 120 of the embedded additional user interface 100 is preferably a color-graphic touch screen display. Preferably, the embedded processor 130 is at least a 32-bit processor. A preferred embodiment utilizes a 32-bit processor because cryptographic techniques, such as SHA-1 and DSA algorithms, are written and operate natively on a 32-bit system. Additionally, the Microsoft® Windows® environment, which is utilized in some preferred embodiments of the invention, is also 32-bit. Further, the internal operating system of the embedded additional user interface 100 is preferably customized to match the specific hardware to which the internal operating system attaches.

Figure 11:
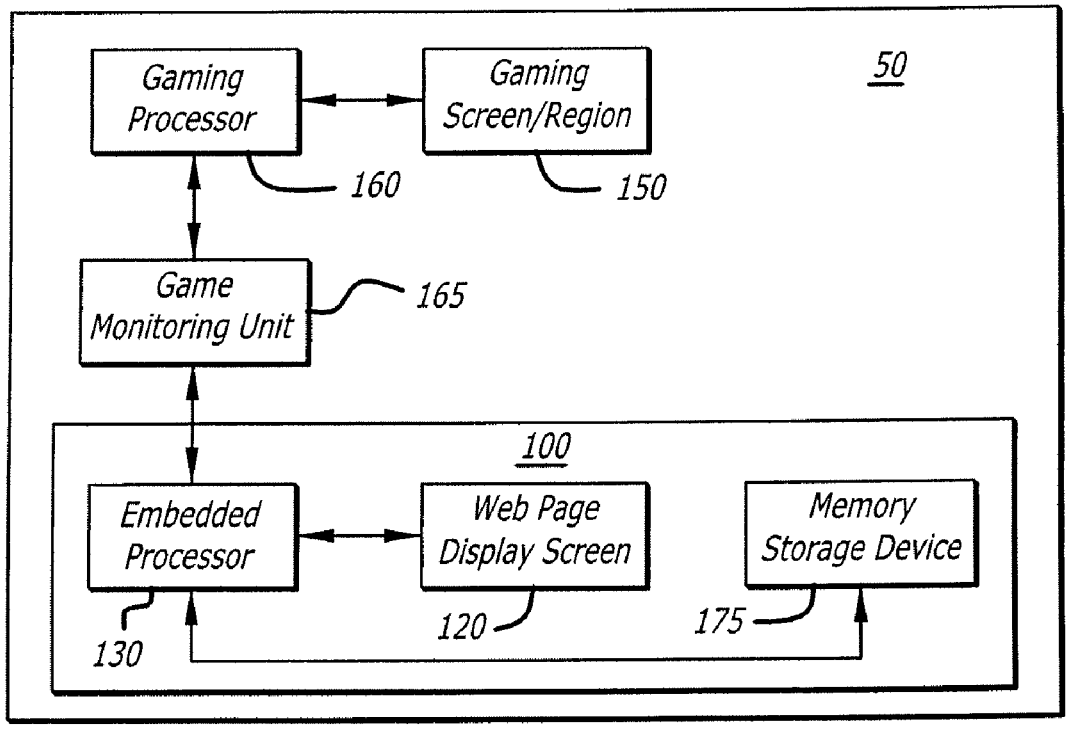
FIG. 11 illustrates a relational diagram of an embedded additional user interface utilizing a web page display screen and an embedded processor that receives data messages from a game monitoring unit that are translated into web page content and mapped to the web page display screen.

Preferably, the embedded additional user interface 100 is an embedded computer board that, in addition to the embedded processor 130 and the web page display screen 120, further includes a removable COMPACT FLASH card 175 (or other memory storage device), as shown in FIG. 11, and a network adapter port. Content and feature updates to the embedded additional user interface 100 are accomplished by physically swapping out the COMPACT FLASH card 175 (or other memory storage device). Thus, in order to retrieve data from the embedded additional user interface 100, the data is accessed by physically removing and reading the COMPACT FLASH card 175.

In one preferred embodiment, the internal operating system utilized by the embedded processor 130 of the embedded additional user interface 100 is WINDOWS® CE version 4.2 (or higher). Preferably, the embedded additional user interface 100 is built upon a PXA255-based board developed by the Kontron Corporation. Additionally, in a preferred embodiment of the embedded additional user interface 100, the browser control for the web page display screen 120 is MICROSOFT® INTERNET EXPLORER® 6.0 (or higher), which is shipped standard with WINDOWS® CE 4.2, the preferred internal operating system for the embedded processor 130.

Figure 12:
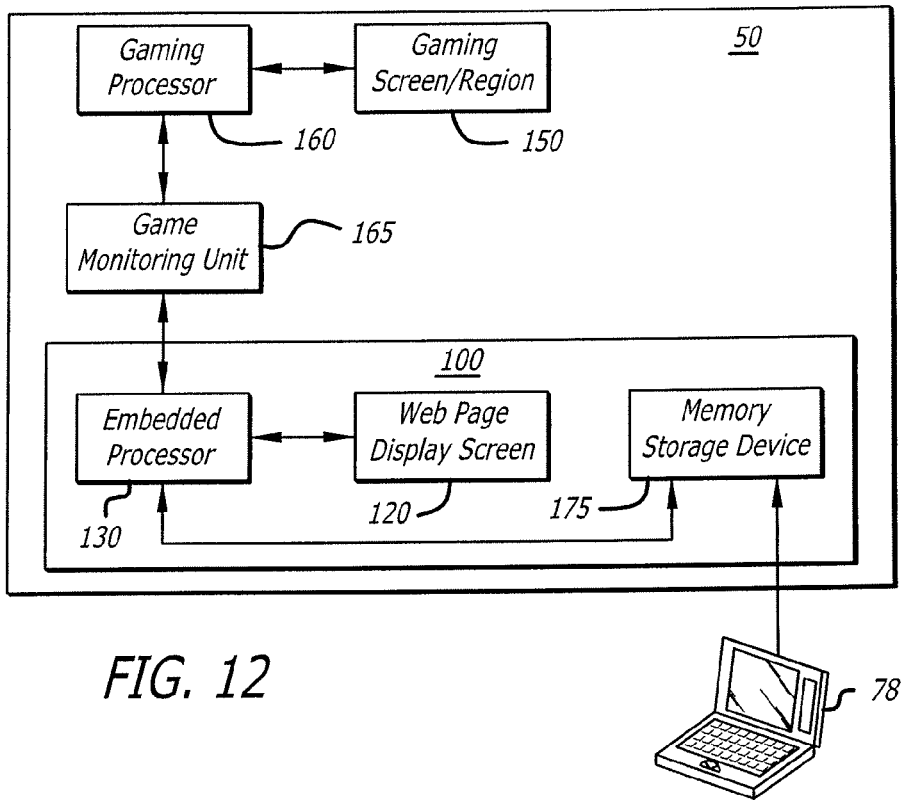
FIG. 12 illustrates a relational diagram of an embedded additional user interface utilizing a web page display screen and an embedded processor that receives cryptographically-certified web page content from a portable computer via a network adapter port.

Referring now to FIG. 12, in this preferred embodiment, content may be locally downloaded. Specifically, in one preferred embodiment, the content is updated through a physical USB (or other connection) that is used to download the new content. In one preferred embodiment, the data on the COMPACT FLASH card 175 can be accessed by connecting a separate computer 178 to the network adapter port of the embedded additional user interface 100. This embodiment allows updating the contents of the operating system, changing the operating system itself, and receiving data from the COMPACT FLASH card 175. Physical removal of the COMPACT FLASH card 175 is also still be an option for update and inspection of files on the embedded additional user interface 100.

In one preferred embodiment, a portable computer is used to store and publish data content to the COMPACT FLASH card 175 on the embedded additional user interface 10, as well as to receiving data from the COMPACT FLASH card 175 on the embedded additional user interface. In this embodiment, all content on the embedded additional user interface 100 is authenticated as if it were a gaming machine.

In another preferred embodiment, a network adapter port is run on the embedded computer board of the user interface 100. This embodiment also includes a boot loader. Further, in this embodiment, the portable computer 178 (described above) includes components for use in uploading data to, and downloading data from, the COMPACT FLASH card 175 on the embedded additional user interface 100. Specifically, the components that run on the portable computer 178 are for moving new data content to the embedded additional user interface 100, and for validation and verification of the data content that is on the embedded additional user interface. Preferably, all data that is used to update the COMPACT FLASH card 175 moves to or from the embedded additional user interface 100 over the single built in network adapter port on the board.

Prior to the advent of the embedded additional user interface 100 of the invention, gaming regulators would have been unwilling to allow casino administrators to design their own content. However, due to the cryptographic technology implemented by the embedded processor 30 in the embedded additional user interface 100, a certification process is provided by the invention with sufficient security for gaming regulators to allow casino administrators to design their own content. Specifically, in one preferred embodiment, the certification process offered ensures authentication and non-repudiation of the casino administrator designed web content. Preferably, in the invention the certification process provided further ensures auditability and traceability. Various cryptographic technologies, such as authentication and non-repudiation (described herein below), are utilized in preferred embodiments of the invention, to provide sufficient security for gaming regulators to allow casino administrators to design their own content.

In one preferred embodiment, this certification process is used to certify "signed content" (created by the casino owners) in the same manner that a "signed program" is certified. Preferably, PKI (Public Key Infrastructure) is utilized in the certification process. PKI is a system of digital certificates, Certificate Authorities, and other registration authorities that verify authenticity and validity. In one preferred embodiment, a "new tier" or second PKI is created that is rooted in the primary PKI and that leverages the capabilities of the certificate (e.g., a x509 certificate) that allow for limited access. Thus, this preferred embodiment allows the attributes within the certificate to be used to provide "levels" of code access and acceptance in the gaming industry.

In one embodiment, the content is protected by digital signature verification using DSA (Digital Signature Algorithm) or RSA (Rivest-Shamir-Adleman) technology. In this regard, the content is preferably protected using digital signature verification so that any unauthorized changes are easily identifiable. A digital signature is the digital equivalent of a handwritten signature in that it binds an individual's identity to a piece of information. A digital signature scheme typically consists of a signature creation algorithm and an associated verification algorithm. The digital signature creation algorithm is used to produce a digital signature. The digital signature verification algorithm is used to verify that a digital signature is authentic (i.e., that it was indeed created by the specified entity). In another embodiment, the content is protected using other suitable technology.

In one preferred embodiment, a Secure Hash Function-1 (SHA-1) is used to compute a 160-bit hash value from the data content or firmware contents. This 160-bit hash value, which is also called an abbreviated bit string, is then processed to create a signature of the game data using a one-way, private signature key technique, called Digital Signature Algorithm (DSA). The DSA uses a private key of a private key/public key pair, and randomly or pseudo-randomly generated integers, to produce a 320-bit signature of the 160-bit hash value of the data content or firmware contents. This signature is stored in the database in addition to the identification number.

In another preferred embodiment, the invention utilizes a Message Authentication Code (MAC). A Message Authentication Code is a specific type of message digest in which a secret key is included as part of the fingerprint. Whereas a normal digest consists of a hash (data), the MAC consists of a hash (key+data). Thus, a MAC is a bit string that is a function of both data (either plaintext or ciphertext) and a secret key. A Message Authentication Code is attached to data in order to allow data authentication. Further, a MAC may be used to simultaneously verify both the data integrity and the authenticity of a message. Typically, a Message Authentication Code (MAC) is a one-way hash function that takes as input both a symmetric key and some data. A symmetric-key algorithm is an algorithm for cryptography that uses the same cryptographic key to encrypt and decrypt the message.

A Message Authentication Code can be generated faster than using digital signature verification technology; however, a Message Authentication Code is not as robust as digital signature verification technology. Thus, when speed of processing is critical the use of a Message Authentication Code provides an advantage, because it can be created and stored more rapidly than digital signature verification technology.

In one preferred embodiment, the authentication technique utilized is a bKey (electronic key) device. A bKey is an electronic identifier that is tied to a particular individual. In this manner, any adding, accessing, or modification of content that is made using a bKey for authentication is linked to the specific individual to which that bKey is associated. Accordingly, an audit trail is thereby established for regulators and/or other entities that require this kind of data or system authentication.

Figure 13:
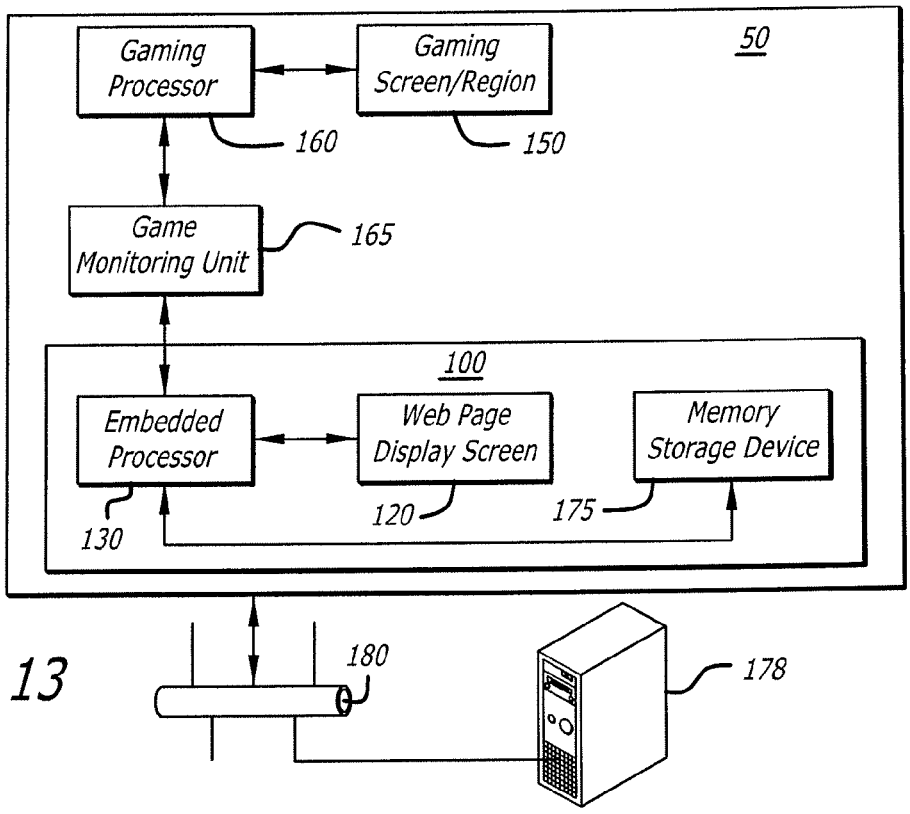
FIG. 13 illustrates a relational diagram of an embedded additional user interface utilizing a web page display screen and an embedded processor that receives web page content from a back-end server via an Ethernet-networked backbone.

Referring now to FIG. 13, in one preferred embodiment, the embedded additional user interface 100 connects to an Ethernet-networked backbone 180 instead of a local system network. Currently, casino networks are not Ethernet, but rather are smaller, more simplistic local system networks. Thus, in this Ethernet-networked backbone 180 embodiment, the current system network is replaced by an industry standard Ethernet backbone, such as 10/100 base T Ethernet running over Cat 3, 4, 5, 6, or higher. Thus, a standard 10/100 base T Ethernet card is added to the processor in this embodiment. Preferably, the network employs TCP/IP, HTTP, and XML messaging or a variant of XML. Nevertheless any suitable protocol may be used.

Further, in another preferred embodiment, the embedded additional user interface 100 connects to a full featured, back end, download configuration server 190 through the above-described Ethernet-networked backbone 180 as shown in FIG. 13. In such an embodiment, the full-featured server 190 can schedule downloads of content (gaming or otherwise) as well as upload information from the gaming machines 50, such as what options the gaming machines 50 currently possess. Accordingly, in a preferred embodiment, the primary use of the server 190 is as a data download and data retrieval server. While this server 190 does upload and download web content style information, it is typically not connected to the World Wide Web. This server 190 must be authenticated (just like a game machine 50) to make the content served to the embedded additional user interface 100 acceptable to the gaming regulators. Preferably, utilization of the Ethernet-networked backbone 180 and the server 190 provides many system benefits, including but not limited to reliability, maintainability, security, content staging, content testing, deployment procedures, and incident recovery. In one embodiment, deliverables also preferably include content templates and guidelines for casino owners and administrators to create their own web content for deployment to the web server. In one embodiment, the web server 190 has its content authenticated in the same manner as the embedded additional user interface 100 to allow content to be downloaded to the web page display screen 120.

Figure 14:
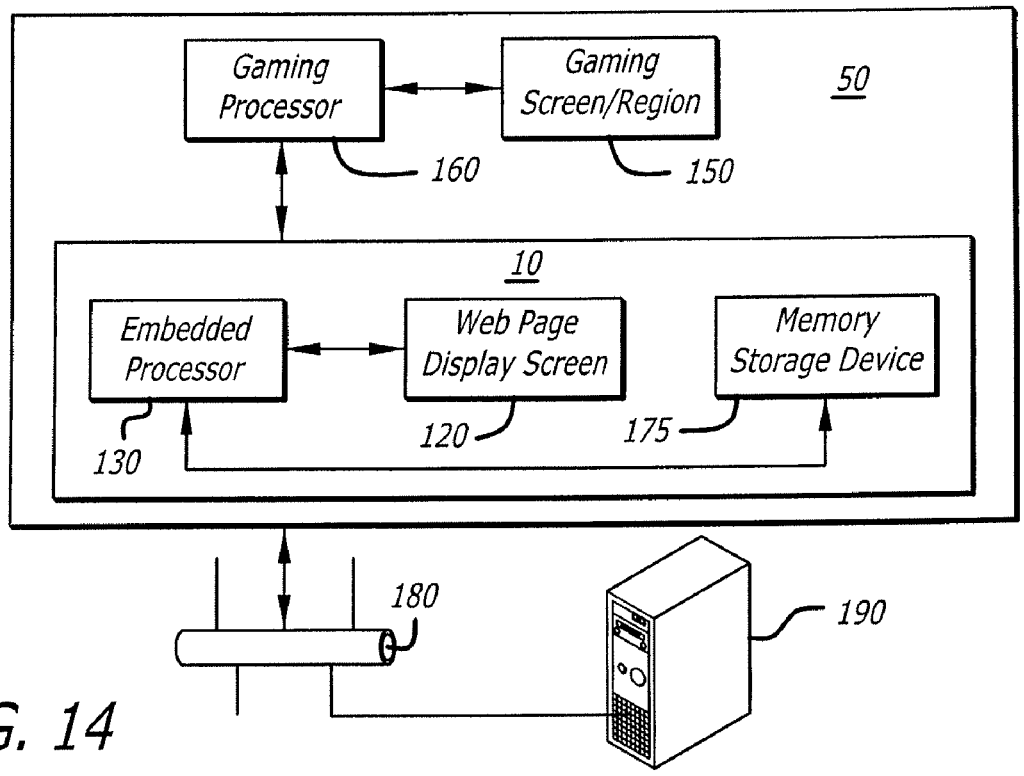
FIG. 14 illustrates a relational diagram of an embedded additional user interface utilizing a web page display screen and an embedded processor that includes the functionality of a standard gaming processor.

Referring now to FIG. 14, in another preferred embodiment of the invention, the functions previously performed by the gaming monitoring unit 165, as shown in FIGS. 11-13, of the gaming machine 50 are supported by the embedded processor 130 of the embedded additional user interface 100. Otherwise stated, the GMU code is transitioned from the gaming monitoring unit 165 into the embedded processor 130 in the embedded additional user interface 100. Accordingly, such a configuration removes the need for the gaming monitoring unit 165 in the gaming machine 50. This results in a significant reduction in the amount and complexity of the hardware, as well as completing a phased transition of more traditional style gaming machines 50 into more modernized upgraded gaming machines.

Thus, in such a preferred embodiment, the invention is directed towards an embedded additional user interface 100 that is incorporated into a gaming machine 50, the gaming machine in turn including a game machine 150 or other appropriate gaming region (e.g., spinning reels), but does not include a gaming monitoring unit 165. Such an embedded additional user interface 100 still includes a web content capable display screen 120 and an embedded processor 130. Once again, the web content capable display screen 120 presents web information to a user via the display screen. The embedded processor 130 preferably utilizes an internal operating system. Furthermore, in this embodiment the embedded processor 130 additionally includes standard gaming monitoring unit functionality (GMU code), since it replaces the gaming monitoring unit 165 in the gaming machine 50. As before, the embedded processor 130 reads incoming data, translates the data into a web protocol (web authoring language), if necessary, and maps the data to the web content capable display screen 120.

In a preferred embodiment, information can also be input by a user into the web page display screen 120 of the user interface 100. The web page display screen 120 of the user interface 100 employs a virtual keypad. Further, the user interface 100 uses a keypad dictionary that allows a user to be able to enter a vastly greater amount of information than was previously possible using a twelve-digit VF keypad. For example, the virtual key on the touch screen that is displayed by the browser is pressed by a user. This calls the Keypad object by calling its Dispatch interface with a string that identifies which virtual key was pressed. The Keypad object looks up the string in the Dictionary object that has been loaded at initialization time with a set of keys to return when that string is passed to it. When it retrieves this set of zero or more key characters, it passes them to the GMU by calling the interface exposed by the object.

Typically, a network interface (or equivalent system) is used to control the flow of funds used with the gaming machine 50 within a particular casino. By utilizing the embedded additional user interface 100 of the invention, the gaming network interface can be instructed to move funds between player's accounts and gaming devices by merely touching the web page display screen 120. In addition, many other more sophisticated commands and instructions may be provided. Thus, the embedded additional user interface 100 improves the player and casino employee interface to the gaming machine 50, directly at the gaming device itself.

In a preferred embodiment of the invention, the web page display screen 120 of the embedded additional user interface 100 enables a player to be shown player messages in an animated, multimedia, web content style environment. These messages would previously have been displayed in a significantly more mundane format on a separate display device (e.g., a two-line VF display device). In some preferred embodiments, touch screen buttons in the web page display screen 120 are used by the player to navigate between windows in web page display screen 120 and allow access to system functions such as cashless withdraw, balance requests, system requests, points redemption, and the like. In other preferred embodiments of the invention, the web page display screen 120 utilizes various other data input techniques commonly known in the art, instead of the touch screen data entry. Thus, implementation of the embedded additional user interface 100 is an efficient, highly beneficial, and substantial upgrade to a gaming machine 50 that greatly increases the functionality over what was previously possible using an EPI device.

In one preferred embodiment, text data messages are translated into web page navigation requests by the embedded processor 130 and then displayed on the web page display screen 120 as shown and discussed with respect to FIGS. 15A and 15B below. Script languages, such as JAVA SCRIPT and VB SCRIPT, are also utilized for some of the web pages. Preferably, the embedded additional user interface 100 emulates the twelve-digit keypad and the two-by-twenty VF display on the web page display screen 120, which has touch screen capabilities. In this embodiment, commands that were previously displayed on the two-by-twenty VF display are matched to a corresponding URL and a browser is used to render the page on the web page display screen 120. The web pages displayed contain touch-screen keys that effectively emulate hardware keys.

Figure 15A:
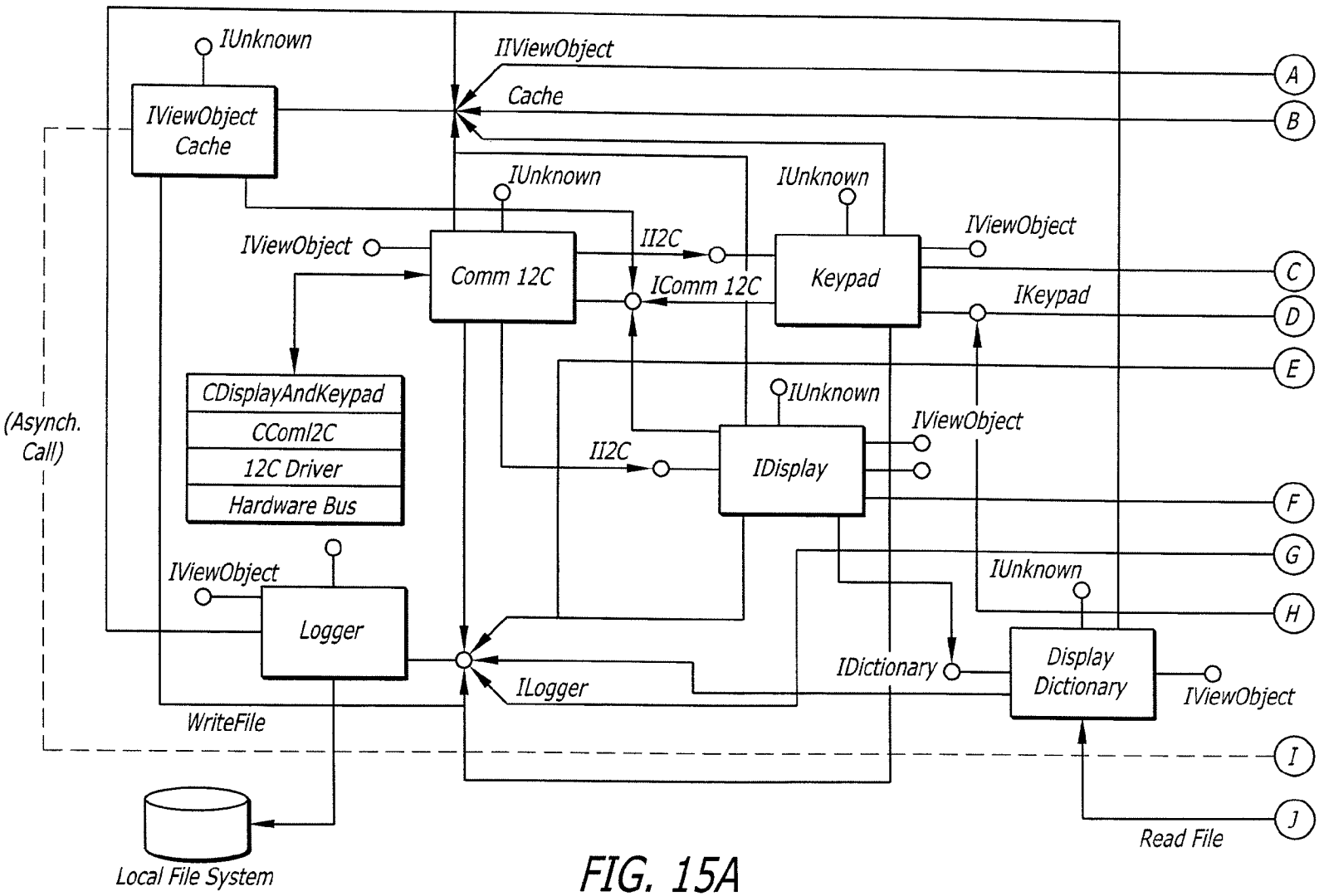
FIGS. 15A and 15B are each partial views of a diagram that illustrates an object interaction diagram of an embedded additional user interface.
Figure 15B:
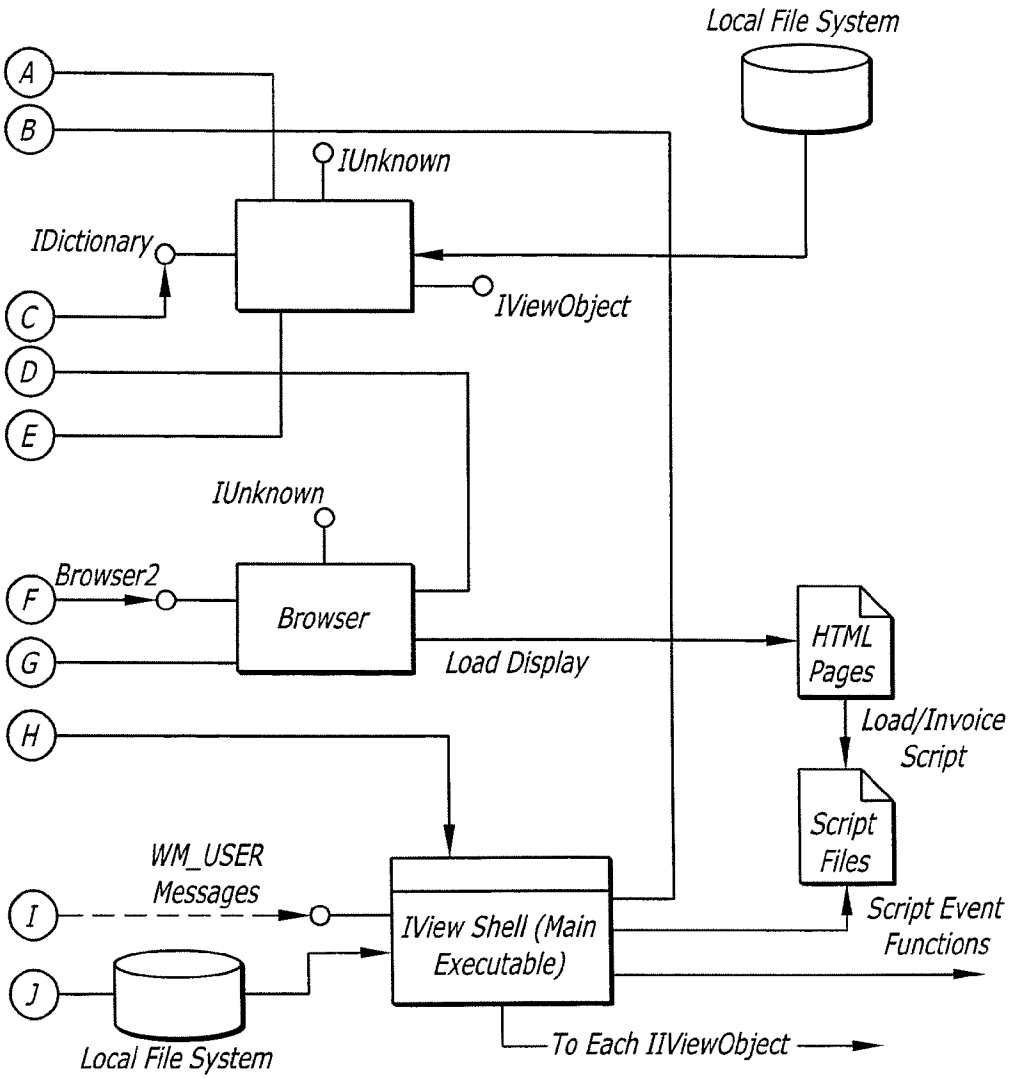
Figure 16:
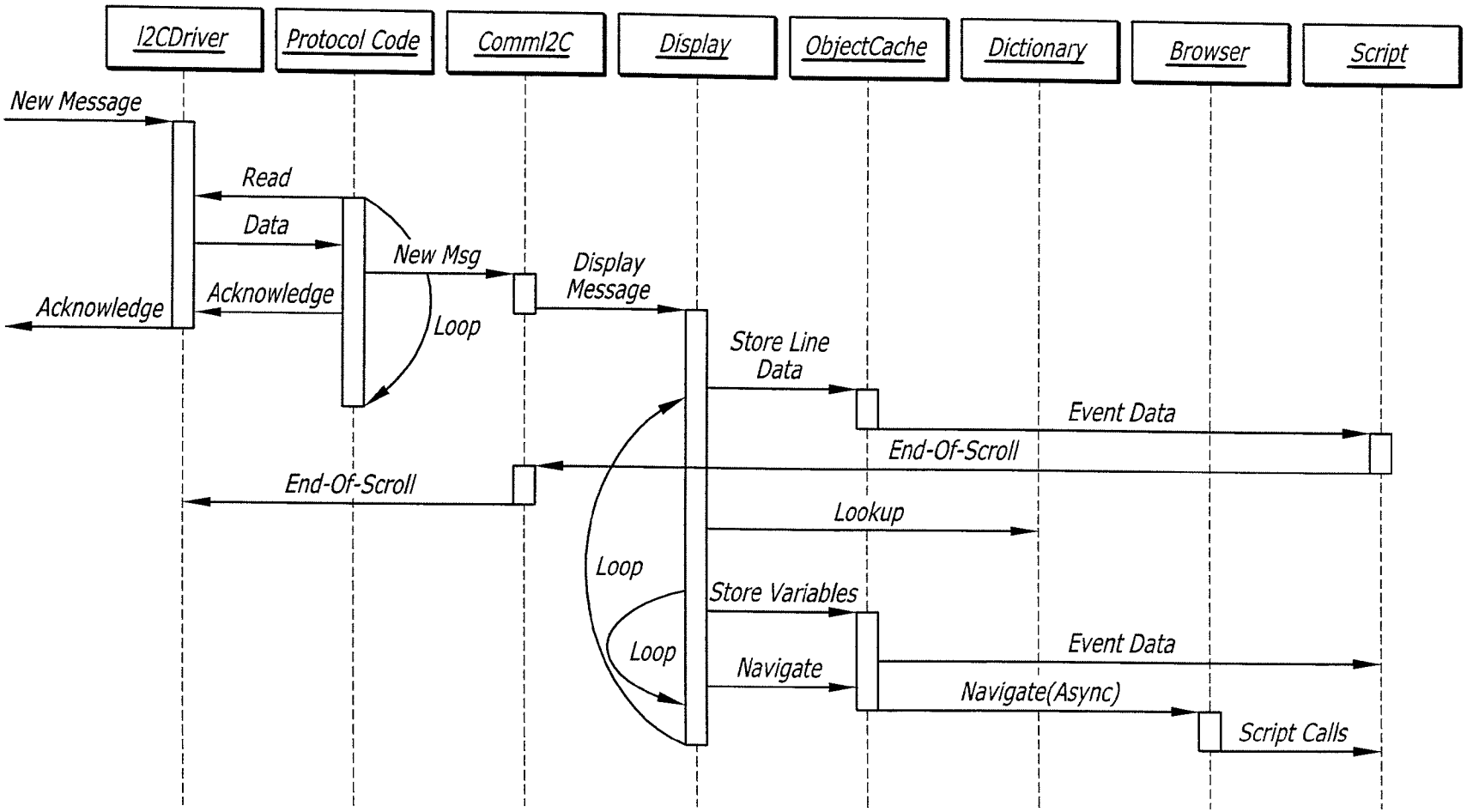
FIG. 16 is a diagram showing the sequence of events that occur when data is sent between the embedded additional user interface and the game monitoring unit.

With reference to FIGS. 15A and 15B, in one preferred embodiment of the invention, a dictionary URL approach is used for translating the data messages into web page information. In this manner, data messages are "looked up" in a dictionary data file where they can be redirected to an attractive URL. The embedded processor 130 responds to requests on the I2C bus that were intended for the prior art enhanced player interface (EPI device) VF display. The web page display screen 120 is not a passive display device like traditional PC monitors, but rather the display screen 120 must respond to commands with text type responses. These requests include initialization requests, status requests, and display requests. With reference to FIG. 16, as each text data message to be displayed is passed into the embedded processor 130, the processor 130 calls a URL Dictionary to look up a URL with which to replace the text data message. Once the substitution is complete, the embedded processor 130 instructs the web page display screen 120 to present (or navigate to) the appropriate web page.

Figure 17:
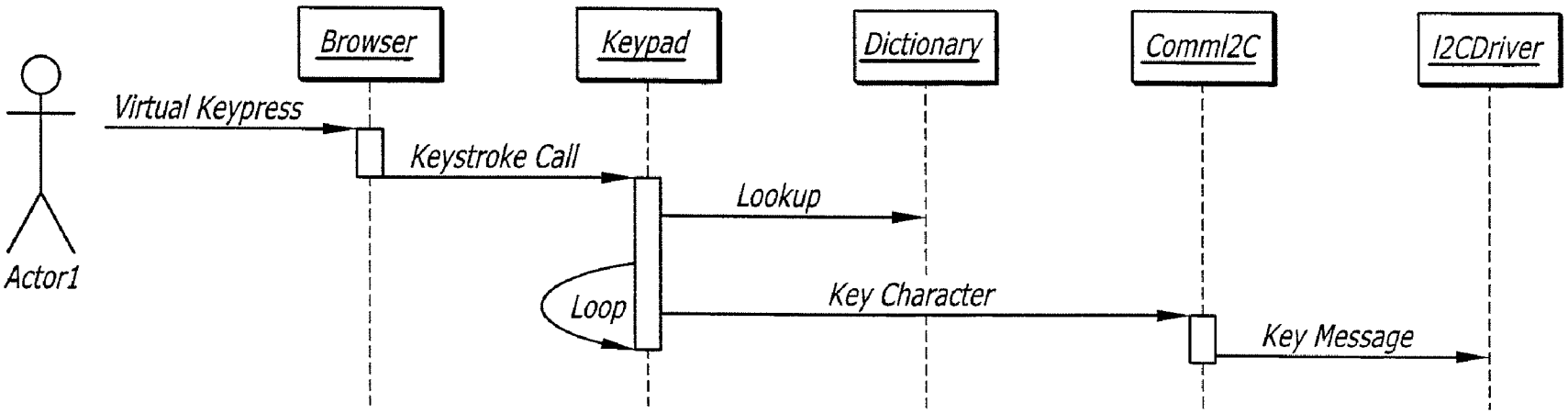
FIG. 17 is a diagram showing the sequence of events that occurs when a virtual key is pressed on the web page display screen.

Accordingly, with reference to FIG. 17, a URL Dictionary component is used to map a text string, sent from the embedded processor 130 and intended for the display on the two-by-twenty VF display, to a URL that can be used to display a much more visually enhanced graphical representation of the same message. Thus, the URL Dictionary component contains a listing of the possible text messages to be supported that could be sent from the embedded processor 130, and a mapping to a set of the desired eye-catching, web content to be displayed on the web page display screen 120. In this event that a message is not in the URL Dictionary, such a message is mapping to a page that substitutes for the two-line mode.

In the preferred embodiments described above, the embedded processor 130 of the embedded additional user interface 100 reads incoming I2C data messages, translates the I2C data messages into a web authoring language (e.g., HTML, DHTML, XML, MACROMEDIA FLASH), and maps the newly translated web page data message to the web page display screen 120. Additionally, the embedded additional user interface 100 can also read incoming data messages that are already in a web authoring language (e.g., HTML, DHTML, XML, MACROMEDIA FLASH), and map this web page data to the web page display screen 120. Further, and highly advantageously, a preferred embodiment of the invention also allows casinos that are using the embedded additional user interface 100 to design and use their own content, thereby giving the casinos the ability to decide what the web page presented on the web page display screen 120 of the user interface 100 will look like.

The potential advantages of utilizing the embedded additional user interface 100 of the invention are numerous. These potential advantages include, by way of example only, and not by way of limitation; providing animated and/or multimedia web style content, providing fonts and icons which are larger and more aesthetically appealing; providing special services to players, (e.g., multiple languages, assistance for handicapped individuals); facilitating interactive uses of the web page display screen 120; providing the ability to customize the "look and feel" of the web page display screen 120 for players and casino employees; increased player excitement and participation; and simplified replaceability and/or upgradeability from an EPI device or other similar non-web page style components.

Referring now to a preferred embodiment of the progressive processing system 12 as shown in FIGS. 1, 2A, and 2B, information utilized by the system to generate a progressive game 10 includes, by way of example only, and not by way of limitation, the following preferred specification parameters: average length of time is in minutes, 15 characters, leading zeros; all amount fields are in whole dollars, 15 characters, leading zeros; progressive game code is generated on the iSERIES, 8 characters; the system PROG.ID is generated by the engine 60, 8 characters; NUMBER OF SLOTS, is generated on the iSERIES, 10 characters, leading zeros, (number of slots included in the promotion); NUMBER CARDED SLOTS, is generated on the iSERIES, 10 characters, leading zeros, (number of slots machines included in a promotion with patron cards inserted) and SEQUENCE NUMBER, generated on the iSERIES, 3 characters, leading zeros.

In one specific preferred embodiment, in order to generate a new promotion progressive game 10 to the progressive processing system 12, the user first creates a new promotion on the iSERIES. Next, the SMS (slot management system) programming detects the new promotion progressive game 10 should be activated, and generates an "ADD TO ENGINE" transaction. Preferably, the transaction is then sent to a data queue SDSM0068. In one preferred embodiment, the ADD transaction written to the data queue contains the following data fields:

| | | | | |
|---|---|---|---|---|
| ADD TO ENGINE, value 001. | TRID001 | A | 01 | 03 |
| AVERAGE WIN AMOUNT | AVG$001 | A | 04 | 18 |
| AVERAGE LENGTH OF TIME, MIN. | AVGT001 | A | 19 | 33 |
| SMS MOUNDS-OF-MONEY CODE | PRCD001 | A | 34 | 41 |
| MOUNDS-OF-MONEY DESCRIPTION | PRZD001 | A | 42 | 81 |
| STARTING DATE YYYYMMDD | SDHY001 | A | 82 | 89 |
| STARTING TIME HHMMSS | STME001 | A | 90 | 95 |
| RESET AMOUNT | STR$001 | A | 96 | 110 |
| SEQUENCE NUMBER | SEQ#001 | A | 111 | 113 |

In one preferred embodiment, the connection program on the iSERIES reads the data queue and forwards the "ADD TO ENGINE" transaction to the engine 60. When the engine 60 receives the "ADD TO ENGINE" transaction, the engine generate a "PROG.ID CODE", and responds (with the following data) back to the iSERIES. Preferably, the connection program writes the following image to a data queue SDSM0066.

| | | | | |
|---|---|---|---|---|
| ADDED TO ENGINE, value 101 | TRID101 | A | 01 | 03 |
| SMS MOUNDS-OF-MONEY CODE | PRCD101 | A | 04 | 11 |
| ENGINE PROG. ID CODE | PRCL101 | A | 12 | 19 |
| SEQUENCE NUMBER | SEQ#001 | A | 20 | 22 |

In a preferred embodiment, the SMS programming on the iSERIES, reads the data queue SDSM0066 and updates the promotion record as having been added and activated on the engine 60. Additionally, the engine PROG.ID is linked to the new promotion progressive game 10 code.

In one specific preferred embodiment, in order to delete (remove) an existing promotion progressive game 10 on the progressive processing system 12, the user first flags the existing promotion for deletion on the iSERIES. Preferably, the SMS programming then generates a "DELETE FROM ENGINE" transaction and sends this transaction to a data queue SDSM0068. In one preferred embodiment, the DELETE transaction written to the data queue contains the following data fields:

| | | | | |
|---|---|---|---|---|
| DELETE FROM ENGINE, value 002. | TRID002 | A | 01 | 03 |
| SMS MOUNDS-OF-MONEY CODE | PRCD002 | A | 04 | 11 |
| ENGINE PROG.ID CODE | PRCL002 | A | 12 | 19 |
| SEQUENCE NUMBER | SEQ#002 | A | 20 | 22 |

In a preferred embodiment, the connection program on the iSERIES reads the data queue and forwards the "DELETE FROM ENGINE" transaction to the engine 60. When the engine 60 receives the "DELETE FROM ENGINE" transaction, it removes the progressive game 10 from its active progressive games 10 and responds (with the following data) back to the iSERIES. Preferably, the connection program writes the following image to a data queue SDSM0066.

| | | | | |
|---|---|---|---|---|
| DELETED FROM ENGINE, value 102. | TRID102 | A | 01 | 03 |
| SMS MOUNDS-OF-MONEY CODE | PRCD102 | A | 04 | 11 |
| ENGINE PROG. ID CODE | PRCL102 | A | 12 | 19 |
| SEQUENCE NUMBER | SEQ#102 | A | 20 | 22 |

In a preferred embodiment, the number of slots and number of carded slots in a promotion progressive game 10 may require updating. Preferably, the iSERIES SMS programming periodically updates each active promotion game "Number of Assets" and "Number of Carded Assets". Once the iSERIES has been updated, it notifies progressive processing system 12 of the updated values with an "UPDATE NUMBERS" transaction and sends the transaction to a data queue SDSM0068. Preferably, the "UPDATE NUMBERS" transaction written to the data queue contains the following data fields:

| | | | | |
|---|---|---|---|---|
| UPDATE NUMBERS, VALUE 003. | TRID003 | A | 01 | 03 |
| NUMBER OF SLOTS | #AST003 | A | 04 | 13 |
| NUMBER CARDED SLOTS | #CRD003 | A | 14 | 23 |
| ENGINE PROG. ID CODE | PRCL003 | A | 24 | 31 |

In a preferred embodiment, the connection program on the iSERIES reads the data queue and forwards the "UPDATE NUMBERS" transaction to the engine 60. When the engine 60 receives a "UPDATE NUMBERS" for the promotion, it uses these numbers to compute the value of the promotion progressive prize. Preferably, the engine 60 does not need to respond to the "UPDATE NUMBERS" transactions.

In a preferred embodiment, the promotion progressive game 10 may be required to obtain promotional prize values from the engine 60. The iSERIES SMS programming periodically acquires the active promotional progressive prize values for each active promotion progressive prize from the engine 60 using a "GET CURRENT VALUE" transaction, which sends the transaction to a data queue SDSM0068. Preferably, the "GET CURRENT VALUE" transaction written to the data queue contains the following data fields:

| | | | | |
|---|---|---|---|---|
| GET CURRENT VALUE, VALUE 004. | TRID004 | A | 01 | 03 |
| ENGINE PROG. ID CODE | PRCL004 | A | 04 | 11 |

In a preferred embodiment, the connection program on the iSERIES reads the data queue and forwards the "GET CURRENT VALUE" transaction to the engine 60. Preferably, when the engine 60 receives a "GET CURRENT VALUE" transaction for a promotional progressive game, it responds with the following data to the iSERIES. Preferably, the connection program writes the following image to a data queue SDSM0066.

| | | | | |
|---|---|---|---|---|
| RESPONSE CURRENT VALUE, VALUE 104. | TRID104 | A | 01 | 03 |
| ENGINE PROG. ID CODE | PRCL104 | A | 04 | 11 |
| PROG. ID AMOUNT | CUR$104 | A | 12 | 26 |

In a preferred embodiment, the SMS programming on the iSERIES, reads data queue SDSM0066, and updates the promotional progressive prize value with the current cash value from the engine 60.

Referring now to another aspect of a preferred embodiment of the progressive processing system 12, when the engine 60 has determined that it is time for a promotional progressive prize to be awarded, the engine generates a "SELECT WINNER VALUE" transaction. The engine 60 informs the iSERIES of the win event by sending the following transaction to the iSERIES. Preferably, it also stops incrementing the promotional progressive prize's value. In a preferred embodiment, the iSERIES connection program writes the following image to a data queue SDSM0066.

| | | | | |
|---|---|---|---|---|
| SELECT WINNER VALUE, VALUE 105. | TRID105 | A | 01 | 03 |
| ENGINE PROG. ID CODE | PRCL105 | A | 04 | 11 |
| WINNING AMOUNT | CUR$105 | A | 12 | 26 |

In a preferred embodiment, the SMS programming on the iSERIES, reads the data queue SDSM0066, updates the promotional progressive prize's value, and selects a winning patron.

Once the progressive processing system 12 indicates that the criteria has been met for awarding the progressive prize for a promotional progressive game 10, the iSERIES programming selects a winner of the progressive prize. Specifically, the iSERIES programming reads all SMS active slot machine (asset) records from the active assets file (SFPAT) and builds a work file (SFPP7). In one preferred embodiment, the slot machine selection only includes slot machines with: (1) a patron card inserted, (2) where the patron's card type matches the card type(s) assigned to be included in the promotion, (3) where the slot machine's zone on the casino floor matches the zone(s) assigned to be include in the promotion, and (4) where the slot machine's SMS manufacture code matches the manufacture code(s) to be included in the promotion. Preferably, the work file SFPP7 contains the following data:

| | |
|---|---|
| ASSET NUMBER | 5.0 |
| PATRONS ACCOUNT NUMBER | 9 |
| PATRONS ACCOUNT SUFFIX | 2 |
| RATINGS ASSET DENOMINATION | 7.2 |
| RATINGS ASSET DENOMINATION | 1 |
| GEAR-BOX ID. | 3.0 |
| RATINGS ASSET LOCATION | 4.0 |
| RATINGS ASSET ZONE | 2 |

In a preferred embodiment, once all included assets records have been written into the work file, the number of included records is known. Preferably, the programming uses a random number program to generate a random number between one and the number of records in the work file SFPP7. In a preferred embodiment, this record contains the winning player's account number, and the slot machine (asset) number. Preferably, the progressive processing system 12 designates this player as the winning player to the promotional progressive game 10. In a preferred embodiment, the system 12 broadcasts transactions to all slot machines on the casino floor announcing the winner, as well as sending a transaction to the slot machine of the winning patron, announcing the selected player as winner.

If no winner selected, the iSERIES programming passes by the "selecting a winner" transactions until the next cycle (e.g., approximately 15 seconds to one minute). Preferably, once the SMS programming on the iSERIES selects a winning player, it notifies the engine 60 of the winner with a "POST WINNER DATA" transaction, and sends the transaction to a data queue SDSM0068. In a preferred embodiment, the "POST WINNER DATA" transaction written to the data queue contains the following data fields:

| | | | | |
|---|---|---|---|---|
| POST WINNER DATA, VALUE 005. | TRID005 | A | 01 | 03 |
| ENGINE PROG. ID CODE | PRCL005 | A | 04 | 11 |
| WINNERS NAME | NAME005 | A | 12 | 41 |
| WINNERS CITY | CITY005 | A | 42 | 71 |
| WINNERS STATE/COUNTRY | STAT005 | A | 72 | 101 |

In a preferred embodiment, the connection program on the iSERIES reads the data queue and forwards the "POST WINNER DATA" transaction to the engine 60. When the engine 60 receives the "POST WINNER DATA" transaction it transmits the winning patron data to any signage connected thereto. Preferably, the engine 60 does not need to respond to the POST WINNER transaction.

Multiple Property Power Winners for Slot and Table Games

Figure 18:
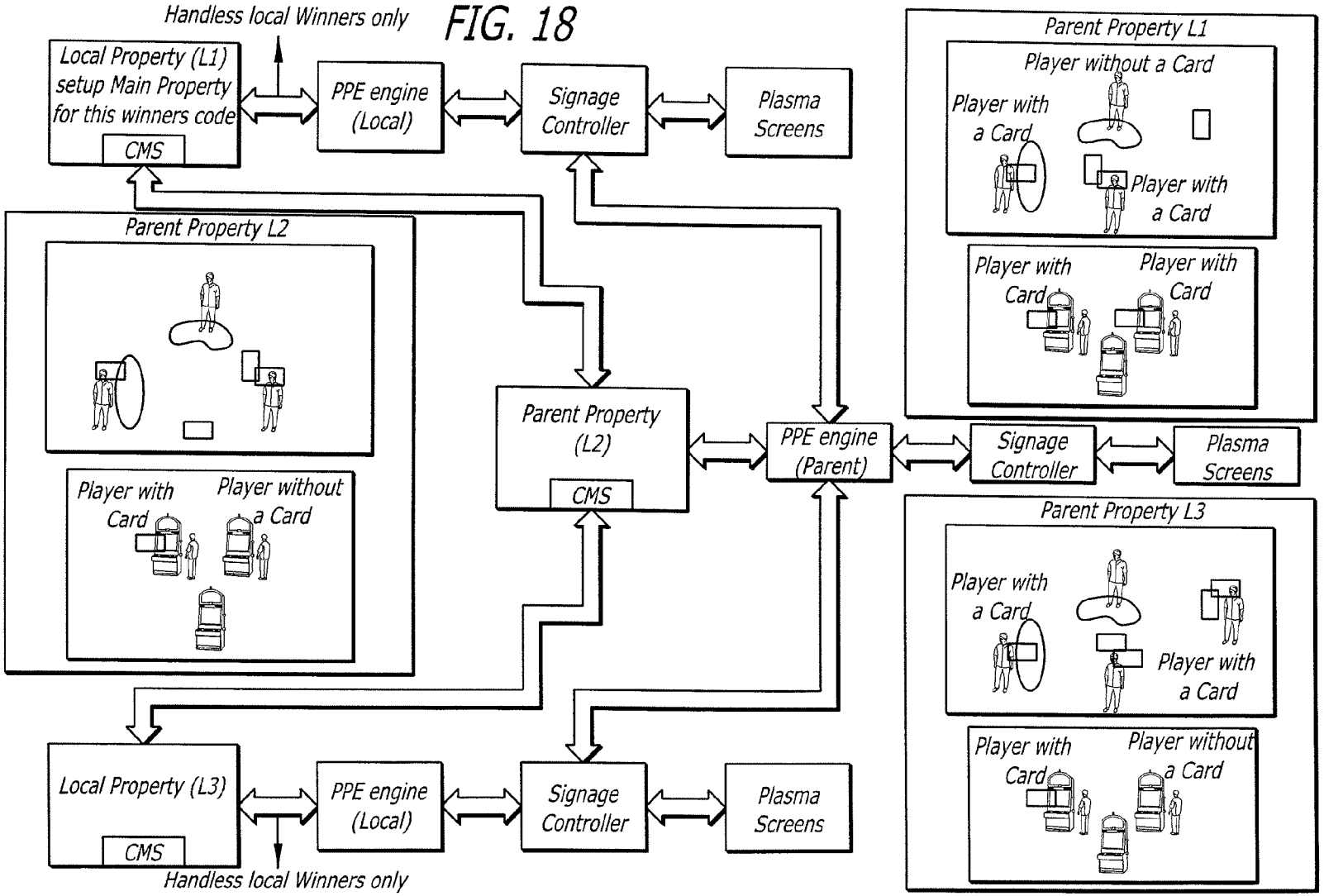
FIG. 18 is a diagram showing a multi-site power winners system for both slot machines and table games configured with a parent property and two local properties.

Referring now to FIG. 18, a diagram of a multi-site power winners system for both slot machines and table games that is configured with a parent property and two local properties is shown. In one embodiment, the multi-site power winners system 200 provides a method of selecting a winner for a prize in a multi-site casino or resort environment. Additionally, the system 200 provides the properties with the ability to configure a combined jackpot amount across one or more properties. The multi-site power winners system 200 includes a Promotional Progressive Engine 210 (PPE) that works in conjunction with a Casino Marketing Server 220 (CMS). A central point is used to store the jackpot reward amount over multiple CMS 220 systems. The PPE 210 tracks and determines when the drawing occurs. All patrons that meet the requirements are part of the selection. A sign controller sends the jackpot amount to all of the properties configured in the combined jackpot reward. The master winner controls send the jackpot amount to the selected winning patron. When the jackpot hits, there can be a chain reaction set up to payout all patrons with their card in a configured lesser amount (e.g., $25.00). This can be rewarded in the form of eBonus rewards to the game for the patrons with their player cards inserted at the time the Power Winner reward is hit.

The engine settings (i.e., PPE settings) and winners settings (i.e., CMS settings) at each site play a distinct role. These settings are setup in controls at the Parent and Local Properties within the structure of the multi-site power winners system 200. The keyed values are validated on multiple properties systems. The Promotional Progressive Engine 210 works along with the Casino Marketing Server 220 in the multi-site power winners system 200, which stores the starting value, average progressive reward value, average length of time to run the progressive and the start time. The PPE 210 powers the multi-site power winners system 200. The PPE 210 provides unique mathematical algorithms to calculate the real-time progressive amount. Further, the PPE 210 conducts the time based random drawings with increasing the probability of hitting. Typically, the PPE 210 is set up to track multiple concurrent winners programs and will suspend and wake during a non-24 hour operation.

The multi-site power winners system 200 manages a player base at a multi-site casino operation or resort for carded or un-carded players at slot machines and/or table games. In some embodiments, active carded slot machines are included if the system 200 is set is for slots only. In other embodiments, a new setting includes carded table patrons as well, which may be defined as all players with an open rating. This open rating works with TABLE VIEW, IGT TABLE TOUCH, or with a manual option to open a player rating within the Casino Player Rating System. Additionally, single operation or a soft-defined plurality can be included in the program.

In one embodiment of the multi-site power winners system 200, one operation is set up as the Parent Property for the "winners application." In this embodiment, only the Parent Property is able to be configured as a Multi-Site winners selection for all defined properties and Local Property winner selections for their site. All local power winners programs are set up at the Local Property for Slots/Table carded or un-carded play. If the Parent Property is not part of the selection program, a Main Property is assigned within the settings. Main Property performs the responsibilities of the Parent when they are not included in the program.

In one embodiment of the multi-site power winners system 200, a Parent Property is allowed to set up a winners code as Multi-Site "Y" or "N." In such an embodiment, a new screen is displayed that enables an operator to continue to set up the winners code as needed. This screen will also have a field to denote carded or un-carded play. The Parent Property entry also assigns a Main Property for the promotion. When setting up a Multi-Site winners option, the operator also sets up the corporate and property codes. This process enables a plurality of combinations within the multi-site power winners system 200.

Once the winners code has been established, an operator may define what criteria are included or excluded from the "winners application." The criteria includes, by way of example only, and not by way of limitation: carded or non-carded players, active slot machines or active table seat, and the like. Additionally, the operator may decide whether or not to establish a casino-wide winners program or just for table or slot active locations; club or card level; a specific Pit, Zone, Denomination or Game Code; a manufacturer type of machine or only specific assets.

Finally, in one embodiment, the operator establishes a non-winners bonus code or a chain reaction bonus to determine the value a patron will receive if that patron is determined to be part of the winners code. The Reward is set up at each property that is part of the winners code program. This is established manually at each site even though the winners code is set up in an automated fashion. The Parent Property is in charge of setting up all information at all included sites. In this embodiment, non-carded players are not able to receive a bonus at next card in. Instead, these non-carded players need to be set up. Additionally, table players typically need to provide some type of coupon, or possibly match play.

The winner selection module selects the winning players list based on code criteria. The multi-site power winners system 200 selects the random winner when notified by the PPE 210 and sends the winner information to the PPE and host system. In one embodiment, setup screens include various criteria for the winners code offering. These criteria include, by way of example only, and not by way of limitation: (1) Number of sites; (2) Enabled for Slots, Tables, or both; (3) Start and end dates and times; (4) Average win (requiring X amount of winnings by player on base game to qualify for Progressive); (5) Average Wager Required (requiring X amount of wagers by player on a base game to qualify for Progressive); (6) Show the number to display (multiple shows—pre progressive, during progressive, award being triggered, and selected winner notification/loser notification); (7) Carded or non-carded players; (8) Days to claim chain reaction or bonus for non-winners offering; (9) Information to be sent to Surveillance; (10) Display information on the Casino Floor, and overhead LCDs.

The PPE 210 process determines the increment rate, duration of the time period, and the growing progressive value. The increment rate is modified during the period to ensure the desired average progressive size is awarded. The progressive value grows from the starting value to the desired average progressive award value.

The PPE 210 determines when a progressive is triggered at a random time during the bonus period. In one embodiment, when the PPE 210 determines the trigger time, the engine freezes the growing progressive value and notifies the "winners application" that it is time to select the random winner. The PPE 210 also identifies the value. Additionally, the PPE 210 notifies the signage display controllers of the current progressive values and that a winner will be drawn.

The CMP/CMS 220 (casino market place/casino marketing server) then performs the following activities: (1) Run the random selection of the specific winner(s) based on the initial criteria set up for that winners code; (2) Notify the PPE 210 server the progressive was awarded; (3) Send the winner data to the PPE 210 for display on the overhead signage; and (4) Send the prize to the appropriate player account if carded play or manually based on overhead signage notification or message to marketing location that will present the prize to a non-carded player at the EGM. Notification is sent to the specific EGM, iVIEW, or 2-line display device to notify the winning player that he/she has won, so the player does not leave the gaming machine.

In another embodiment, surveillance takes a picture of the player at the machine and transfers the image to the cage/club desk for visual identification of the winning player. In this embodiment, either (1) the iVIEW (or 2-line display device)

provides a redemption code for the player, or (2) a ticket is printed out (dual port printing) for redemption at the cage or club desk at a later time. In some embodiments, the surveillance also projects the picture of the winning person on various displays throughout the casino to let everyone know the identity of the winner.

In one embodiment, the multi-site power winners system 200 may send prizes to non-winner accounts based on system soft settings. This win amount could be associated with given redemption code(s). Expiration rules for these non-carded power winner awards are also configurable. Alternatively, non-identified players who win can collect the prize in the following ways:

(1) Ask players to insert their player card (if they have one) to bind the win to the card number. AFT transactions may occur at that time or at a later time on another gaming machine or at the cashier cage. Expiration rules would apply.

(2) Require registration of the unidentified player at the gaming machine (base game or iVIEW or 2 line display) in order to associate the awards with the player account. Registration may require a username/password/pin to access the account (temporary or permanent). The unidentified player would then have to go to the club desk and officially create an account (present formal identification, bio-data, or the like). At this time, the winning can now be made accessible subject to expiration rules.

(3) After the award, a redemption code is presented to the player on any display in the gaming cabinet. The player then enters this code to accept the award at this gaming device. Cashable or non-cashable funds may be credited to the gaming machine at this time.

(4) After the award, a redemption code is presented to the player on any display in the cabinet. The player may then be asked to enter/select a PIN or password to be used later in association with this redemption code. A player may redeem the award (or portion of award) at any time on any device, or with the cashier, subject to expiration rules.

In one embodiment, the multi-site power winners system 200 selects a winner player from one or more of the following gaming machines: (1) Slot Machines—if they have an Active Player with a card. (2) Table Games—if a patron has an open rating. (A pointer or wheel at the table is used to point to the winning player(s). Alternatively, each player may select a number that the software would use to select a winning number). (3) Slot Machines—if they are active without a patron card inserted. (4) Table Games—if the table is open and the winner is selected based on seat number at the table.

Additionally, a patron may register to be included in the "winners offering" or another activity may put them in play for a chance at winning. Many options are available within a Casino Resort operation: horse racing, keno, hotel check-in, entrance to a show or another activity. All non-winners at the time of random selection have the ability to receive an offering based on system settings. The system 200 allows for soft settings so that one or a plurality of properties may be included in the random winner selection.

In one embodiment of the multi-site power winners system 200, the "Power Winner" is selected and receives a prize based on internal controls of the casino operator. This is normally set up as a marketing expense (through the CMS 220), but the system 200 also enables the expense to be handled and tracked with an external meter sent from the winners application. In one embodiment, all non-winners receive a reward using the Power Rewards program. The notification is made at the next card-in at a gaming machine, or alternately, the notification may be sent immediately, based on the setting in the reward program.

In one embodiment of the multi-site power winners system 200, the winner receives the prize based on the random selection at the slot machine or table game seat. At a table game, the dealer/pit boss may identify the number of players playing for the multi-site power winners game. The power winners game tells the dealer/pit boss which specific player won from the non-identified players. Typically, players are paid at this time. In one embodiment, the non-winners receive a bonus or chain reaction in their account and are notified either at the next card-in, or are notified immediately, based on settings of the winners code.

In an embodiment of the multi-site power winners system 200, all players at a gaming establishment that are playing a gaming machine can view the signs, which are displayed throughout the casino and property, that the winner has been selected. This process is within the marketing programs used for the property. The PPE 210 first determines that it is time for the random selection and then the marketing server program completes the random selection based on the soft settings for this winner selection.

Typically, in one embodiment of the multi-site power winners system 200, the power winner is notified at the gaming machine at which they are playing or at the table game at which they are playing, based upon signage. In this embodiment, all non-winners (if set up for the Power Rewards code, which is another soft setting) are notified based on controls at each sight. Signage throughout the property is a useful notification piece for all players, whether carded or un-carded, that the winner was selected.

Players can redeem their Power Reward "non-winners prize" during the time frame that it is active. Once this time period has expired this non-winners prize is no longer available. Winners have the funds available to them based on IRS and regulatory compliance issues being followed for that property.

In the multi-site power winners system 200, the qualifications for the winner's selection are soft (i.e., may be altered by the operator setting up the reward criteria), and each selection by the multi-site power winners system may implement differing criteria. One selection could be a local slot selection for all slot players requiring a card to be in the machine. Another selection could be for all players whether a card is required or not. This selection would require an active slot or table game. The selection could run for two properties within a region of the multi-site power winners system 200.

In another embodiment, the multi-site power winners system 200 may include another selection that is a large random selection for a particular holiday. For example, the marketing group may determine that the winner on a specific day for all sites will receive a cash prize and a trip. With each winners code created, the Parent Property determines if the random selection is Local or Multi-site. If the selection is Multi-Site there are other soft settings that need to be set up based on the number of properties included within the multi-site power winners system 200.

In another aspect of the multi-site power winners system 200, an operator determines whether an award will cover players at Slot gaming machines, Table gaming machines, or both. Further, an operator who sets up an award determines whether only gaming machines with an active card are recognized or if all active gaming machines and open tables are included. In one embodiment, any action by a patron could include that patron in the pool of potential winners eligible for the random selection. An operator of the multi-site power winners system 200 may continue to narrow the scope of eligible participants by Denominations, Game codes, Manufacturers of Slot Machines, Zones or Pits. An operator may even set up the multi-site power winners system 200 for some specific slot assets. Further, in one embodiment of the multi-site power winners system 200, if a player is not identified, the property sets up internal controls to determine if the prize is provided to another patron or kept available for a certain period of time based on their rules of the program.

In a preferred embodiment, the multi-site power winners system 200 enables casinos within a corporate structure to have a power winners program that is available across multiple properties. The multi-site power winners system 200 does not require patron numbers at the Universal or Regional Level. The system 200 enables a user to have property 1A and 1B in a first winner's code and 1C and 1D in a second winner's code.

Promotional Progressive Engine (PPE) communicates with CMP/CMS 220 or other Player Tracking and Promotional servers through Web Services. The following Web Services are provided by the PPE:

Power Winners-Power-Progressive Engine:

In one embodiment of the basic power winners system, the Power-Progressive Engine is a system game that is displayed to the patrons at the slot machines on the casino floor. It is a time and value-based progressive which is funded by marketing dollars that is paid to the winning patron, who has a player tracking card inserted into a slot machine at the time the winning value is selected. The progressive is available to all patrons based on the grouping of the specific progressives settings, which can include all slot machines on the casino, or restrict it to specific slot machines, by the slot machines denomination(s), and/or by the slot machines manufacture(s) and/or by the slot machines zone(s), or a set of specific asset (slot machine) numbers.

A casino operator enters an average desired progressive $ amount (ex. $1000), an average desired progressive award time (ex. 24 hours), and a progressive reset amount (ex. $250). The actual progressive grows from the reset value towards the desired value. The progressive growth is not

| | Name | Purpose |
|---|---|---|
| 1 | createPromotion(overloaded) | Creates a new promotion on the PPE database. It takes all the necessary arguments to create a new promotion and returns back a ProgID - unique identifier for a newly created promotion. |
| 2 | createPromotion(overloaded) | Creates a new promotion on the PPE database. It takes all the necessary arguments to create a new promotion and returns back a "ProgID" unique identifier for a newly created promotion. Contains one additional parameter "floorWiggleRange". SOAP MessageName = "CreatePromotionWithFloorWiggleRange" |
| 3 | createPromotion(overloaded) | Creates a new promotion on the PPE database. It takes all the necessary arguments to create a new promotion and returns back a "ProgID" unique identifier for a newly-created promotion. Contains two extra parameters "MaxValue" and "WinTicketTable". SOAP MessageName = "CreatePromotionWithMaxValue" |
| 4 | requestPromotion Value | Returns the current value of a promotion for a specific ProgID. |
| 5 | requestWinner | Returns a list of all progressives (ProgIDs) that have been triggered. |
| 6 | confirm WinnerNotification | Updates the PPE database to acknowledge that the CMP/CMS server has been notified that a certain promotion (ProgID) is completed. |
| 7 | postWinner(overloaded) | Updates the PPE database with the winner information provided by CMP/CMS or other promotion server. |
| 8 | updateFloorActivity | Updates the PPE database to record current floor activity value. This value is then used by the PPE engine to growth the progressive in tune with the general floor activity. |
| 9 | getAllPromotions | Returns information about all currently-running promotions (progressives). |
| 10 | deletePromotion | Deletes a currently running promotion (ProgID). |
| 11 | suspendPromotion | Suspends a selected promotion. |
| 12 | restartPromotion | Restarts an already suspended promotion. |
| 13 | suspendAllPromotions | Suspends all running promotions. |
| 14 | restartAllPromotions | Restarts all suspended promotions. |
| 15 | updateCurrentFloorWiggle | Updates the current floor wiggle for a specific promotion. |
| 16 | postWinner(overloaded) | Updates the PPE database with the winner information including PropertyID and GamingLocation provided by CMP/CMS or other promotion server. SOAP MessageName = "PostWinnerWithPropertyIdGamingLocation" |
| 17 | createProperty | To create a new gaming property for signage. |
| 18 | updateProperty | To update a created property |
| 19 | disableProperty | To temporarily flag a property as disabled or not used. |
| 20 | enableProperty | To enable a disabled property. |
| 21 | assignProperty | Assign a property to a promotion for signage to send messages. |
| 22 | assignProperties | Lets you assign multiple properties at a time. |
| 23 | unassignProperty | To remove assignment of a property to a promotion. |
| 24 | getAllProperties | Lists all the properties created. |
| 25 | getProgressiveProperties | Lists all the properties assigned to a promotion. |
| 26 | getPropertyProgressive | Lists all the promotions a property is assigned. |

linked to wagering activity on the casino floor. At a random time during the progressive growth the award is triggered. At the award time, the actual progressive value is stopped from growing any further and is randomly awarded out to the floor.

The patron is automatically eligible for specific progressives and does not need to interact with the slot machine or system to increase their chances of being selected as the winner. The Power-Progressive system will, on average, award the desired amount of money in the desired amount of time if the same progressive is run several times. This system also ensures unpredictability of award time or award size by the players or casino personnel.

In one embodiment, the Power-Progressive Engine requires a License Key to be active. Once the license key is activated, the user can activate or inactivate the Power-Progressive feature by accessing the activation screen. The Power-Progressive control screen will be displayed indicating the status of the Power-Progressive feature, either inactive or active.

Preferably, an operator of the system can change the name of Power-Progressive to be what ever they desire. The user enters an 'N' (No) to inactivate this feature or enters a 'Y' (Yes) to activate this feature. This feature requires the valid number of assets to be set before allowing a setting of 'Y' (Yes) to activate. If the required license key is not active this field will be set to 'N' (No).

Another setting controls how many of the Power-Progressive values are to be broadcast to the casino floor. A setting of one indicates only the progressive with the highest current value will be broadcast. A setting of two indicates the two progressives with the highest current values are to be broadcast to the casino floor.

Still another setting establishes the frequency in minutes to refresh the Progressives Engine. This setting indicates how frequently to update the Power-Progressive engine with the current floor activity, where the one common setting is 15 minutes.

Yet another setting establishes which assets are to receive the Broadcast values. This setting controls which assets (slot machines) are to receive the Power-Progressive broadcast values messages. Valid settings are: A=All assets, C=Only assets with a patron Card-in, N=Only asset without a patron card-in.

In one embodiment, another setting includes "days before archiving data." This setting controls which Power-Progressive data is retained on the system before being archived into the SMS purge library. A setting of zero indicates to not archive the data, but rather keep the data on-line and available. If a value is entered the data will be removed from the system once the progressive's ending date is older than the number of days in this setting. Once the daily summary's date is older than the number of days in this setting, the data will be removed. In this scenario, the data in the winners selection file is archived into the SMS purge library.

Still another setting is the "days before archiving daily detail data" setting. An entry of zero indicates no archiving. This setting controls which Power-Progressive detail log data is retained on the system before being archived into the SMS purge library. A setting of zero indicates to not archive the data, but rather keep the data on-line and available. If a value is entered, the data will be removed from the system once the detail log records transaction date is older than the number of days in this setting. In such a scenario, the data is archived into the SMS purge library.

Yet another setting is the "log inbound and outbound detail data" setting. This setting controls if the inbound data from the Power Progressive Engine and the outbound data to the Power Progressive Engine is to be logged, a setting of 'N' (No) indicates to not log the detail data a setting of 'Y' (Yes) indicates the detail data is to be logged in the detail data file. Other criteria include Class file for Progressives JAR file and Parameters for Progressives JAR file. Once the activation setting is a 'Y' (Yes), the next time the SMS jobs are started two additional jobs will activate within the SMS job subsystem.

In one embodiment, the system includes the MOUNDSOFMONEY process and the MOUNDSMONEYCN process. MOUNDSOFMONEY processes Power-Progressive transactions between the iSERIES and the Power-Progressive engine. It writes transactions to a data queue and reads transactions from a data queue. MOUNDSMONEYCN processes communications (connection) programming between the iSERIES and the Power-Progressive engine. It reads a data queue, and sends transactions to the engine, and receives transactions from the engine and writes them into another data queue.

In one embodiment, the game manufacturer controls the number of slot machines for which the Power-Progressive feature is available. This value is set before utilizing the Power-Progressive feature. The number of slot machines can be unlimited, and the expiration date can go up to Dec. 31, 2069. In such an embodiment, to set this value, an operator requests the encrypted control from the game manufacturer. After the encrypted value is received, it must also be applied.

After the game manufacturer support personal verifies that the customer requesting the encrypted number of assets has the right to use the Power-Progressive feature, if the customer has the right to use the feature, they verify the number assets (slot machines) on which the customer has the right to use the Power-Progressive feature. These verifications are typically retrieved from the customer's project manager or their sales representative.

In one embodiment, when setting the assets for a power progressive, the user sets all of the slot machines allowed in the Power-Progressive feature. This function is only required when the number of slots allowed to the Power-Progressive feature is not unlimited. Current limits are displayed via the marketing menu. As an operator adds or removes asset numbers, the number of your current assets assigned will increase/decrease. An operator cannot add more asset numbers than his current limit.

In one embodiment, an operator begins the process of creating a power progressive by accessing a marketing menu, and selecting the option for power-progressive. The operator then creates a Power-Progressive by entering the following data, which is recorded in the Power-Progressive master file: (1) a Power-Progressive code; (2) the winning patrons iVIEW show number; (3) the winning iVIEW show number to be broadcast to slots on the casino floor; (4) a Power-Progressive description; (5) a starting date and time, (must be in the future, note time is military format Hours: Minutes: Seconds.); (6) an average winning amount; (7) a reset amount; (8) the progressives average length of time in Days, Hours, and Minutes; (9) which patron card levels are included, the highest card levels, the middle card levels, or the lowest card levels (at least one must be set to 'Y' (Yes)); (10) the number of times to have the progressive repeat; (11) whether surveillance is to be notified when a winner is selected; (12) the iVIEW show number to broadcast the Power-Progressive's values on the casino floor as it grows; (13) whether an external system is to be informed of the Power-Progressive's winners as they occur; (14) which slot denominations are included in this Power-Progressive; (15) which slot machine SMS manufacture codes are included in the Power-Progressive; (16) how the winning amount is to be awarded to the patron referred to as payment type; and (17) which slot machines zones are included in this Power-Progressive.

Referring again to setting (16), how the winning amount is to be awarded to the patron referred to as payment type, the two options supported are: E=eBONUS and H=Hand pay. If eBONUS is selected, the operator then enters an eBONUS code to link to the Power-Progressive. The operator also sets the number of days the patron has to take the eBONUS monies once applied. In one embodiment, if the eBONUS is selected, the potential winning amount can not exceed the eBONUS limit of $65,535. The potential winning amount is the average winning amount times 1.25, and requires the eBONUS Flex-Play to be active, and the Slot NT code 107.70 or high running on all gear-boxes. If an eBONUS is linked, the number of days to claim overrides the eBONUS master's start date/time ending date/time, the required play amount is forced to zero, and the winning amount is forced to the amount of the progressive. The winning patron's eBONUS record is created with a starting date and time, the ending date and time, and the date and time to claim the award, which are set to the starting date and time, plus the number of days to claim the award. The eBONUS cannot already be linked to another Power Progressive, and an operator cannot link an eBONUS to this Power Progressive if the repeat option is greater than one.

In one embodiment, the user adds an asset number (valid range is 1 to 65000), or deletes an existing asset number, or deletes all asset numbers currently assigned. Once a progressive has started, these cannot be changed. So a user must make sure these are set correctly before the progressive starts. If the user wishes, he can also award eBONUS monies to the patrons who were eligible but not selected as the winning patron. The user enters the eBONUS code to link to this Power Progressive, and by the patron's card level the amount of monies to be awarded, and the number of days the patron has to claim the eBONUS award amount. The eBONUS code cannot already be linked to another Power Progressive. As the Progressive grows or is won or set up to repeat, an operator can view the status, the value(s), and the history of the progressive.

When an operator creates a new progressive on the iSERIES, the SMS programming detects that the progressive should be activated, generates an "ADD TO ENGINE" transaction, and sends this transaction to a data queue. The ADD transaction written to the data queue typically contains the following data fields:

| | | | | |
|---|---|---|---|---|
| ADD TO ENGINE, value 001. | TRID001 | A | 01 | 03 |
| AVERAGE WIN AMOUNT | AVG$001 | A | 04 | 18 |
| AVERAGE LENGTH OF TIME, MIN. | AVGT001 | A | 19 | 33 |
| SMS Power-Progressive CODE | PRCD001 | A | 34 | 41 |
| Power-Progressive DESCRIPTION | PRZD001 | A | 42 | 81 |
| STARTING DATE YYYYMMDD | SDHY001 | A | 82 | 89 |
| STARTING TIME HHMMSS | STME001 | A | 90 | 95 |
| RESET AMOUNT | STR$001 | A | 96 | 110 |
| SEQUENCE NUMBER | SEQ#001 | A | 111 | 113 |
| DISPLAY ON SIGNAGE Y = YES N = NO | DSPL001 | A | 114 | 114 |
| WINNING PATRON SHOW NUMBER | SHO#001 | A | 115 | 117 |
| BROADCAST CURRENT VALUES SHOW# | SHOB001 | A | 118 | 120 |
| BROADCAST WINNER SHOW NUMBER | SHOG001 | A | 121 | 123 |

The connection program on the iSERIES reads the data queue and forwards the "ADD TO ENGINE" transaction to the engine via its connection. When the engine receives the "ADD TO ENGINE" transaction, the engine generates its "PROG ID. CODE," and responds with the following data, back to the iSERIES via its connection. The connection program writes the following image to a data queue.

| | | | | |
|---|---|---|---|---|
| ADDED TO ENGINE, value 101. | TRID101 | A | 01 | 03 |
| SMS Power-Progressive CODE | PRCD101 | A | 04 | 11 |
| ENGINE PROG. ID CODE | PRCL101 | A | 12 | 19 |
| SEQUENCE NUMBER | SEQ#001 | A | 20 | 22 |

The SMS programming on the iSERIES reads the data queue, updates the progressive record as having been added and activated on the engine, and links the Engine PROG.ID to the SMS Power-Progressive code.

If the user decides to delete (remove) an existing progressive, the user flags the existing progressive on the iSERIES. The SMS programming then generates a "DELETE FROM ENGINE" transaction and sends this transaction to a data queue. The DELETE transaction written to the data queue typically contains the following data fields:

| | | | | |
|---|---|---|---|---|
| DELETE FROM ENGINE, value 002. | TRID002 | A | 01 | 03 |
| SMS Power-Progressive CODE | PRCD002 | A | 04 | 11 |
| ENGINE PROG. ID CODE | PRCL002 | A | 12 | 19 |
| SEQUENCE NUMBER | SEQ#002 | A | 20 | 22 |

The connection program on the iSERIES reads the data queue and forwards the "DELETE progressive to the engine" transaction to the engine via its connection. When the engine receives the "DELETE FROM ENGINE" transaction, it removes the progressive from its active progressives, and responds with the following data back to the iSERIES via its connection. The connection program writes the following image to a data queue.

| | | | | |
|---|---|---|---|---|
| DELETED FROM ENGINE, value 102. | TRID102 | A | 01 | 03 |
| SMS Power-Progressive CODE | PRCD102 | A | 04 | 11 |
| ENGINE PROG. ID CODE | PRCL102 | A | 12 | 19 |
| SEQUENCE NUMBER | SEQ#102 | A | 20 | 22 |

The iSERIES SMS programming periodically updates each active progressive's "Number of Assets" and "Number of Carded Assets" values. Once the iSERIES has been updated it will notify the Engine of these values with a "UPDATE NUMBERS" transaction, and sends this transaction to a data queue. The "UPDATE NUMBERS" transaction written to the data queue will contain the following data fields:

| | | | | |
|---|---|---|---|---|
| UPDATE NUMBERS, VALUE 003. | TRID003 | A | 01 | 03 |
| NUMBER OF SLOTS | #AST003 | A | 04 | 13 |
| NUMBER CARDED SLOTS | #CRD003 | A | 14 | 23 |
| ENGINE PROG. ID CODE | PRCL003 | A | 24 | 31 |

The connection program on the iSERIES reads the data queue and forwards the "UPDATE NUMBERS" transaction to the engine via its connection. When the engine receives an "UPDATE NUMBERS" for the progressive, it uses these numbers when computing the value of the progressive. The engine does not need to respond to the "UPDATE NUMBERS" transactions.

The iSERIES SMS programming periodically acquires the active progressive's values for each active progressive from the engine, with a "GET CURRENT VALUE" transaction. It then sends this transaction to a data queue. The "GET CURRENT VALUE" transaction written to the data queue will contain the following data fields:

| | | | | |
|---|---|---|---|---|
| GET CURRENT VALUE, VALUE 004. | TRID004 | A | 01 | 03 |
| ENGINE PROG. ID CODE | PRCL004 | A | 04 | 11 |

The connection program on the iSERIES reads the data queue and forwards the "GET CURRENT VALUE" transaction to the engine via its connection. When the engine receives a "GET CURRENT VALUE" transaction for a progressive, it responds with the following data to the iSERIES via its connection. The connection program writes the following image to a data queue:

| | | | | |
|---|---|---|---|---|
| RESPONSE CURRENT VALUE, VALUE 104. | TRID104 | A | 01 | 03 |
| ENGINE PROG. ID CODE | PRCL104 | A | 04 | 11 |
| PROG. ID AMOUNT | CUR$104 | A | 12 | 26 |

The SMS programming on the iSERIES reads a data queue and updates the progressive's record with the current cash value from the engine.

When the engine has determined that a progressive has reached its winning points, the engine generates a "SELECT WINNER VALUE" transaction. The engine then informs the iSERIES by sending the following transaction to the iSERIES via its connection. The engine also stops incrementing the progressive s value. The iSERIES connection program writes the following image to a data queue.

| | | | | |
|---|---|---|---|---|
| SELECT WINNER VALUE, VALUE 105. | TRID105 | A | 01 | 03 |
| ENGINE PROG. ID CODE | PRCL105 | A | 04 | 11 |
| WINNING AMOUNT | CUR$105 | A | 12 | 26 |

The SMS programming on the iSERIES reads a data queue and updates the progressive's current value and winning value (provided by the engine), and attempts to select a winning patron. Once the engine indicates a Power-Progressive progressive has met the criteria to select a winner, the iSERIES programming performs the following:

The engine searches for the matching progressive via the Prog. Id. Once the SMS programming on the iSERIES determines it has found (or not found) the matching progressive by the Prog. Id., it notifies the engine of the match (or no-match) "Match Winning Progressive Data" transaction, and sends the following transaction to a data queue. The "Match Winning Progressive Data" transaction written to the data queue contains the following data fields:

| | | | | |
|---|---|---|---|---|
| SELECT WINNER VALUE, VALUE 006. | TRID006 | A | 01 | 03 |
| ENGINE PROG. ID CODE | PRCL006 | A | 04 | 11 |
| MATCH FOUND Y = YES, N = NO | FOUND006 | A | 12 | 12 |

The connection program on the iSERIES reads the data queue and forwards the "Match Winning Progressive Data" transaction to the engine via its connection. If a match is found, the connection program reads all SMS active slot machine (asset) records from the active assets file, building a work file. Slot machine selection is to only include slot machines with a patron card inserted, where (1) the patron's card type matches the card type(s) assigned to be included in the progressive master, (2) the slot machine's zone on the casino floor matches the zone(s) assigned to be included in the progressive, and (3) the slot machine's SMS manufacture code matches the manufacture code(s) to be included in the progressive. This selection process ensures that each patron is only in the work file one time, and this handles patron using multiple cards at multiple slot machines. The work file typically contains the following data:

| | |
|---|---|
| ASSET NUMBER | 5.0 |
| PATRONS ACCOUNT NUMBER | 9 |
| PATRONS ACCOUNT SUFFIX | 2 |
| RATINGS ASSET DENOMINATION | 7.2 |
| RATINGS ASSET DENOMINATION | 1 |
| GEAR-BOX ID. | 3.0 |
| RATINGS ASSET LOCATION | 4.0 |
| RATINGS ASSET ZONE | 2 |

Once all included assets records have been written into the work file, it can be determined how many records were included. Using a random number program the programming generates a random number between 1 (one) and the number of records in the work file. This record contains the winning patrons account number, and the slot machine (asset) number. The system assigns this patron as the winning patron to the Power-Progressive. It broadcasts transactions to all slot machines on the casino floor announcing the winner and sends a transaction to the slot machine of the winning patron, announcing that they are the winner.

If no winner is selected, the iSERIES programming bypasses selecting a winner until the next cycle, approx. 15 seconds to one minute. Once the SMS programming on the iSERIES selects a winning patron, it notifies the Engine of the winner with a "POST WINNER DATA" transaction, and sends this transaction to a data queue. The "POST WINNER DATA" transaction written to the data queue typically contains the following data fields:

| | | | | |
|---|---|---|---|---|
| POST WINNER DATA, VALUE 005. | TRID005 | A | 01 | 03 |
| ENGINE PROG. ID CODE | PRCL005 | A | 04 | 11 |
| WINNERS NAME | NAME005 | A | 12 | 41 |
| WINNERS CITY | CITY005 | A | 42 | 71 |
| WINNERS STATE/COUNTRY | STAT005 | A | 72 | 101 |

The connection program on the iSERIES reads the data queue and forwards the "POST WINNER DATA" transaction to the engine via its connection. When the engine receives the "POST WINNER DATA" transaction, it may notify any signage with the winning patrons data. The engine should know the winning amount. The engine does not need to respond to the POST WINNER transaction.

Although the invention has been described in language specific to computer structural features, methodological acts, and by computer readable media, it is to be understood that the invention defined in the appended claims is not necessarily limited to the specific structures, acts, or media described. Therefore, the specific structural features, acts and media are disclosed as exemplary embodiments implementing the claimed invention.

Furthermore, the various embodiments described above are provided by way of illustration only and should not be construed to limit the invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed is:

1. A multi-site progressive gaming system including one or more gaming machines connected to a server, and wherein the progressive gaming system has a progressive prize value that increases according to a progressive prize growth rate during a progressive game, the progressive gaming system comprising:

a selectable multi-site properties value, wherein the selectable multi-site properties value defines a number of properties incorporated into the multi-site progressive gaming system;

a selectable targeted progressive prize value, wherein the targeted progressive prize value is selectable by an administrator before the progressive game is initiated;

a selectable targeted progressive prize time which is a theoretical average time when the progressive prize is awarded, wherein the targeted progressive prize time is selectable by an administrator before the progressive game is initiated;

one or more enticement factors including an erratic movement enticement factor, wherein the erratic movement enticement factor contributes erratic movement to the progressive prize value growth rate that causes the progressive growth rate to erratically increase and decrease in a +/−5% range, and wherein the progressive prize growth rate is determined using the selectable targeted progressive prize value, the selectable targeted progressive prize time, and the one or more enticement factors; and a random number generation algorithm that tests to determine if there is a progressive prize win at each time slice, which is calculated from the selectable targeted progressive prize time, before selecting one or more winners of the progressive prize, and wherein the selectable targeted progressive prize time is used to calculate the time period for testing for a progressive prize win;

wherein if a progressive prize win has not been identified, the progressive prize value is incremented by the progressive prize growth rate; and wherein if a progressive prize win has been identified, one or more winners of the progressive prize are determined using the server.

2. The multi-site progressive gaming system of claim 1, wherein eligible players are designated as players at slot machines, players at table games, or players at slot machines and table games.

3. The multi-site progressive processing system of claim 1, wherein eligible players are designated as players from active players with cards, active players without cards, or all active players.

4. A multi-site progressive processing system interconnected to one or more gaming machines that are linked to a server, wherein the system provides an opportunity to win a progressive prize, wherein the system has a progressive prize value that increases according to a progressive prize growth rate, the progressive processing system comprising:

a selectable multi-site properties value, wherein the selectable multi-site properties value defines a number of properties incorporated into the multi-site progressive processing system;

a selectable targeted progressive prize value, wherein the targeted progressive prize value is a modifiable by an administrator;

a selectable targeted progressive prize time which is a theoretical average time when the progressive prize is awarded, wherein the targeted progressive prize time is modifiable by an administrator, wherein the progressive prize growth rate is calculated using the selectable targeted progressive prize value, the selectable targeted progressive prize time, and an erratic movement enticement factor, wherein the erratic movement enticement factor contributes erratic movement to the progressive prize value growth rate that causes the progressive growth rate to erratically increase and decrease in a +/−5% range; and an algorithm that tests to determine if there is a progressive prize win at each time slice, which is calculated from the selectable targeted progressive prize time, before selecting one or more winners of the progressive prize, and wherein the selectable targeted progressive prize time is used to calculate the time period for testing for a progressive prize win;

wherein the progressive prize value is incremented by the progressive prize growth rate; and wherein if a progressive prize win has been identified, one or more winners of the progressive prize are determined using the server.

5. The multi-site progressive gaming system of claim 4, wherein eligible players are designated as players at slot machines, players at table games, or players at slot machines and table games.

6. The multi-site progressive processing system of claim 4, wherein eligible players are designated as players from active players with cards, active players without cards, or all active players.

7. A multi-site progressive processing system interconnected to one or more gaming machines that are linked to a server, wherein the system provides an opportunity to win a progressive prize, wherein the system has a progressive prize value that increases according to a progressive prize growth rate, the progressive processing system comprising:

a selectable multi-site properties value, wherein the selectable multi-site properties value defines a number of properties incorporated into the multi-site progressive processing system;

a selectable progressive prize value at which the progressive prize is given, wherein the selectable progressive prize value is modifiable by an administrator; and a selectable targeted progressive prize time which is a theoretical average time when the progressive prize is awarded, wherein the targeted progressive prize time is modifiable by an administrator, and wherein the progressive prize growth rate is calculated using the selectable targeted progressive prize value, the selectable targeted progressive prize time, and an erratic movement enticement factor, wherein the erratic movement enticement factor contributes erratic movement to the progressive prize value growth rate that causes the progressive growth rate to erratically increase and decrease in a +/−5% range;

wherein the progressive prize value is incremented by the progressive prize growth rate; and wherein a progressive prize win is identified by testing at each time slice, which is calculated from the selectable targeted progressive prize time, before selecting one or more winners of the progressive prize, after which one or more winners of the progressive prize are determined using the server.

8. The multi-site progressive gaming system of claim 7, wherein eligible players are designated as players at slot machines, players at table games, or players at slot machines and table games.

9. The multi-site progressive processing system of claim 7, wherein eligible players are designated as players from active players with cards, active players without cards, or all active players.

* * * * *

UNITED STATES PATENT AND TRADEMARK OFFICE

CERTIFICATE OF CORRECTION

PATENT NO. : 8,348,755 B2
APPLICATION NO. : 12/113026
DATED : January 8, 2013
INVENTOR(S) : Bryan M. Kelly et al.

It is certified that error appears in the above-identified patent and that said Letters Patent is hereby corrected as shown below:

In the Specifications

Column 2, In line 50, add --S-- to “DRAWING”

Column 5, In line 33, replace ““sometime” with --“something--

Column 5, In line 34, replace ““sometime” with --“something--

Column 7, In line 47, replace “gaining” with --gaming--

Column 8, In line 4, remove “s” from “dollars”

Column 19, In line 29, add --’-- to “states”

Column 28, In line 46, remove “be”

Column 36, In line 18, add --’-- to “assets”

Column 45, In line 2, remove “s” from “machines”

Signed and Sealed this
Twenty-eighth Day of May, 2013

Teresa Stanek Rea
*Acting Director of the United States Patent and Trademark Office*